US009919542B2

(12) United States Patent
Kano et al.

(10) Patent No.: US 9,919,542 B2
(45) Date of Patent: Mar. 20, 2018

(54) CUTTING DEVICE

(71) Applicant: Brother Kogyo Kabushiki Kaisha, Nagoya-shi, Aichi-ken (JP)

(72) Inventors: Yasutoshi Kano, Kariya (JP); Kohei Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/390,787

(22) Filed: Dec. 27, 2016

(65) Prior Publication Data

US 2017/0106674 A1 Apr. 20, 2017

Related U.S. Application Data

(63) Continuation of application No. 15/079,480, filed on Mar. 24, 2016, now Pat. No. 9,566,805.

(30) Foreign Application Priority Data

Mar. 31, 2015 (JP) ..... 2015-071074
Mar. 31, 2015 (JP) ..... 2015-071108

(51) Int. Cl.
*B41J 11/70* (2006.01)
*B26D 1/06* (2006.01)
(Continued)

(52) U.S. Cl.
CPC ..... *B41J 11/70* (2013.01); *B26D 1/06* (2013.01); *B26D 1/065* (2013.01); *B26D 3/08* (2013.01);
(Continued)

(58) Field of Classification Search
CPC .. B41J 11/42; B41J 11/70; B26D 1/06; B26D 1/065; B26D 3/16; B26D 3/085;
(Continued)

(56) References Cited

U.S. PATENT DOCUMENTS 4,544,293 A 10/1985 Cranston et al.
9,566,805 B2 * 2/2017 Kano ..... B26D 1/065
(Continued)

FOREIGN PATENT DOCUMENTS

JP 2005-324404 A 11/2005

OTHER PUBLICATIONS

Aug. 31, 2016—(EP) Extended European Search Report—App 16162383.0.

*Primary Examiner* — Huan Tran
*Assistant Examiner* — Alexander D Shenderov
(74) *Attorney, Agent, or Firm* — Banner & Witcoff, Ltd.

(57) ABSTRACT

A cutting device includes a cutting blade, a receiving block, a motor, a cutting blade movement mechanism, and a receiving block movement mechanism. The cutting blade includes a blade portion. The receiving block includes a contact surface including a first contact surface and a second contact surface. The motor is configured to rotate. The cutting blade movement mechanism supports the cutting blade and is configured to move the cutting blade between a separated position and a contact position in concert with a rotation of the motor. The receiving block movement mechanism is configured to move the receiving block from a first opposed position to a second opposed position in concert with the rotation of the motor.

19 Claims, 26 Drawing Sheets

(51) Int. Cl.

| | |
|---|---|
| ***B26D 3/08*** | (2006.01) |
| ***B26D 3/16*** | (2006.01) |
| ***B26D 5/16*** | (2006.01) |
| ***B26D 7/02*** | (2006.01) |
| *B26D 1/00* | (2006.01) |
| *B26D 7/01* | (2006.01) |

(52) U.S. Cl.
CPC ..... *B26D 3/085* (2013.01); *B26D 3/16* (2013.01); *B26D 5/16* (2013.01); *B26D 7/025* (2013.01); *B26D 2001/0066* (2013.01); *B26D 2007/013* (2013.01)

(58) Field of Classification Search
CPC . B26D 3/08; B26D 5/26; B26D 7/025; B26D 2001/0066; B26D 2007/013
USPC ..... 347/110
See application file for complete search history.

(56) References Cited

U.S. PATENT DOCUMENTS

| | | | | |
|---|---|---|---|---|
| 2006/0011040 | A1 | 1/2006 | Uchiyama et al. | |
| 2006/0086220 | A1 | 4/2006 | Kaneko et al. | |
| 2013/0287467 | A1* | 10/2013 | Takahashi ..... | B26D 1/085 400/621 |

* cited by examiner

CUTTING DEVICE

CROSS-REFERENCE TO RELATED APPLICATION

This application is a continuation of U.S. patent application Ser. No. 15/079,480 filed Mar. 24, 2016 which claims priority to Japanese Patent Application Nos. 2015-071074 and 2015-071108, both filed Mar. 31, 2015. The contents of the foregoing applications are hereby incorporated herein by reference.

BACKGROUND

The present disclosure relates to a cutting device.

A cutting device is known that can perform a full cut operation and a half cut operation on an object to be cut. The full cut operation is an operation that cuts the object into two or more pieces. The half cut operation is an operation that cuts the object while leaving a portion remaining. For example, a known cutting device includes a cutter receiver and a cutter blade. The cutter receiver is switched between a first state and a second state. The first state is a state in which a flat surface of the cutter receiver is opposed to the cutter blade. The second state is a state in which a surface of the cutter receiver on which a protrusion is formed is opposed to the cutter blade.

SUMMARY

It is assumed that the above-described cutting device includes a motor that moves the cutter blade, and a motor that switches the cutter receiver between the first state and the second state. In this case, a mechanism of the cutting device may become complex.

Embodiments of the broad principles derived herein provide a cutting device that is capable of performing a half cut operation and a full cut operation with a simple structure.

Embodiments provide a cutting device that includes a cutting blade that includes a blade portion, a receiving block that includes a contact surface contactable by the blade portion, the contact surface including a first contact surface and a second contact surface, the first contact surface including two portions that are contactable by the blade portion and that are aligned with a recessed portion between the two portions, and the second contact surface being a continuous portion contactable by the blade portion, a motor configured to rotate in a forward direction and a reverse direction, a cutting blade movement mechanism that supports the cutting blade, the cutting blade movement mechanism being configured to move the cutting blade between a separated position and a contact position in concert with a rotation of the motor when the motor rotates in the forward direction and when the motor rotates in the reverse direction, the separated position being a position in which the blade portion is separated from the contact surface, and the contact position being a position in which the blade portion is in contact with the contact surface, and a receiving block movement mechanism configured to move the receiving block from a first opposed position to a second opposed position in concert with the rotation of the motor, the first opposed position being a position in which one of the first contact surface and the second contact surface is opposed to the blade portion, the second opposed position being a position in which the other one of the first contact surface and the second contact surface is opposed to the blade portion, the receiving block movement mechanism being configured to maintain the receiving block in a state of being stopped in the first opposed position when the motor rotates in the forward direction, by inhibiting a driving force of the motor from being transmitted to the receiving block, and the receiving block movement mechanism being configured to move the receiving block from the first opposed position to the second opposed position when the motor rotates in the reverse direction, by transmitting the driving force to the receiving block.

BRIEF DESCRIPTION OF THE DRAWINGS

Embodiments will be described below in detail with reference to the accompanying drawings in which.

DETAILED DESCRIPTION

[1. Overview of Printer 1]

A printer 1 that is an example of an embodiment will be explained with reference to the drawings. In the following explanation, the upper side, the lower side, the lower right side, the upper left side, the upper right side, and the lower left side of FIG. 1 respectively define the upper side, the lower side, the front side, the rear side, the right side, and the left side of the printer 1.

Figure 1:
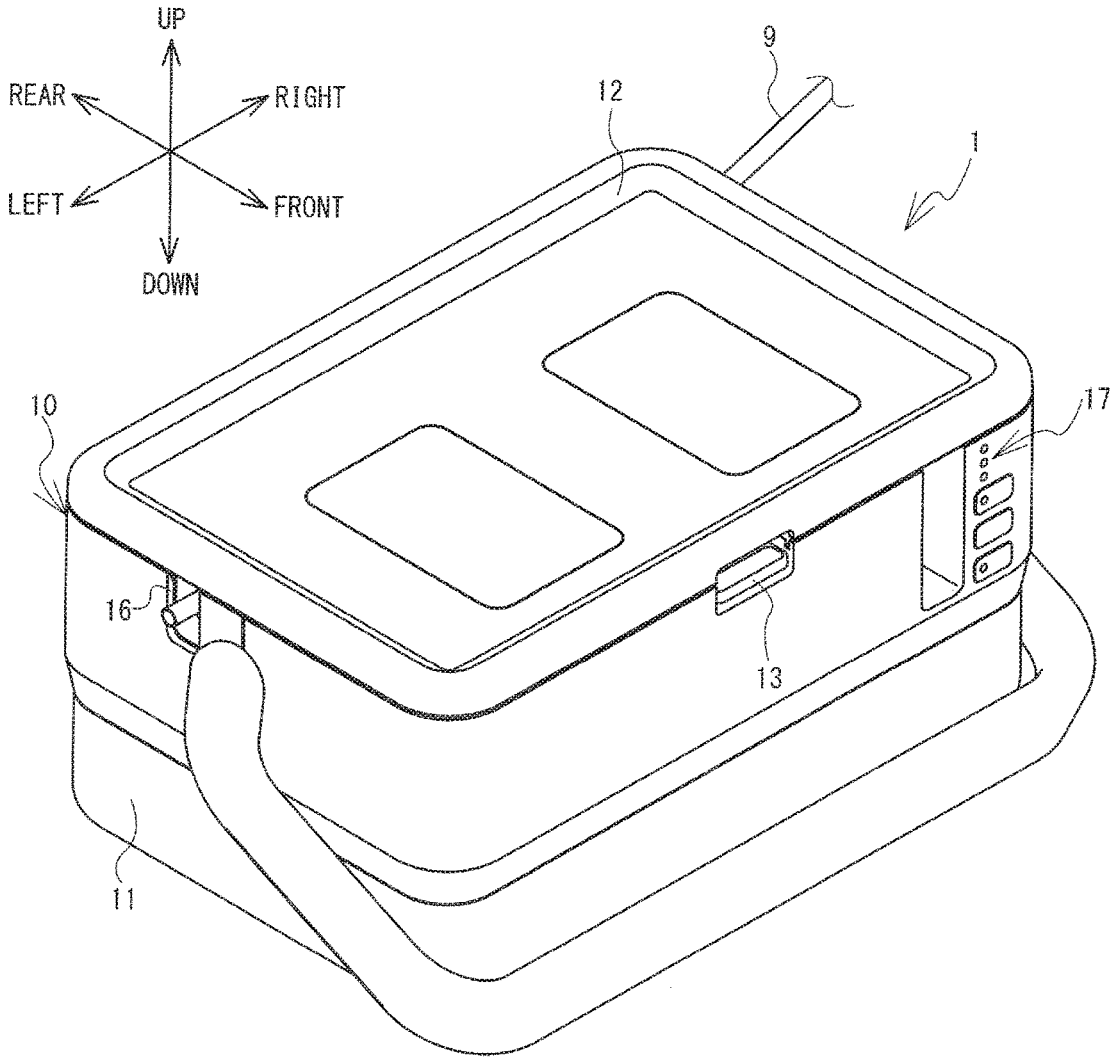
FIG. 1 is a perspective view of a printer 1.
Figure 2:
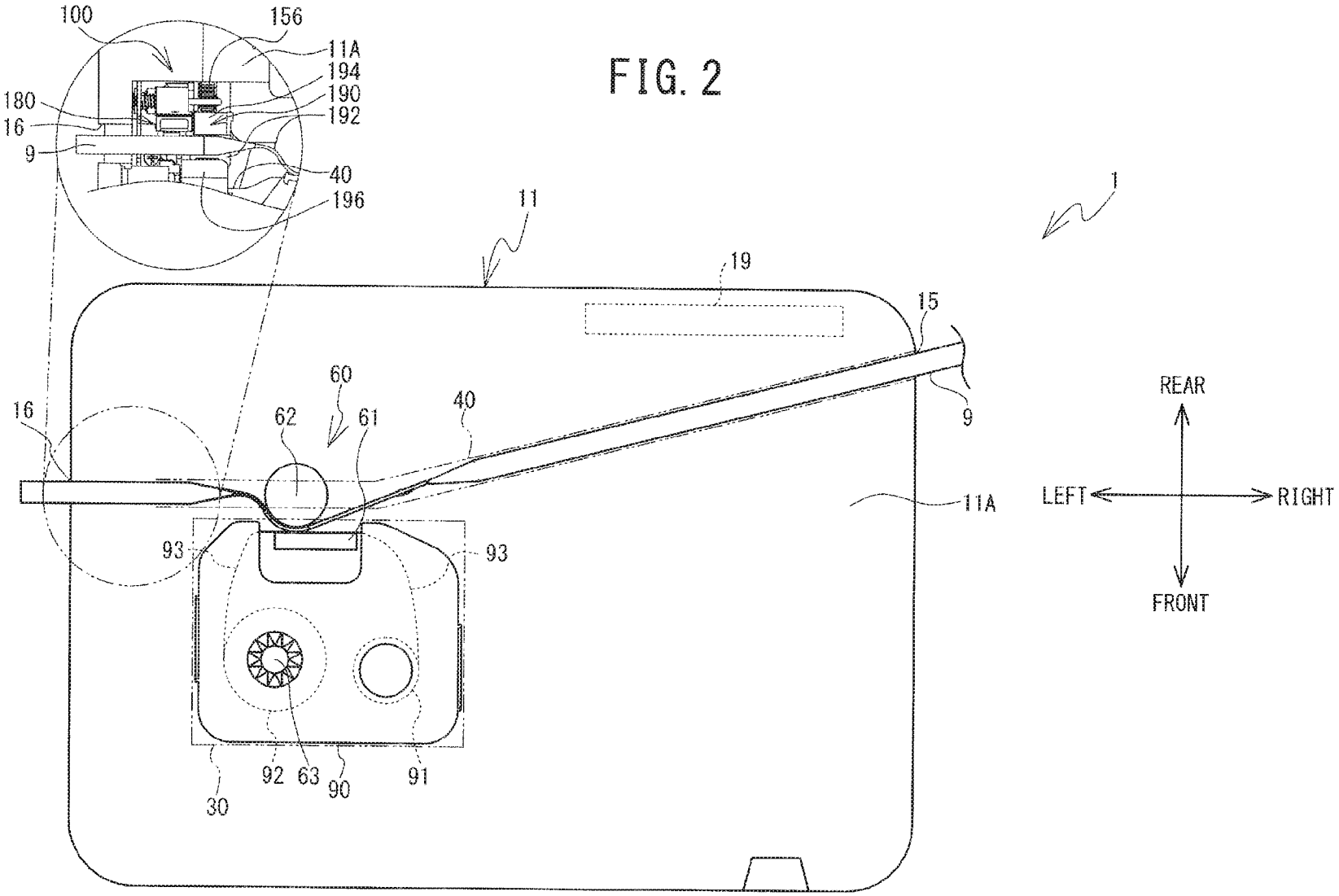
FIG. 2 is a plan view of an interior of a main body case 11.

The printer 1 shown in FIG. 1 and FIG. 2 performs printing on a tube 9, which is a cylindrical print medium. The printer 1 can cut the tube 9 after printing. The printer 1 can perform one of a half cut operation and a full cut operation on the tube 9 after printing. The full cut operation of the present example is an operation in which the whole periphery of the tube 9 is cut such that the tube 9 is cut into two or more pieces. The half cut operation of the present example is an operation in which the tube 9 is cut such that a part of the periphery of the tube 9 is left remaining Hereinafter, when the half cut and the full cut operations are collectively referred to, they are referred to as a cutting operation.

Figure 11A:
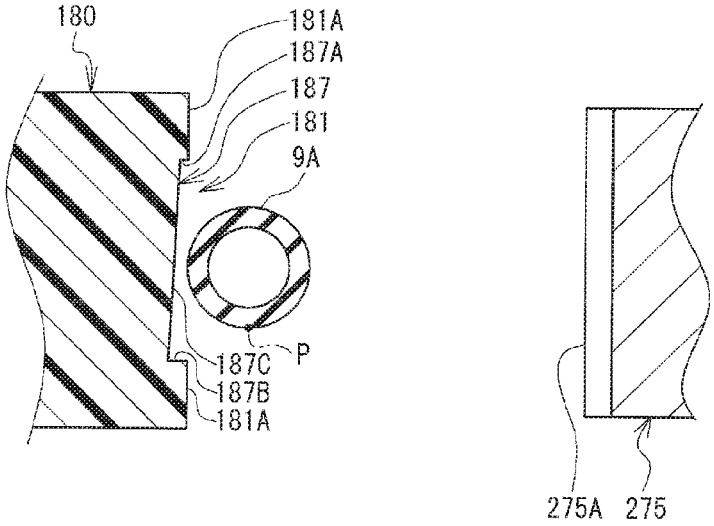
FIG. 11A is a diagram showing a positional relationship between the receiving block 180, a cutting blade 275, and a large diameter tube 9A.
Figure 11B:
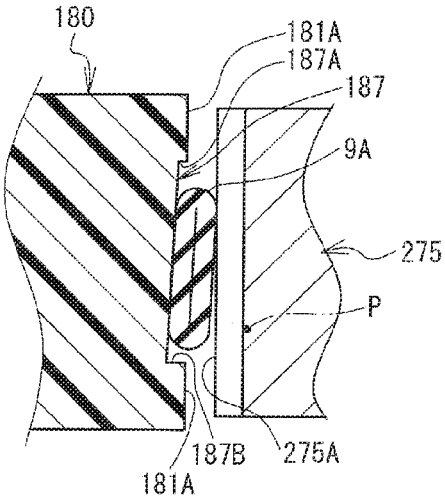
FIG. 11B is a diagram showing a positional relationship between the receiving block 180, the cutting blade 275, and the large diameter tube 9A.
Figure 11C:
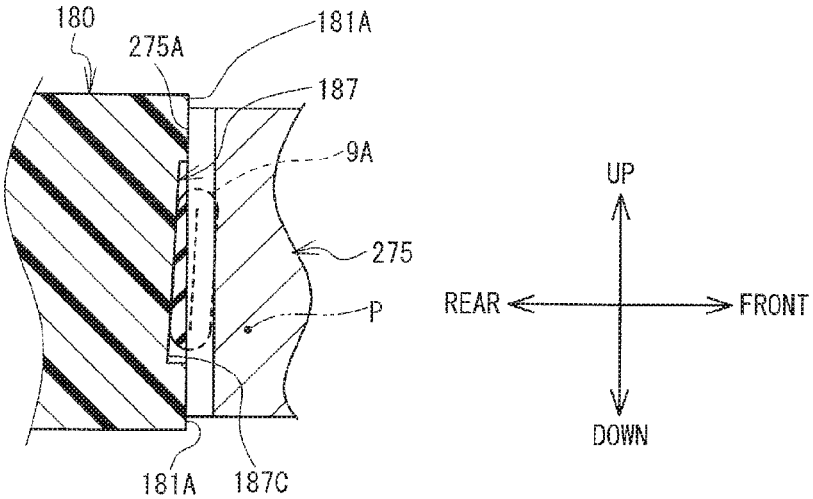
FIG. 11C is a diagram showing a positional relationship between the receiving block 180, the cutting blade 275, and the large diameter tube 9A.
Figure 12A:
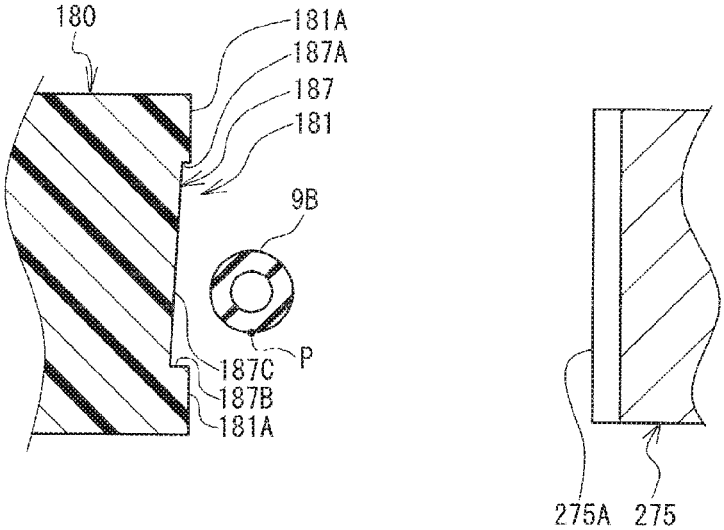
FIG. 12A is a diagram showing a positional relationship between the receiving block 180, the cutting blade 275, and a small diameter tube 9B.
Figure 12B:
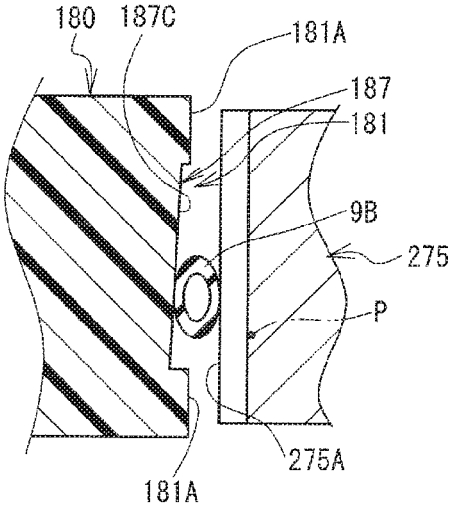
FIG. 12B is a diagram showing a positional relationship between the receiving block 180, the cutting blade 275, and the small diameter tube 9B.
Figure 12C:
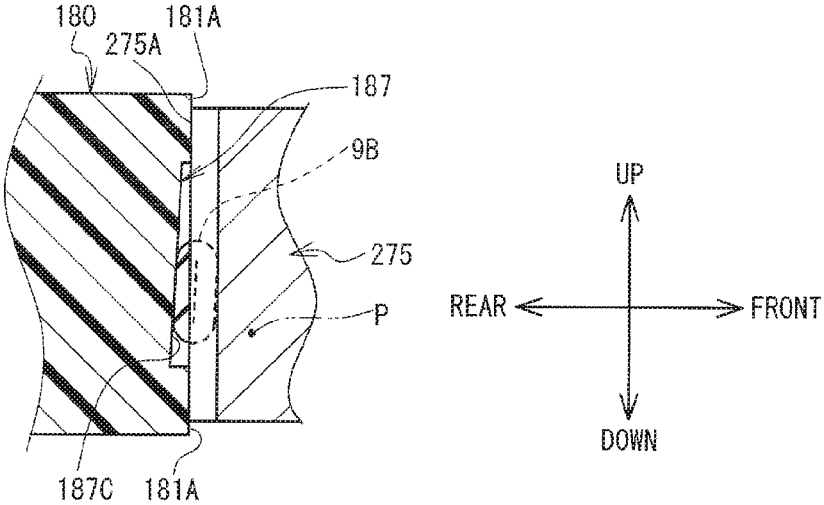
FIG. 12C is a diagram showing a positional relationship between the receiving block 180, the cutting blade 275, and the small diameter tube 9B.

The tube 9 of the present example includes a large diameter tube 9A (refer to FIG. 11A to FIG. 11C) and a small diameter tube 9B (refer to FIG. 12A to FIG. 12C). The large diameter tube 9A is, for example, a tube having an outer diameter of 7.5 mm and an inner diameter of 6.5 mm. The small diameter tube 9B is, for example, a tube having an outer diameter of 4.5 mm and an inner diameter of 4 mm.

As shown in FIG. 1, the printer 1 includes a housing 10, which includes a main body case 11 and a cover 12. The main body case 11 is a cuboid box-shaped member that is long in the left-right direction. The cover 12 is a plate-shaped member that is disposed on the upper side of the main body case 11. A rear end portion of the cover 12 is rotatably supported on the upper side of a rear end portion of the main body case 11. A lock mechanism 13 is provided on the upper side of a front end portion of the main body case 11. The lock mechanism 13 latches a front end portion of the cover 12 when the cover 12 is closed with respect to the main body case 11, and regulates the opening and closing of the cover 12.

When the cover 12 is closed with respect to the main body case 11 (refer to FIG. 1), the cover 12 covers a mounting surface 11A (refer to FIG. 2). The mounting surface 11A is an upper surface of the main body case 11. When a user opens the cover 12, the user may operate the lock mechanism 13 to release the latching of the cover 12. After that, the user may rotate the cover 12 upward away from the lock mechanism 13. When the cover 12 has been opened with respect to the main body case 11, the mounting surface 11A is exposed in the upward direction (refer to FIG. 2).

Side surfaces of the housing 10 are provided with an operation portion 17, a tube insertion opening 15 (refer to FIG. 2), and a tube discharge opening 16. The operation portion 17 is configured by a plurality of operation buttons, including a power source button and a start button. The operation portion 17 is provided on an upper right portion of the front surface of the main body case 11. The tube insertion opening 15 is an opening to guide the tube 9 to the inside of the housing 10. The tube insertion opening 15 is provided on an upper rear portion of the right surface of the main body case 11. The tube insertion opening 15 is a rectangular shape that is slightly long in the up-down direction. The tube discharge opening 16 is an opening to discharge the tube 9 to the outside of the housing 10. The tube discharge opening 16 is provided on an upper rear portion of the left surface of the main body case 11. The tube discharge opening 16 is a rectangular shape that is slightly long in the up-down direction. The tube discharge opening 16 is provided slightly further toward the front side than the tube insertion opening 15.

As shown in FIG. 2, a ribbon mounting portion 30 and a tube mounting portion 40 etc. are provided on the mounting surface 11A. The ribbon mounting portion 30 is a portion into which a ribbon cassette 90 can be removably mounted. The ribbon mounting portion 30 is a recessed portion that is open in the upward direction. The ribbon mounting portion 30 is formed as an open shape substantially corresponding to the ribbon cassette 90 in a plan view. The ribbon mounting portion 30 of the present example is provided in a left portion of the mounting surface 11A and to the front of the tube mounting portion 40.

The tube mounting portion 40 is a portion into which the tube 9 can be removably mounted. The tube mounting portion 40 is a groove portion that is open in the upward direction. The tube mounting portion 40 extends from the tube insertion opening 15 to the vicinity of the right side of the tube discharge opening 16. As described above, the tube discharge opening 16 is provided slightly further toward the front side than the tube insertion opening 15. As a result, the tube mounting portion 40 extends substantially in the left-right direction while tilting slightly toward the front left side. The direction in which the tube mounting portion 40 extends from the tube insertion opening 15 toward the tube discharge opening 16 is referred to as a tube feed direction. The tube feed direction is parallel to a plane that is parallel to the left-right direction and the front-rear direction. The tube feed direction is orthogonal to the up-down direction. An opening cross section of the tube mounting portion 40 is slightly larger than a transverse cross-section of the tube 9, apart from a portion at which the tube mounting portion 40 and the ribbon mounting portion 30 are connected spatially. The opening cross section of the tube mounting portion 40 is orthogonal to the tube feed direction. The transverse cross-section of the tube 9 is orthogonal to an extending direction of the tube 9. The user may mount the tube 9 in the tube mounting portion 40 along the tube feed direction such that the tube 9 extends from the tube insertion opening 15 as far as the tube discharge opening 16.

A control board 19, a power source portion (not shown in the drawings), a tube printing mechanism 60, and the ribbon cassette 90 will be explained with reference to FIG. 2. The control board 19 is a board on which are provided a CPU, a ROM, a RAM and the like that are not shown in the drawings. The control board 19 controls various operations of the printer 1. The control board 19 controls a printing operation of the tube printing mechanism 60, for example. The control board 19 of the present example is provided on a rear right portion inside the main body case 11. The control board 19 extends in the up-down direction and the left-right direction. The power source portion is connected to a battery (not shown in the drawings) mounted inside the main body case 11, or is connected via a cord to an external power source (not shown in the drawings). The power source portion supplies electric power to the printer 1. The power source portion of the present example is provided to the front of the control board 19.

The ribbon cassette 90 is a box-like body that can house an ink ribbon 93. A ribbon roll 91 and a ribbon take-up spool 92 are rotatably supported inside the ribbon cassette 90. The ribbon roll 91 is the ink ribbon 93 that has not yet been used and that is wound on a spool (not shown in the drawings). The ribbon take-up spool 92 is a spool on which the used ink ribbon 93 is wound.

The tube printing mechanism 60 includes a print head 61, a movable feed roller 62, a ribbon take-up shaft 63, a drive motor (not shown in the drawings), and the like. The print head 61 and the ribbon take-up shaft 63 extend upward from a bottom surface of the ribbon mounting portion 30. The print head 61 is provided in a rear portion of the ribbon mounting portion 30. The print head 61 is a thermal head that includes a heating element (not shown in the drawings). The ribbon take-up shaft 63 is a shaft around which the ribbon take-up spool 92 can rotate.

The movable feed roller 62 is a rotatable roller. The movable feed roller 62 is disposed to the rear of the ribbon mounting portion 30. The movable feed roller 62 is opposed to the print head 61. The movable feed roller 62 can be switched between an operating position and a retracted position, in accordance with the closing and opening of the cover 12 (refer to FIG. 1). When the movable feed roller 62 is in the operating position, the movable feed roller 62 is disposed inside the tube mounting portion 40 and is in proximity to the print head 61. When the movable feed roller 62 is in the retracted position, the movable feed roller 62 is disposed to the rear of the tube mounting portion 40, and is separated from the print head 61. The drive motor (not shown in the drawings) is a motor that rotationally drives the movable feed roller 62 and the ribbon take-up shaft 63.

When the cover 12 is open, the movable feed roller 62 is displaced to the retracted position. When the ribbon cassette 90 is mounted in the ribbon mounting portion 30, the ribbon take-up shaft 63 is inserted into the ribbon take-up spool 92. After that, when the cover 12 is closed, the movable feed roller 62 is displaced to the operating position. The movable feed roller 62 overlaps the tube 9 in the tube mounting portion 40 with the unused ink ribbon 93 and urges the tube 9 and the unused ink ribbon 93 toward the print head 61. At this time, the tube 9 is elastically deformed as a result of the urging force of the movable feed roller 62, and the ink ribbon 93 is clamped between a surface of the tube 9 and the print head 61.

The tube printing mechanism 60 performs the following print operation in accordance with control of the control board 19. The drive motor of the tube printing mechanism 60 causes the movable feed roller 62 and the ribbon take-up shaft 63 to rotate. In accordance with the rotation of the movable feed roller 62, the tube 9 inside the tube mounting portion 40 is fed to a downstream side in the tube feed direction. At that time, the tube 9 before printing that is outside the housing 10 is pulled into the inside of the tube mounting portion 40, from the right surface of the main body case 11 via the tube insertion opening 15. When the ribbon take-up spool 92 rotates in accordance with the rotation of the ribbon take-up shaft 63, the ink ribbon 93 is pulled out from the ribbon roll 91.

The print head 61 uses the pulled out ink ribbon 93 to print a character on the tube 9 being fed. The print head 61 of the present example prints a normal image of the character on a front surface of the tube 9 that passes to the rear of the print head 61. Thus, the front surface of the tube 9 is a print surface of the tube 9. The used ink ribbon 93 is taken up by the ribbon take-up spool 92. The tube 9 after printing is fed by the movable feed roller 62 to the downstream side in the tube feed direction. The tube 9 is discharged from the main body case 11 via the left end portion of the tube mounting portion 40 and the tube discharge opening 16.

[2. Structure of Cutting Mechanism 100 and Overview of its Operations]

As shown in FIG. 2, the cutting mechanism 100 is provided between the left end portion of the tube mounting portion 40 and the tube discharge opening 16. The cutting mechanism 100 is a mechanism to perform the cutting operation on the tube 9 after printing. An overview of the cutting mechanism 100 is as follows. The cutting mechanism 100 includes a cutting blade 275 (refer to FIG. 11A to FIG. 11C), and a receiving block 180. The cutting blade 275 and the receiving block 180 are opposed to each other on either side of a tube feed path 9C (refer to FIG. 3). The tube feed path 9C is a path along which the tube 9 is fed from the left end portion of the tube mounting portion 40 to the tube discharge opening 16. The tube feed path 9C extends in the left-right direction. After the tube 9 is disposed on the receiving block 180, the cutting mechanism 100 causes the cutting blade 275 to move toward the receiving block 180. The cutting blade 275 clamps the tube 9 between the cutting blade 275 and the receiving block 180. When the cutting blade 275 presses the tube 9 toward the receiving block 180, the cutting operation on the tube 9 is performed. The cutting mechanism 100 switches the cutting operation on the tube 9 between a half cut operation and a full cut operation, by switching a position of the receiving block 180 in the left-right direction.

Figure 3:
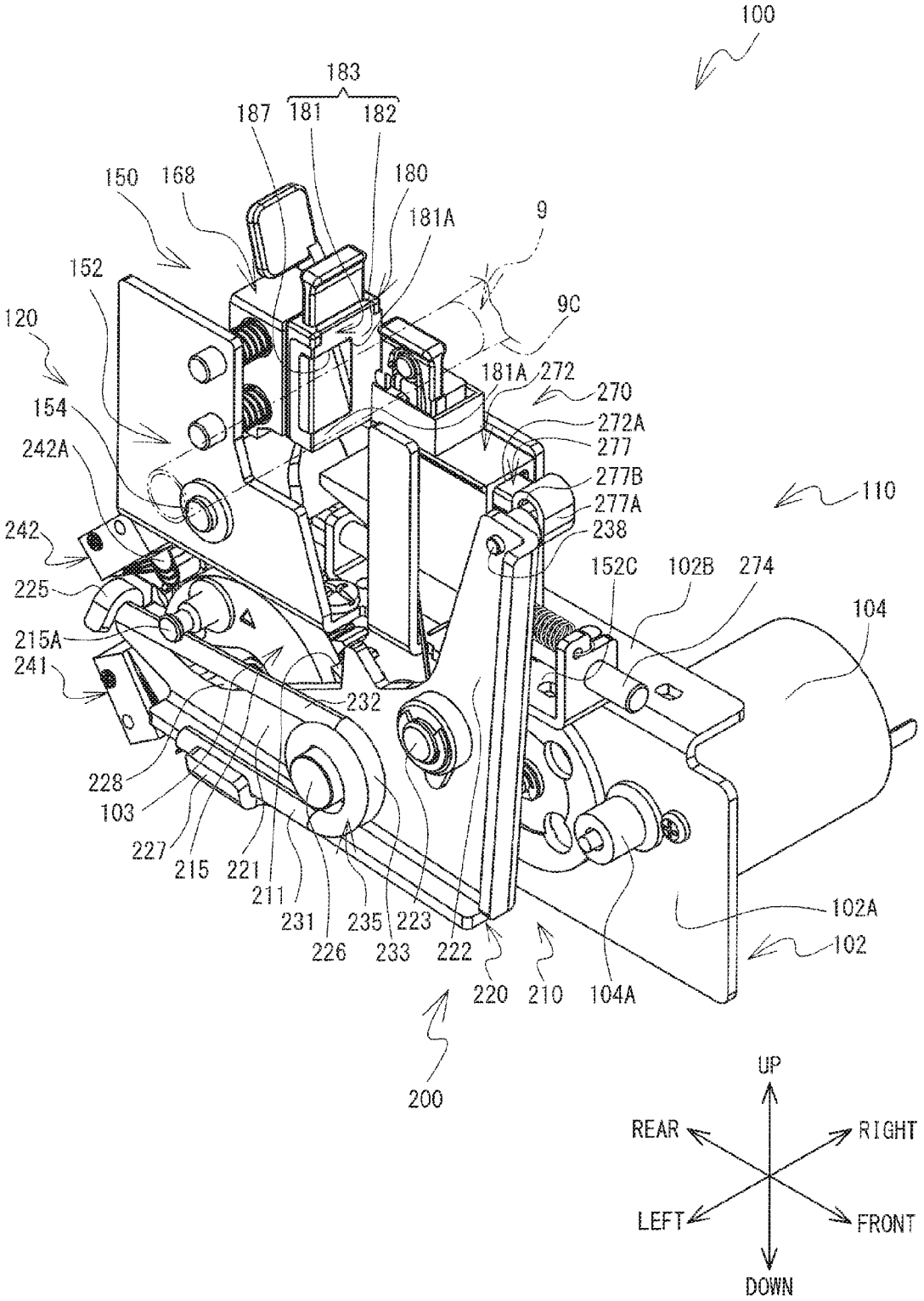
FIG. 3 is a perspective view of a cutting mechanism 100 as seen from the front left.

As shown in FIG. 3, the cutting mechanism 100 includes a positioning portion 190 (refer to FIG. 2), a drive portion 110, a receiving block movement mechanism 120, and a cutting blade movement mechanism 200. The positioning portion 190 guides the tube 9 after printing toward the receiving block 180 while determining a position of the tube 9 in the up-down direction. The drive portion 110 drives the receiving block movement mechanism 120 and the cutting blade movement mechanism 200. The receiving block movement mechanism 120 is a mechanism that supports the receiving block 180 such that the receiving block 180 can move linearly in the left-right direction. The cutting blade movement mechanism 200 is a mechanism that supports the cutting blade 275 such that the cutting blade 275 can move in the front-rear direction.

[2-1. Positioning Portion 190]

As shown in FIG. 2, the positioning portion 190 is disposed further to the downstream side, in the tube feed direction, than the left end portion of the tube mounting portion 40. The positioning portion 190 includes a bottom wall portion 192, a rear wall portion 194, and a front wall portion 196. The bottom wall portion 192 is a wall portion disposed at substantially the same height as a bottom portion of the tube mounting portion 40. A shape of the bottom wall portion 192 is substantially rectangular in a plan view. The bottom wall portion 192 can come into contact with the tube 9 from below and restrict a downward movement of the tube 9. In this manner, the bottom wall portion 192 can determine a position, in the up-down direction, of the tube 9 supplied to the cutting mechanism 100. Hereinafter, a position in the up-down direction of the lower end of the tube 9 that is positioned by the bottom wall portion 192 is referred to as a reference position P (refer to FIG. 11A to FIG. 11C).

The rear wall portion 194 and the front wall portion 196 are wall portions that extend upward from a rear end portion and a front end portion of the bottom wall portion 192, respectively. The rear wall portion 194 and the front wall portion 196 are opposed to each other from either side of the tube feed path 9C. A distance between the rear wall portion 194 and the front wall portion 196 in the direction in which the rear wall portion 194 and the front wall portion 196 are opposed to each other is slightly longer than the outer diameter of the large diameter tube 9A.

[2-2. Drive Portion 110]

Figure 4:
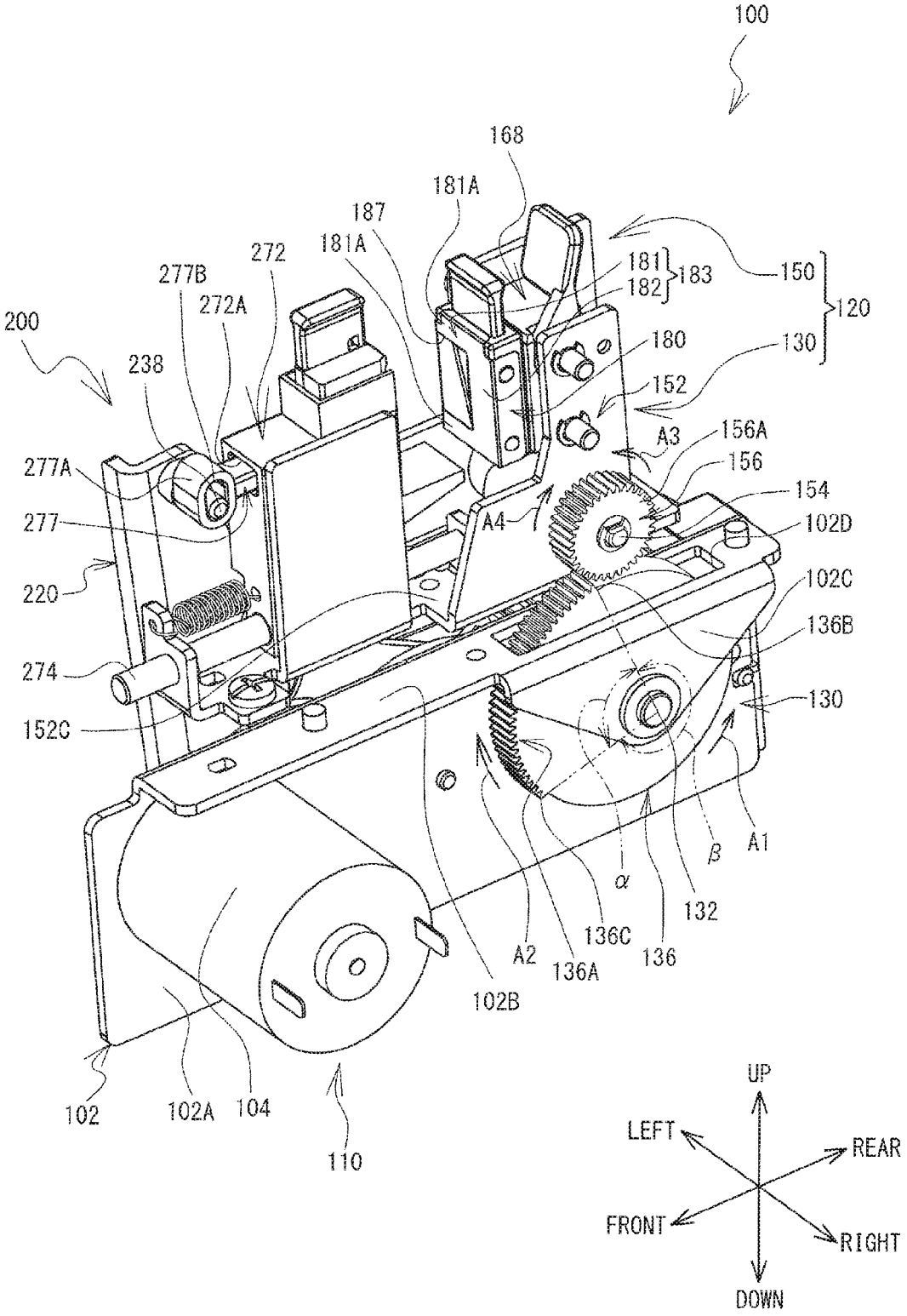
FIG. 4 is a perspective view of the cutting mechanism 100 as seen from the front right.

As shown in FIG. 3 and FIG. 4, the drive portion 110 is provided below the tube feed path 9C. The drive portion 110 includes a support portion 102, a DC motor 104, and a gear group 105 (refer to FIG. 5). The support portion 102 includes a first plate portion 102A, a second plate portion 102B, and a third plate portion 102C (refer to FIG. 4). The first plate portion 102A is a plate-shaped portion that extends in the up-down direction and the front-rear direction. The second plate portion 102B is a plate-shaped portion that extends to the right from an upper end portion of the first plate portion 102A. A plate body 99 (refer to FIG. 9) is attached to an upper surface of the second plate portion 102B. The plate body 99 extends in the left-right direction and the front-rear direction. The third plate portion 102C (refer to FIG. 4) is a plate-shaped body that extends downward, from a rear portion of the right end portion of the second plate portion 102B. An opening portion 102D (refer to FIG. 4) is provided in a rear portion of the second plate portion 102B. The opening portion 102D penetrates in the up-down direction.

The DC motor 104 is fixed to a front portion of a right surface of the first plate portion 102A. An output shaft of the DC motor 104 penetrates through the first plate portion 102A. A motor gear 104A is provided on a leading end portion of the output shaft of the DC motor 104.

Figure 5:
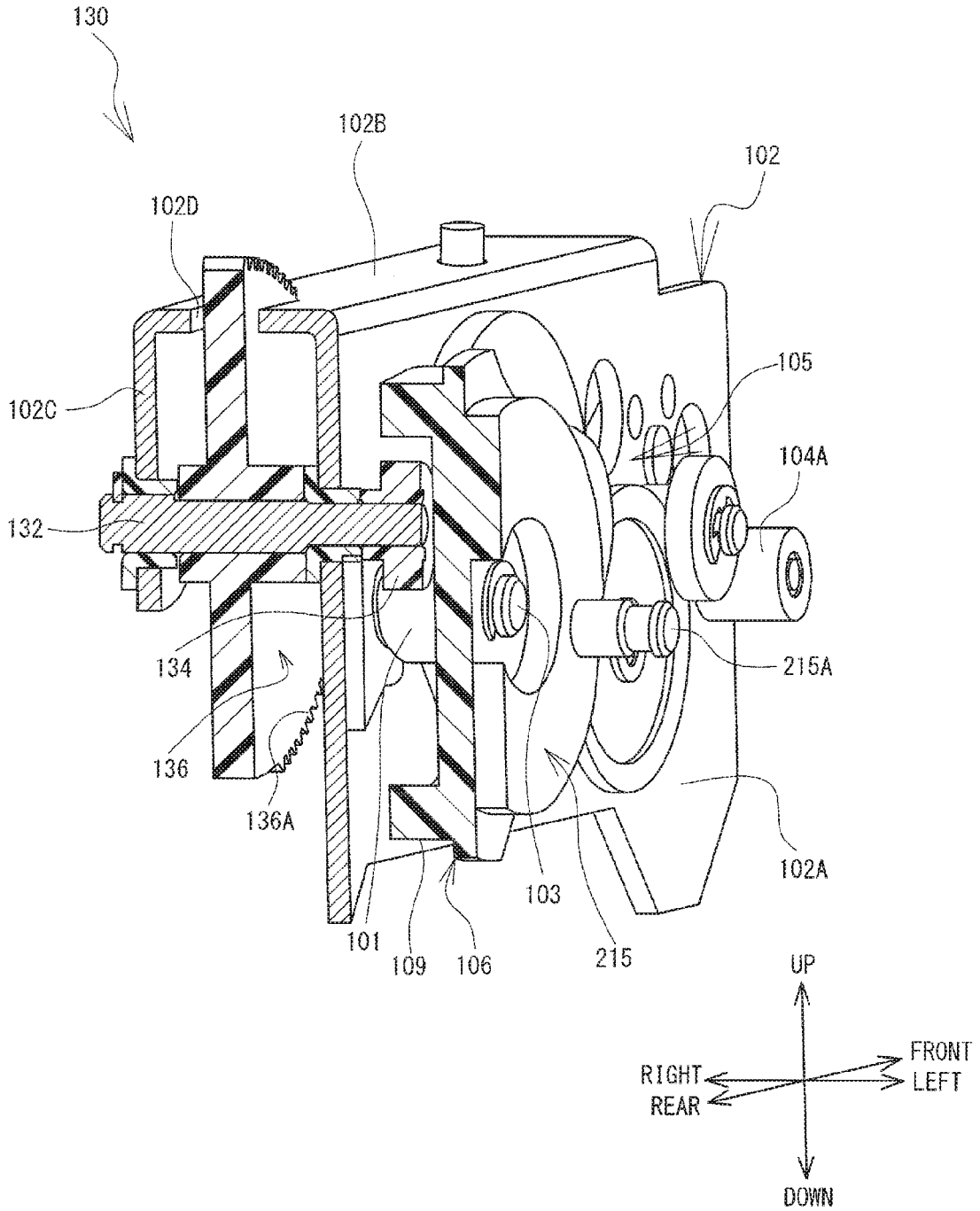
FIG. 5 is a cross-sectional perspective view of an intermittent gear 136 and a rotating member 106.

The gear group 105 (refer to FIG. 5) includes a plurality of gears. The plurality of gears are rotatably provided on shaft portions that extend to the left from the left surface of the first plate portion 102A, respectively. In FIG. 3 and FIG. 5, some of the plurality of gears are not illustrated.

As shown in FIG. 5, the gear group 105 connects the motor gear 104A to a first gear portion 109. The first gear portion 109 is ring-shaped in a right side view. The first gear portion 109 is integrally formed with a rotating member 106, which is a disc-shaped member having a thickness in the left-right direction. The rotating member 106 is rotatably supported by a rotating shaft portion 103. The rotating shaft portion 103 is fixed to a rear portion of the left surface of the first plate portion 102A. The rotating shaft portion 103 extends in the left-right direction. A driving force of the DC motor 104 is transmitted to the first gear portion 109 via the motor gear 104A and the gear group 105, and the first gear portion 109 rotates around the rotating shaft portion 103 as a result.

The rotating member 106 includes a second gear portion 101. Of a right portion of the rotating member 106, the second gear portion 101 is formed on the inside of the first gear portion 109. The second gear portion 101 rotates with the first gear portion 109, around the rotating shaft portion 103.

[2-3. Receiving Block Movement Mechanism 120]

The receiving block movement mechanism 120 will be explained with reference to FIG. 4 and FIG. 8. The receiving block movement mechanism 120 includes a drive transmission portion 130 and a receiving block support portion 150. The drive transmission portion 130 is coupled to the DC motor 104. The receiving block support portion 150 causes the receiving block 180 to move in the left-right direction by a driving force transmitted by the drive transmission portion 130.

Of the drive transmission portion 130, a holding member 152, a cam drive gear 156, and a cam member 158, which will be explained below, are not illustrated in FIG. 3. Of the drive transmission portion 130, a support shaft 132, a gear 134, and an intermittent gear 136, which will be explained below, are not illustrated in FIG. 4.

[2-3-1. Drive Transmission Portion 130]

Figure 6:
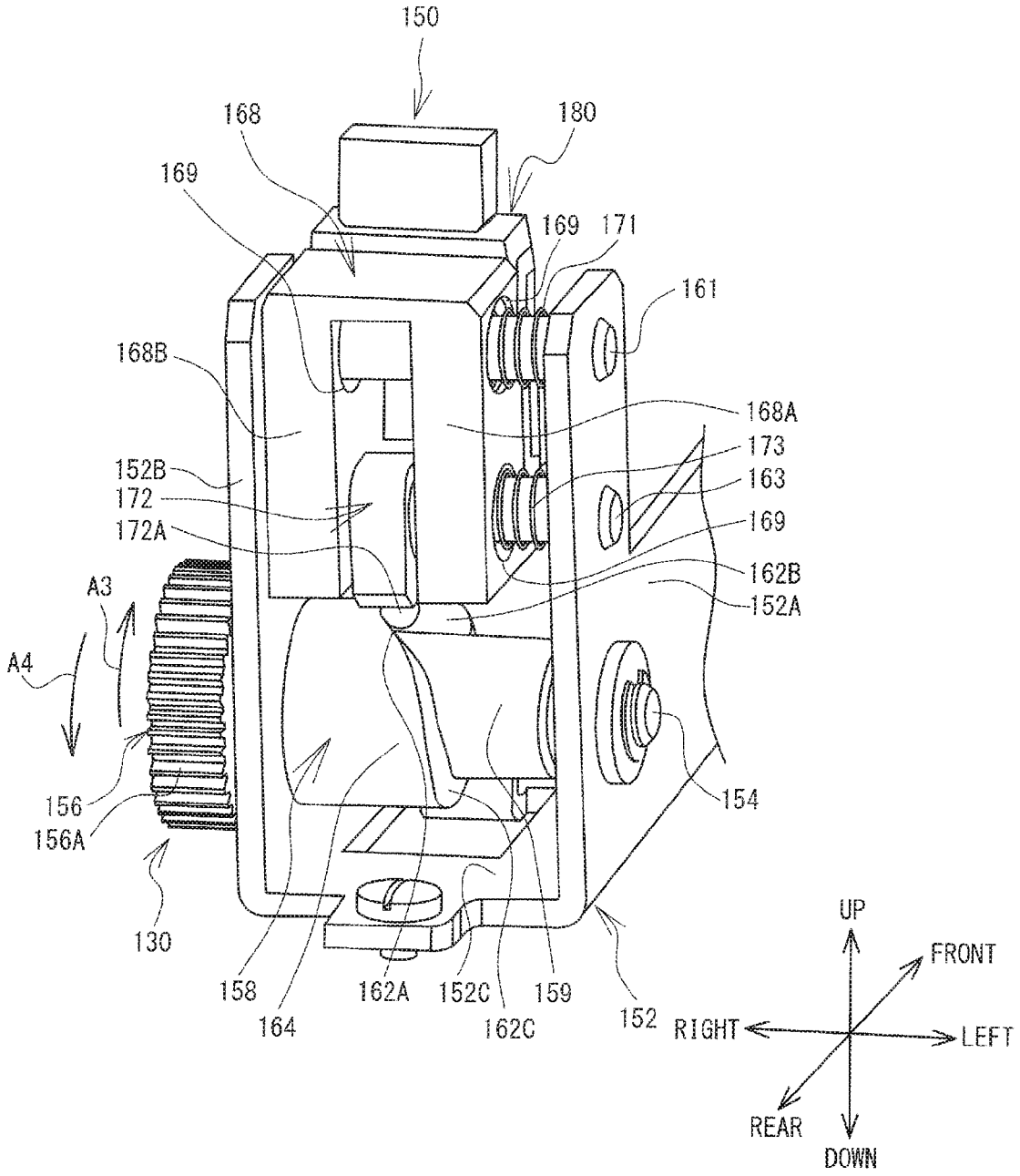
FIG. 6 is a perspective view of a receiving block support portion 150 when a receiving block 180 is in a first opposed position.

As shown in FIG. 4 and FIG. 5, the drive transmission portion 130 includes the support shaft 132, the gear 134 (refer to FIG. 5), the intermittent gear 136, the holding member 152 (refer to FIG. 4), a first shaft portion 154 (refer to FIG. 4), the cam drive gear 156 (refer to FIG. 4), and the cam member 158 (refer to FIG. 6). The support shaft 132 is rotatably supported by the first plate portion 102A and the third plate portion 102C. The support shaft 132 is a shaft portion that extends in the left-right direction. The support shaft 132 extends further to the left side than the first plate portion 102A.

The gear 134 is supported by the support shaft 132, further to the left side than the first plate portion 102A. The gear 134 meshes with the second gear portion 101. As a result, when the above-described first gear portion 109 rotates in accordance with the rotation of the DC motor 104, the second gear portion 101 causes the support shaft 132 to rotate.

The intermittent gear 136 is supported by the support shaft 132, between the first plate portion 102A and the third plate portion 102C. A part of a circumferential surface of the intermittent gear 136 is exposed upward from the opening portion 102D of the second plate portion 102B.

The intermittent gear 136 can rotate with the support shaft 132. Hereinafter, of rotation directions of the intermittent gear 136 around the support shaft 132, the anti-clockwise direction in a right side view is referred to as a first rotation direction, and the direction opposite to the first rotation direction is referred to as a second rotation direction. The first rotation direction is a direction in which an arrow A1 shown in FIG. 4 is oriented. The second rotation direction is a direction in which an arrow A2 shown in FIG. 4 is oriented. When the DC motor 104 rotates in the forward direction, the intermittent gear 136 rotates in the first rotation direction. When the DC motor 104 rotates in the reverse direction, the intermittent gear 136 rotates in the second rotation direction. The reverse direction is the opposite direction to the forward direction.

As shown in FIG. 4, a first toothed portion 136A is provided on a part of the circumferential surface of the intermittent gear 136 in the rotation direction. The first toothed portion 136A includes a first end portion 136B and a second end portion 136C. The first end portion 136B is an end portion of the first toothed portion 136A in the second rotation direction (the direction of the arrow A2). The second end portion 136C is an end portion of the first toothed portion 136A in the first rotation direction (the direction of the arrow A1).

An angle over which the toothed portion is formed (a toothed portion formation angle) is an angle from the first end portion 136 B to the second end portion 136C, in the first rotation direction. The toothed portion formation angle is an angle α shown in FIG. 4. The toothed portion formation angle of the intermittent gear 136 is, as an example, 76 degrees. An angle over which the toothed portion is not formed (a toothed portion non-formation angle) is an angle from the first end portion 136B to the second end portion 136C in the second rotation direction. The toothed portion non-formation angle is an angle β shown in FIG. 4. The toothed portion non-formation angle of the intermittent gear 136 is, as an example, 284 degrees.

Figure 9:
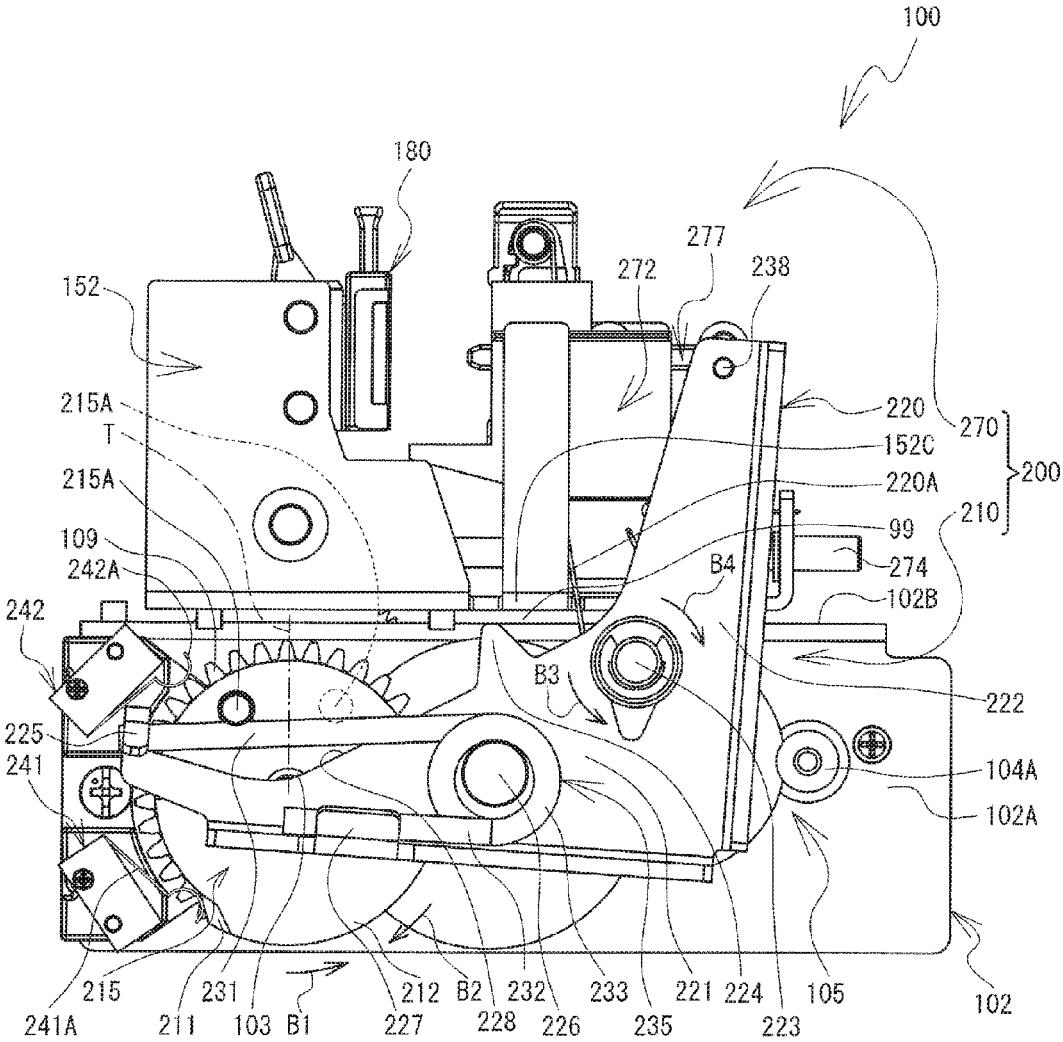
FIG. 9 is a left side view of the cutting mechanism 100 in an initial state.
Figure 9:
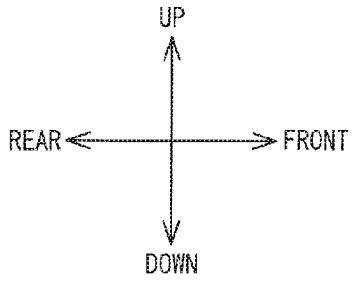

As shown in FIG. 4 and FIG. 6, the holding member 152 is provided on an upper surface of the plate body 99 (refer to FIG. 9). The holding member 152 is disposed on the upper left side with respect to the intermittent gear 136. The holding member 152 includes a left plate 152A, a right plate 152B, and a lower plate 152C. The left plate 152A and the right plate 152B are opposed to each other with a gap between them in the left-right direction. The left plate 152A and the right plate 152B are plate-shaped bodies having an L shape in a left side view. The left plate 152A and the right plate 152B each have a thickness in the left-right direction. An inside corner portion of the L shape, in the side view, of each of the left plate 152A and the right plate 152B is close to the tube feed path 9C (refer to FIG. 3).

The lower plate 152C connects lower end portions of the left plate 152A and the right plate 152B. The lower plate 152C is a plate-shaped body having a substantially rectangular shape in a plan view. The lower plate 152C extends from the rear side to the front side of the tube feed path 9C.

As shown in FIG. 6, the first shaft portion 154 is rotatably supported by a lower portion of the left plate 152A and a lower portion of the right plate 152B. The first shaft portion 154 is a shaft portion that extends in the left-right direction. The first shaft portion 154 extends to the right side of the right plate 152B.

The cam drive gear 156 is supported by the right end portion of the first shaft portion 154. The cam drive gear 156 can rotate around the first shaft portion 154. The cam drive gear 156 is positioned to the rear of the rear wall portion 194 (refer to FIG. 2). A second toothed portion 156A is provided around a whole circumferential surface of the cam drive gear 156. The second toothed portion 156A can mesh with the first toothed portion 136A of the intermittent gear 136.

As a result of the second toothed portion 156A meshing with the first toothed portion 136A (refer to FIG. 4), the cam drive gear 156 is caused to rotate by the intermittent gear 136. When the intermittent gear 136 rotates in the second rotation direction (the direction of the arrow A2 in FIG. 4), the cam drive gear 156 rotates in a third rotation direction. The third rotation direction is a direction in which an arrow A3 shown in FIG. 6 is oriented. When the intermittent gear 136 rotates in the first rotation direction (the direction of the arrow A1 in FIG. 4), the cam drive gear 156 rotates in a fourth rotation direction. The fourth rotation direction is a direction in which an arrow A4 shown in FIG. 6 is oriented.

The cam member 158 is supported by the first shaft portion 154, between the left plate 152A and the right plate 152B. The cam member 158 includes a cylindrical portion 159. The cylindrical portion 159 extends in the left-right direction. The first shaft portion 154 is inserted into a tube aperture (refer to FIG. 7) of the cylindrical portion 159. In this way, the cam member 158 rotates around the first shaft portion 154 in concert with the rotation of the cam drive gear 156. The rotation direction of the cam member 158 and the rotation direction of the cam drive gear 156 match each other.

Figure 7:
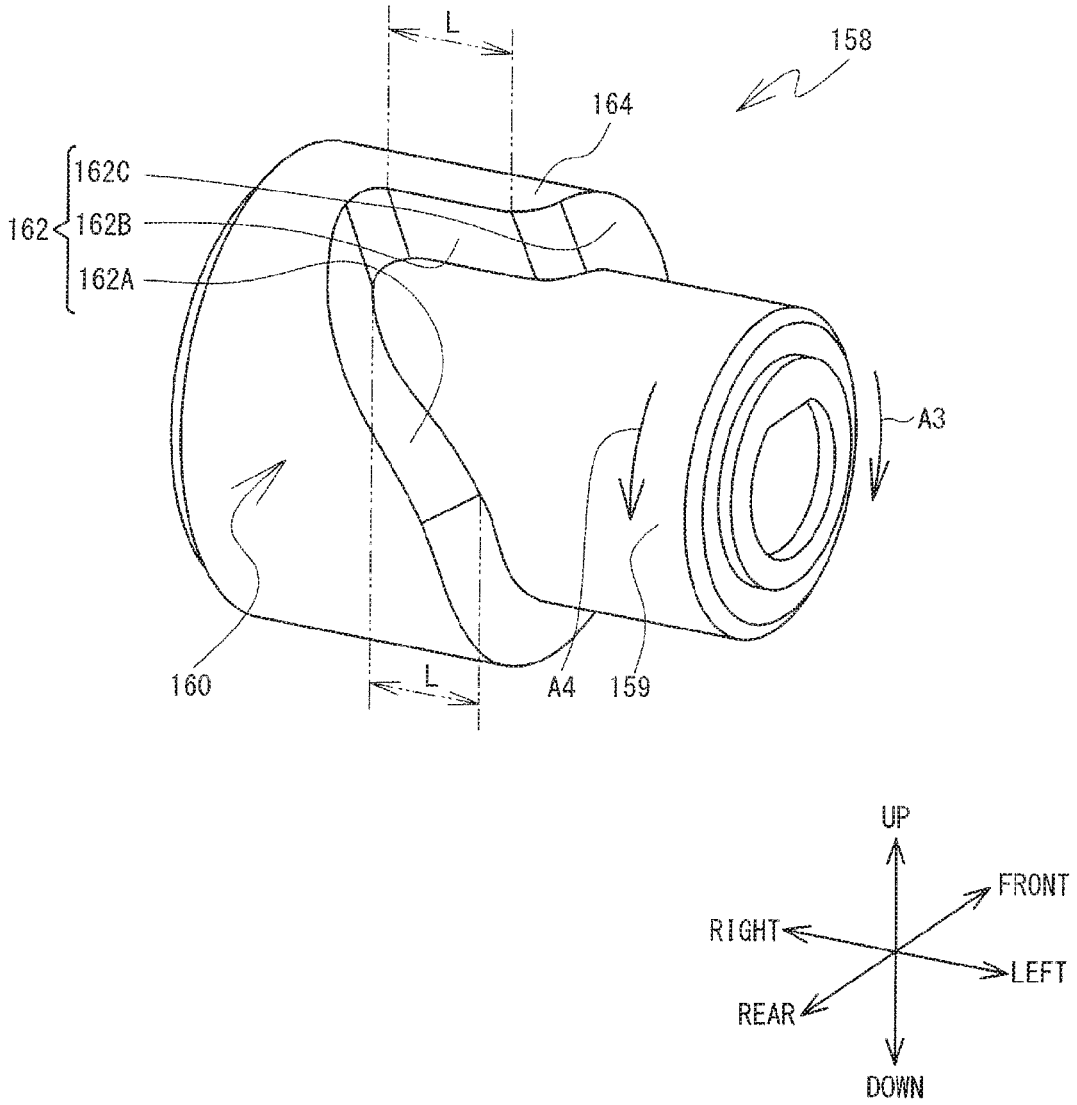
FIG. 7 is a perspective view of a cam member 158.

As shown in FIG. 7, a cam portion 160 is formed on a right portion of the outer circumferential surface of the cylindrical portion 159. The cam portion 160 can rotate with the cylindrical portion 159. The cam portion 160 is formed so as to surround the whole circumferential surface of the right portion of the outer circumferential surface of the cylindrical portion 159. A part of a left portion of the cam portion 160 is cut out toward the right side.

The cam portion 160 includes a cam surface 162. The cam surface 162 is formed on a portion of the surface of the cam portion 160 that faces to the left and portions that face in the fourth rotation direction (the direction of the arrow A4). The cam surface 162 includes a first cam surface 162A, a second cam surface 162B, and a third cam surface 162C.

The first cam surface 162A extends gradually to the left in the fourth rotation direction. Centering on the first shaft portion 154, an angle over which the first cam surface 162A is formed is 82 degrees, for example. The second cam surface 162B is connected to the right end portion of the first cam surface 162A. The second cam surface 162B is a surface that extends in a direction to become separated from the first shaft portion 154 (refer to FIG. 6) and in the left-right direction. A length of the first cam surface 162A in the left-right direction and a length of the second cam surface 162B in the left-right direction are the same as each other, and correspond to a distance L shown in FIG. 7. The third cam surface 162C connects the end portion in the fourth rotation direction of the first cam surface 162A and the left end portion of the second cam surface 162B. The third cam surface 162C is parallel to the third rotation direction and the fourth rotation direction.

A specific cam surface 164 is formed on the outer circumferential surface of the cam portion 160. The specific cam surface 164 is disposed further to the right side than the third cam surface 162C. The specific cam surface 164 extends in the third rotation direction, from the end portion of the second cam surface 162B in the direction in which the second cam surface 162B is separated from the first shaft portion 154.

[2-3-2. Receiving Block Support Portion 150]

Figure 8:
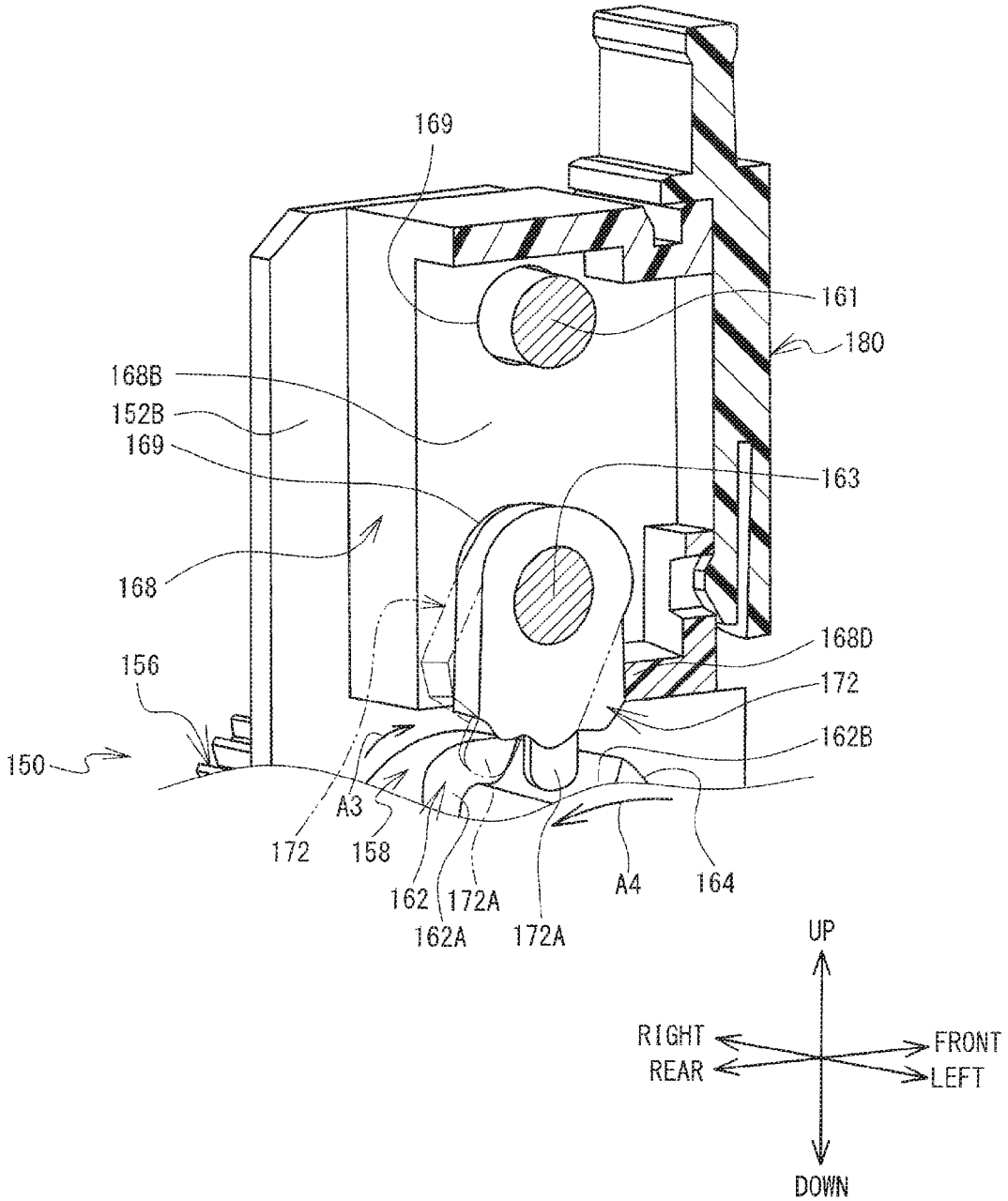
FIG. 8 is a cross-sectional perspective view of a support member 168.

As shown in FIG. 6 and FIG. 8, the receiving block support portion 150 includes support rods 161 and 163, a sliding member 172, and the receiving block 180. The support rods 161 and 163 extend in the left-right direction above the cam member 158. The support rods 161 and 163 are disposed in this order from the upper side. Both ends of each of the support rods 161 and 163 in the left-right direction are fixed, respectively, to the left plate 152A and the right plate 152B.

The support member 168 is supported by the support rods 161 and 163 between the left plate 152A and the right plate 152B such that the support member 168 can move linearly in the left-right direction. The support member 168 is positioned above the cam member 158. The support member 168 is a box shape that is open on the lower side and the rear side.

The support member 168 includes a left wall portion 168A and a right wall portion 168B. The left wall portion 168A and the right wall portion 168B are opposed to each other with a gap between them in the left-right direction. Two hole portions 169 are provided in each of the left wall portion 168A and the right wall portion 168B. The support rods 161 and 163 are respectively inserted through the upper and lower hole portions 169.

Of the two hole portions 169 of the left wall portion 168A, a contact wall portion (not shown in the drawings) is provided on the inside of the upper hole portion 169. The contact wall portion is a plate-shaped body having a thickness in the left-right direction. A circular hole (not shown in the drawings) that is concentric with the hole portion 169 is formed in the contact wall portion. The support rod 161 is inserted into the circular hole.

Figure 13:
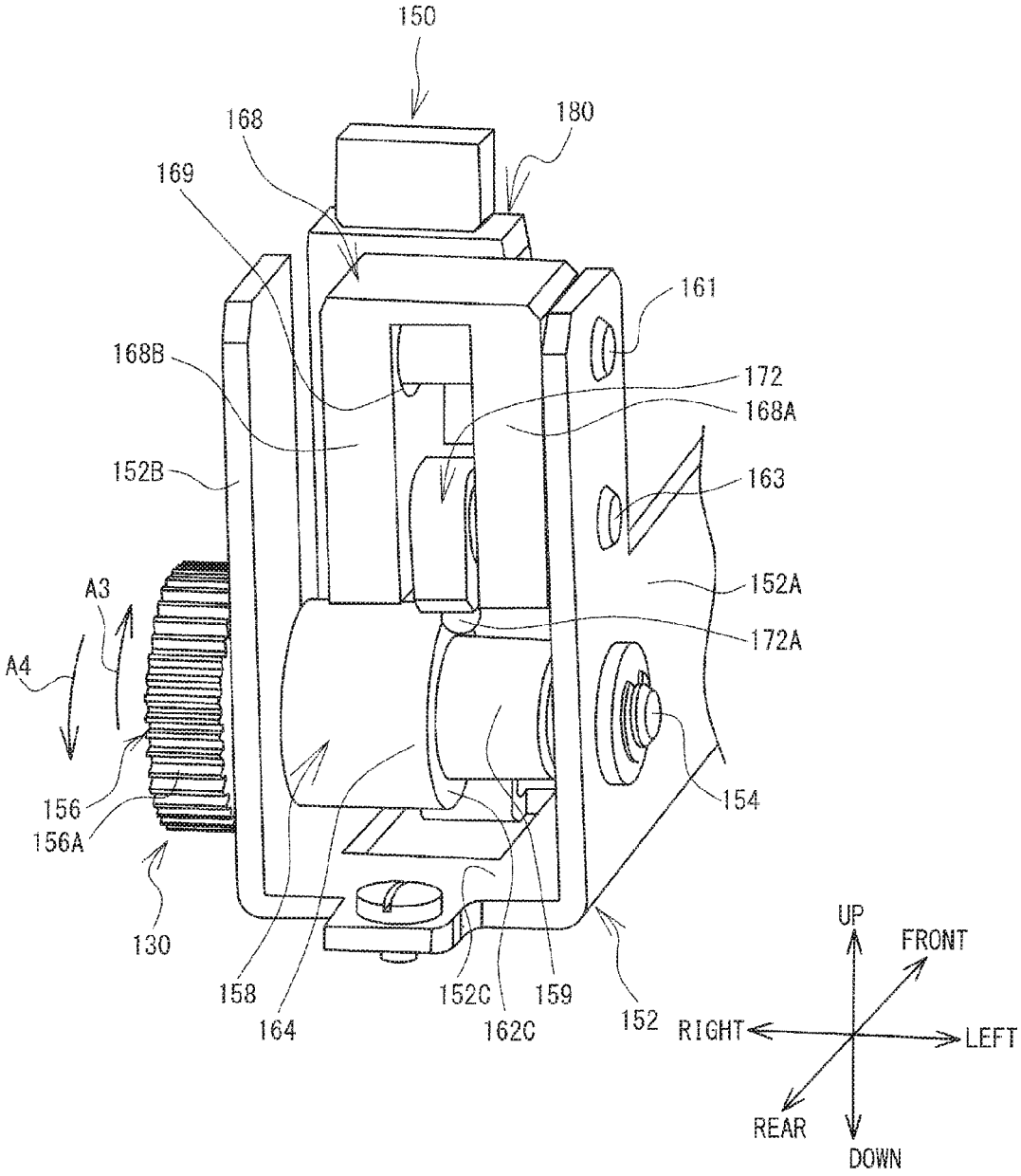
FIG. 13 is a perspective view of the receiving block support portion 150 when the receiving block 180 is in a second opposed position.

The left end position of a movable range of the support member 168 is a position in the left-right direction of the support member 168 when the left wall portion 168A is in contact with the left plate 152A (refer to FIG. 13). The right end position of the movable range of the support member 168 is a position in the left-right direction of the support member 168 when the right wall portion 168B is in contact with the right plate 152B (refer to FIG. 3, FIG. 4, FIG. 6, and so on).

As shown in FIG. 8, the sliding member 172 is rotatably supported by the support rod 163 between the left wall portion 168A (refer to FIG. 6) and the right wall portion 168B. The sliding member 172 is a substantially cuboid shape. A length in the left-right direction of an upper portion of the sliding member 172 is slightly shorter than a distance between the right wall portion 168B and the left wall portion 168A, in the direction in which the right wall portion 168B and the left wall portion 168A are opposed to each other. The sliding member 172 includes a sliding portion 172A. The sliding portion 172A protrudes downward from the support member 168. A lower end portion of the sliding portion 172A is formed in an arc shape toward the lower side. The sliding portion 172A can slide with respect to the cam surface 162 or the specific cam surface 164.

The sliding member 172 can rotate around the support rod 163 between a first rotation position and a second rotation position. The first rotation position is a rotation position of the sliding member 172 when the sliding portion 172A slides with respect to the cam surface 162. When the sliding member 172 is in the first rotation position, the sliding member 172A protrudes downward from the support member 168. The second rotation position is a rotation position of the sliding member 172 when the sliding portion 172A slides with respect to the specific cam surface 164. The second rotation position is a position when the sliding member 172 has rotated slightly further in the clockwise direction, in a left side view, than the first rotation position. In FIG. 8, the sliding member 172 that is in the first rotation position is illustrated with a solid line, and the sliding member 172 that is in the second rotation position is illustrated with a line of alternate long and short dashes.

A regulating portion 168D is provided in front of the sliding member 172 in the first rotation position. The regulating portion 168D protrudes to the left from the front side of a lower portion of the left surface of the right wall portion 168B. The regulating portion 168D comes into contact, from the front, with the sliding member 172 in the first rotation position.

As shown in FIG. 6, the support rods 161 and 163 are respectively inserted through coil springs 171 and 173. The coil spring 171 enters into the hole portion 169 and urges the contact wall portion (not shown in the drawings) to the right. The coil spring 173 passes through the inside of the hole portion 169 and urges the sliding member 172 to the right. When the sliding member 172 that is being urged is in the first rotation position, the movement of the sliding member 172 to the right is restricted by the cam surface 162. When the sliding member 172 that is being urged is in the second rotation position, the movement of the sliding member 172 to the right is restricted by the left surface of the right wall portion 168B.

As shown in FIG. 3, the receiving block 180 is provided on the front end portion of the support member 168. The receiving block 180 is positioned to the left of the rear wall portion 194 (refer to FIG. 2). In other words, the receiving block 180 is provided on the downstream side, in the tube feed direction, of the positioning portion 190. The receiving block 180 is a substantially cuboid shape. A front end surface of the receiving block 180 is a contact surface 183 with which the cutting blade 275 can come into contact. The tube 9 can be disposed on the contact surface 183. In the up-down direction, the contact surface 183 extends from above the reference position P to below the reference position P (refer to FIG. 11A to FIG. 11C and FIG. 15A to FIG. 15C). The reference position P is between the upper end and the lower end of the contact surface 183 in the up-down direction.

The contact surface 183 includes a first contact surface 181 and a second contact surface 182. The first contact surface 181 is provided further to the left than the second contact surface 182. A retraction groove 187, into which a part of the tube 9 in the circumferential direction can enter, is provided in a central portion of the first contact surface 181 in the up-down direction. The retraction groove 187 is provided in a portion of the first contact surface 181 that includes the reference position P in the up-down direction (refer to FIG. 11A to FIG. 11C). The first contact surface 181 includes two contact planes 181A that are formed in a planar shape. Of the first contact surface 181, the two contact planes 181A are a portion above and a portion below the retraction groove 187. The two contact planes 181A extend in the left-right direction and the up-down direction. The two contact planes 181A are in the same plane as each other.

As shown in FIG. 11A to FIG. 11C, the retraction groove 187 is a recessed portion that is recessed toward the rear. The retraction groove 187 is a substantially rectangular shape in a front view. A length of the retraction groove 187 in the front-rear direction is a groove depth of the retraction groove 187. The retraction groove 187 includes a first surface 187A, a second surface 187B, and a third surface 187C. The first surface 187A is a flat surface extending to the rear from a lower end of the upper contact plane 181A of the two contact planes 181A. The second surface 187B is a flat surface extending to the rear from an upper end of the lower contact plane 181A of the two contact planes 181A. A length of the second surface 187B in the front-rear direction is longer than a length of the first surface 187A in the front-rear direction. The third surface 187C is a flat surface that connects a rear end of the first surface 187A and a rear end of the second surface 187B. The third surface 187C forms a groove bottom of the retraction groove 187. The third surface 187C is a flat surface that inclines toward the front in the upward direction. Of the third surface 187C, a section that is above the reference position P extends to the side of the contact plane 181A in the upward direction. A maximum groove depth of the retraction groove 187 of the present example is less than 0.5 mm, for example. The maximum groove depth of the present example is a distance between a lower end of the third surface 187C and the contact plane 181A in the front-rear direction.

As shown in FIG. 4, the second contact surface 182 is a flat surface that extends in the up-down direction and the left-right direction. The second contact surface 182 is in the same plane as the two contact planes 181A.

The receiving block 180 is provided on the support member 168 and can thus move linearly in the left-right direction. The receiving block 180 can move linearly between a first opposed position and a second opposed position. The first opposed position is a position at the right end of a movable range of the receiving block 180. In the present example, when the receiving block 180 is in the first opposed position, the first contact surface 181 is opposed to the cutting blade 275. The second opposed position is a position at the left end of the movable range of the receiving block 180. In the present example, when the receiving block 180 is in the second opposed position, the second contact surface 182 is opposed to the cutting blade 275.

[2-3-3. Positional Relationships of Various Members when Receiving Block Movement Mechanism 120 is in Initial State]

Positional relationships of the intermittent gear 136, the cam member 158, the sliding member 172, the support member 168, and the receiving block 180 when the receiving block movement mechanism 120 having the above-described structure is in an initial state will be explained. The initial state of the receiving block movement mechanism 120 is a state of the receiving block movement mechanism 120 before the cutting mechanism 100 starts the cutting operation.

When the receiving block movement mechanism 120 is in the initial state, the intermittent gear 136 is in a start rotation position (refer to FIG. 4). The start rotation position is a rotation position of the intermittent gear 136 when the intermittent gear 136 has slightly rotated in the first rotation direction from a rotation position at which the first end portion 136B meshes with the second toothed portion 156A. The intermittent gear 136 that is in the start rotation position does not mesh with the cam drive gear 156. Thus, transmission of the driving force of the DC motor 104 to the cam drive gear 156 is restricted.

When the receiving block movement mechanism 120 is in the initial state, the cam member 158 is in a rotation position such that the second cam surface 162B is disposed substantially above the first shaft portion 154 (refer to FIG. 6). When the receiving block movement mechanism 120 is in the initial state, the sliding member 172 is in the first rotation position (refer to FIG. 8). The sliding portion 172A of the sliding member 172 is pressed against the right end portion of the first cam surface 162A, by the urging force of the coil spring 173 (refer to FIG. 6). At that time, an upper portion of the sliding member 172 is in contact with the left surface of the right wall portion 168B. The support member 168 is at the right end position of the movable range of the support member 168 and is urged by the coil spring 171. The movement of the support member 168 to the right is restricted by the right plate 152B. At that time, the receiving block 180 is in the first opposed position (refer to FIG. 3).

[2-3-4. Overview of Operations of Receiving Block Movement Mechanism 120]

When the receiving block movement mechanism 120 is in the initial state, if the DC motor 104 rotates in the forward direction, the intermittent gear 136 (refer to FIG. 4) rotates in the first rotation direction (the direction of the arrow A1). Thus, the intermittent gear 136 idles, without meshing with the cam drive gear 156. As a result, the receiving block movement mechanism 120 inhibits the transmission of the driving force of the DC motor 104 to the cam drive gear 156.

On the other hand, when the receiving block movement mechanism 120 is in the initial state, if the DC motor 104 rotates in the reverse direction, the intermittent gear 136 (refer to FIG. 4) rotates in the second rotation direction (the direction of the arrow A2). Immediately after the intermittent gear 136 has started to rotate in the second rotation direction, the first end portion 136B of the first toothed portion 136A meshes with the second toothed portion 156A. The receiving block movement mechanism 120 allows the transmission of the driving force of the DC motor 104 to the cam drive gear 156. By the intermittent gear 136 continuously rotating in the second rotation direction, the cam drive gear 156 is caused to rotate in the third rotation direction (the direction of the arrow A3 in FIG. 6). The cam drive gear 156 causes the first shaft portion 154 (refer to FIG. 6) to rotate in the third rotation direction. In this way, the cam member 158 rotates in the third rotation direction. The first cam surface 162A that is rotating in the third rotation direction slides with respect to the sliding portion 172A. In this way, the sliding member 172 moves to the left while resisting the urging force of the coil spring 173. The sliding member 172 moves to the left in a state in which the rotation of the sliding member 172 in the anti-clockwise direction in a left side view is restricted by the regulating portion 168D (refer to FIG. 8). The sliding member 172 that moves to the left urges the support member 168 to the left. The support member 168 moves to the left from the right end position of the movable range of the support member 168, while resisting the urging force of the coil spring 171. The receiving block 180 moves to the left from the first opposed position.

[2-4. Cutting Blade Movement Mechanism 200]

The cutting blade movement mechanism 200 will be explained with reference to FIG. 3 and FIG. 9. The cutting blade movement mechanism 200 includes a rotation drive portion 210 and a cutting blade movement portion 270. The rotation drive portion 210 is rotationally driven in concert with the rotation of the DC motor 104. The cutting blade movement portion 270 moves the cutting blade 275 in the front-rear direction in accordance with the rotational driving of the rotation drive portion 210.

[2-4-1. Rotation Drive Portion 210]

The rotation drive portion 210 includes a cam portion 215, an initial position sensor 241, an intermediate position sensor 242, and a link member 220. The cam portion 215 is a portion formed on a left portion of the above-described rotating member 106 (refer to FIG. 5). The cam portion 215 is circular in a left side view. The cam portion 215 can rotate around the rotating shaft portion 103 together with the first gear portion 109 (refer to FIG. 5). Hereinafter, the anti-clockwise direction around the rotating shaft portion 103 in a left side view is referred to as a first direction and the opposite direction to the first direction is referred to as a second direction. The first direction is a direction in which an arrow B1 shown in FIG. 9 is oriented. The second direction is a direction in which an arrow B2 shown in FIG. 9 is oriented. When the DC motor 104 rotates in the forward direction, the cam portion 215 rotates in the first direction. When the DC motor 104 rotates in the reverse direction, the cam portion 215 rotates in the second direction.

The cam portion 215 includes a right side protruding portion 211 and a left side protruding portion 212. The right side protruding portion 211 and the left side protruding portion 212 are both plate-shaped bodies that protrude to the outside, in a radial direction, from the circumferential surface of the cam portion 215.

The right side protruding portion 211 is provided further to the right side (namely, to the far side of FIG. 9) than a center in the left-right direction of the circumferential surface of the cam portion 215. The right side protruding portion 211 is provided on a part of the circumferential surface of the cam portion 215 in a rotational direction around the rotating shaft portion 103. An angle over which the right side protruding portion 211 is formed is an angle, in the first direction, from the end portion of the right side protruding portion 211 in the second direction to the end portion of the right side protruding portion 211 in the first direction. The angle over which the right side protruding portion 211 is formed in the present example is 90 degrees or more. The end surface of the right side protruding portion 211 in the second direction is inclined so as to separate from the rotating shaft portion 103 in the first direction.

The left side protruding portion 212 is provided further to the left side (namely, to the near side of FIG. 9) than the center in the left-right direction of the circumferential surface of the cam portion 215. Therefore, the left side protruding portion 212 is disposed further to the left side than the right side protruding portion 211. The left side protruding portion 212 is provided on a part of the circumferential surface of the cam portion 215 in the rotational direction around the rotating shaft portion 103. An angle over which the left side protruding portion 212 is formed in the present example is smaller than the angle over which the right side protruding portion 211 is formed. The angle over which the left side protruding portion 212 is formed is an angle, in the first direction, from the end portion of the left side protruding portion 212 in the second direction to the end portion of the left side protruding portion 212 in the first direction. The end surface of the left side protruding portion 212 in the second direction is inclined so as to separate from the rotating shaft portion 103 in the first direction. The end surface of the left side protruding portion 212 in the first direction is inclined so as to separate from the rotating shaft portion 103 in the second direction. The end surface of the left side protruding portion 212 in the second direction is further to the first direction side than the end surface of the right side protruding portion 211 in the second direction.

A pressing pin 215A is provided on a left surface of the cam portion 215. The pressing pin 215A is a columnar body that protrudes to the left from the cam portion 215. The pressing pin 215A is disposed in a position at substantially 90 degrees in the second direction with respect to the end surface in the second direction of the right side protruding portion 211.

The cam portion 215 shown in FIG. 3 and FIG. 9 is in an initial rotation position. When the cam portion 215 is in the initial rotation position, the pressing pin 215A is in a rotation position in which the pressing pin 215A has rotated slightly in the first direction from a rotation position directly above the rotating shaft portion 103.

As shown in FIG. 9, the initial position sensor 241 is provided on a lower rear portion of a left surface of the first plate portion 102A. The initial position sensor 241 includes a first rotating shaft (not shown in the drawings), a movable portion 241A, and a first spring (not shown in the drawings). The first rotating shaft extends in the left-right direction in an upper rear portion inside the initial position sensor 241. The movable portion 241A is rotatably provided on the first rotating shaft. The movable portion 241A extends from the first rotating shaft downward and to the front. Of the movable portion 241A, the end portion on the opposite side to the first rotating shaft is a leading end portion of the movable portion 241A. The leading end portion of the movable portion 241A is curved in an arc shape toward the rotating shaft portion 103. The first spring urges the movable portion 241A in the anti-clockwise direction in a left side view around the first rotating shaft.

The movable portion 241A comes into contact with or is separated from the right side protruding portion 211 that rotates. When the movable portion 241A is separated from the right side protruding portion 211, the movable portion 241A is in a normal position. When the movable portion 241A is in the normal position, the leading end portion of the movable portion 241A enters into a movement path of the right side protruding portion 211. In this case, the initial position sensor 241 outputs an OFF signal. When the movable portion 241A comes into contact with the right side protruding portion 211, the movable portion 241A is further in the clockwise direction in a left side view than the normal position. In this case, the initial position sensor 241 outputs an ON signal. When the cam portion 215 is in the initial rotation position, the end surface in the second direction of the right side protruding portion 211 is slightly separated, in the first direction, from the leading end portion of the movable portion 241A. Thus, when the cam portion 215 is in the initial rotation position, the initial position sensor 241 outputs the OFF signal.

The intermediate position sensor 242 is provided on an upper rear portion on the left surface of the first plate portion 102A. The intermediate position sensor 242 is positioned substantially 90 degrees in the second direction from the initial position sensor 241. The intermediate position sensor 242 is disposed further to the left side than the initial position sensor 241. The intermediate position sensor 242 includes a second rotating shaft (not shown in the drawings), a movable portion 242A, and a second spring (not shown in the drawings). The second rotating shaft extends in the left-right direction in a lower rear portion inside the intermediate position sensor 242. The movable portion 242A is rotatably provided on the second rotating shaft. The movable portion 242A extends from the second rotating shaft upward and to the front. Of the movable portion 242A, the end portion on the opposite side to the second rotating shaft is a leading end portion of the movable portion 242A. The leading end portion of the movable portion 242A is curved in an arc shape toward the rotating shaft portion 103. The second spring urges the movable portion 242A in the clockwise direction, in a left side view, around the second rotating shaft.

The movable portion 242A comes into contact with or is separated from the left side protruding portion 212 that rotates. When the movable portion 242A is separated from the left side protruding portion 212, the movable portion 242A is in a normal position. When the movable portion 242A is in the normal position, the leading end portion of the movable portion 242A enters into a movement path of the left side protruding portion 212. In this case, the intermediate position sensor 242 outputs an OFF signal. When the movable portion 242A comes into contact with the left side protruding portion 212, the movable portion 242A is further in the anti-clockwise direction in a left side view than the normal position. In this case, the intermediate position sensor 242 outputs an ON signal. When the cam portion 215 is in the initial rotation position, the end surface in the second direction of the left side protruding portion 212 is separated from the leading end portion of the movable portion 242A, at a position of having rotated 90 degrees or more in the first direction from the leading end portion of the movable portion 242A. The end surface of the left side protruding portion 212 in the first direction is separated from the leading end portion of the movable portion 242A, at a position of having rotated 90 degrees or more in the second direction from the leading end portion of the movable portion 242A. Thus, when the cam portion 215 is in the initial rotation position, the intermediate position sensor 242 outputs the OFF signal.

The link member 220 is a plate-shaped member that is substantially L-shaped in a right side view. The link member 220 is provided further to the left side than the gear group 105 and the cam portion 215. The link member 220 can rotate around a link shaft portion 223. The link shaft portion 223 extends in the left-right direction. The right end portion of the link shaft portion 223 is fixed to the left surface of the first plate portion 102A. Hereinafter, the anti-clockwise direction, in a left side view, around the link shaft portion 223 is referred to as a third direction, and a direction opposite to the third direction is referred to as a fourth direction. The third direction is a direction in which an arrow B3 shown in FIG. 9 is oriented. The fourth direction in a direction in which an arrow B4 shown in FIG. 9 is oriented.

As shown in FIG. 9, the link member 220 includes a first plate-shaped portion 221 and a second plate-shaped portion 222. The first plate-shaped portion 221 is a plate-shaped portion that extends substantially in the front-rear direction below the tube feed path 9C. The second plate-shaped portion 222 is a plate-shaped portion that extends upward from a front end portion of the first plate-shaped portion 221 while inclining at substantially 90 degrees with respect to the first plate-shaped portion 221. An upper end portion of the second plate-shaped portion 222 is disposed to the front of the tube feed path 9C. A rear lower portion of the second plate-shaped portion 222 is connected to the left end portion of the link shaft portion 223.

A spring 220A is provided on the link shaft portion 223. The link member 220 is urged in the fourth direction around the link shaft portion 223 by the spring 220A. The rotation in the fourth direction of the link member 220 that is urged is restricted at a position at which a link protrusion 224 comes into contact with the above-described plate body 99. The link protrusion 224 is a protruding portion that protrudes diagonally upward and to the rear from a front portion of an upper surface of the first plate-shaped portion 221. Hereinafter, a rotation position of the link member 220 when the link protrusion 224 is in contact with the plate body 99 is referred to as a separated rotation position. The link member 220 shown in FIG. 3, FIG. 4, and FIG. 9 is in the separated rotation position.

A spring shaft portion 226, latching pieces 225 and 227, and an escape groove 228 are provided in the first plate-shaped portion 221. The spring shaft portion 226 protrudes to the left from a left surface of the first plate-shaped portion 221. The spring shaft portion 226 is disposed below the link protrusion 224.

The latching pieces 225 and 227 protrude to the front from the first plate-shaped portion 221. The latching piece 225 is provided on a rear end portion on the upper surface of the first plate-shaped portion 221. The latching piece 225 is disposed further to the rear than the spring shaft portion 226. The latching piece 227 is provided on a portion further to the rear than a center, in the front-rear direction, of a lower surface of the first plate-shaped portion 221. A position of the latching piece 227 in the front-rear direction is between the latching piece 225 and the spring shaft portion 226. The escape groove 228 is provided between the latching piece 225 and the link protrusion 224, in the upper surface of the first plate-shaped portion 221. The escape groove 228 is a groove portion that is recessed downward. A central portion of the escape groove 228 in the front-rear direction is formed below the latching piece 225.

A torsion spring 235, which is in an elastically deformed state, is provided on the first plate-shaped portion 221. The torsion spring 235 includes a coil portion 233, a first arm portion 231, and a second arm portion 232. An axial line of the coil portion 233 extends in the left-right direction. The spring shaft portion 226 is inserted into the coil portion 233.

The first arm portion 231 extends to the rear from the right end portion of the coil portion 233. A leading end portion of the first arm portion 231 urges the latching piece 225 from below, and latches with the latching piece 225. The first arm portion 231 is disposed below the pressing pin 215A of the cam portion 215. The leading end portion of the rotating pressing pin 215A comes into contact with or separates from the first arm portion 231. The second arm portion 232 extends to the rear from the left end portion of the coil portion 233. The second arm portion 232 is disposed below the first arm portion 231. A leading end portion of the second arm portion 232 urges the latching piece 227 from above, and latches with the latching piece 227.

A protruding pin 238 is provided on the second plate-shaped portion 222. The protruding pin 238 protrudes to the right from an upper end portion of the second plate-shaped portion 222. When the link member 220 is in the separated rotation position, the protruding pin 238 is positioned to a front end position in a movable range of the protruding pin 238.

[2-4-2. Cutting Blade Movement Portion 270]

As shown in FIG. 3, FIG. 4, and FIG. 9, the cutting blade movement portion 270 includes a housing member 272, a rail member 274, the cutting blade 275 (refer to FIG. 11A to FIG. 11C), and an arm member 277. The housing member 272 is placed on a front portion of the lower plate 152C of the holding member 152. The housing member 272 is opposed to the receiving block 180 from the front side of the receiving block 180. The housing member 272 is positioned further downstream, in the tube feed direction, than the positioning portion 190 (refer to FIG. 2). The housing member 272 is a box-shaped member that is open to the rear. The housing member 272 can move in the front-rear direction. A through hole 272A is provided in an upper portion of a front wall portion of the housing member 272.

The rail member 274 is a columnar body that extends in the front-rear direction while penetrating a lower portion of the housing member 272. The rail member 274 is provided below the tube feed path 9C. The rail member 274 guides the movement of the housing member 272 in the front-rear direction.

The cutting blade 275 is housed inside the housing member 272. The cutting blade 275 is a plate-shaped body having a thickness in the left-right direction. A blade portion 275A (refer to FIG. 11A to FIG. 11C), which extends in a straight line in the up-down direction, is formed on a rear end portion of the cutting blade 275. The cutting blade 275 is urged to the front by an attachment spring (not shown in the drawings) provided inside the housing member 272. The cutting blade 275 can move in the front-rear direction relative to the housing member 272. The blade portion 275A can protrude further to the rear than the housing member 272.

The arm member 277 extends in the front-rear direction. The arm member 277 is inserted into the through hole 272A. A rear end portion of the arm member 277 is coupled to the cutting blade 275. A tubular portion 277A is formed on a front end portion of the arm member 277. The tubular portion 277A is an elliptical shape that is long in the up-down direction in a right side view. The protruding pin 238 of the link member 220 is inserted into a tubular hole 277B of the tubular portion 277A from the left side. In this way, when the link member 220 rotates around the link shaft portion 223, the arm member 277 can move in the left-right direction.

[2-4-3. Positional Relationships of Various Members when Cutting Blade Movement Mechanism 200 is in Initial State]

Positional relationships of the cam portion 160, the link member 220, the housing member 272, and the cutting blade 275 when the cutting blade movement mechanism 200 having the above-described structure is in an initial state will be explained. The initial state of the cutting blade movement mechanism 200 is a state of the cutting blade movement mechanism 200 before the cutting mechanism 100 starts the cutting operation.

When the cutting blade movement mechanism 200 is in the initial state, the cam portion 160 is in the initial rotation position, and the link member 220 is in the separated rotation position. In this case, the leading end portion of the pressing pin 215A of the cam portion 215 is in contact, from above, with the first arm portion 231 of the torsion spring 235. Since the link member 220 is in the separated rotation position, the protruding pin 238 is in the front end position of its movable range. The arm member 277 and the housing member 272 are at front end positions of their respective movable ranges. An arrangement position of the cutting blade 275 when the housing member 272 is in the front end position of its movable range is referred to as a separated position. The separated position is a front end position of a movable range of the cutting blade 275. When the cutting blade 275 is in the separated position, the cutting blade 275 is separated from the contact surface 183 of the receiving block 180, and is housed inside the housing member 272.

[2-4-4. Overview of Operations of Cutting Blade Movement Mechanism 200]

As shown in FIG. 9, when the cutting blade movement mechanism 200 is in the initial state, if the DC motor 104 rotates in the forward direction, the cam portion 215 rotates in the first direction (the direction of the arrow B1). In accordance with the rotation in the first direction of the cam portion 215, the pressing pin 215A presses the first arm portion 231 in the anti-clockwise direction in a left side view. The link member 220 rotates in the third direction (the direction of the arrow B3). The protruding pin 238 of the link member 220 causes the arm member 277 to move to the rear. The arm member 277 causes the cutting blade 275 to move to the rear. Thus, the housing member 272 moves to the rear from the front end position of the movable range of the housing member 272.

On the other hand, when the cutting blade movement mechanism 200 is in the initial state, if the DC motor 104 rotates in the reverse direction, the cam portion 215 rotates in the second direction (the direction of the arrow B2 in FIG. 9). The link member 220 is maintained in the state of being positioned in the separated rotation position.

In accordance with the rotation of the cam portion 215 in the second direction, the pressing pin 215A separates from the first arm portion 231 and rotates in the second direction. The cam portion 215 rotates to a specific rotation position. In FIG. 9, the pressing pin 215A that has rotated to the specific rotation position is illustrated by a line of alternate long and short dashes. The specific rotation position is a position that is substantially symmetrical with the initial rotation position with respect to a virtual plane T. The virtual plane T includes an axial line of the rotating shaft portion 103, and is a virtual surface that extends in the left-right direction and the up-down direction. When the cam portion 215 rotates to the specific rotation position, the pressing pin 215A once more comes into contact with the first arm portion 231. A position at which the pressing pin 215A comes into contact with the first arm portion 231 is closer to the coil portion 233 than the case in which the DC motor 104 rotates in the forward direction.

When the DC motor 104 continues to rotate in the reverse direction, the cam portion 215 rotates further in the second direction than the specific rotation position. The pressing pin 215A presses the first arm portion 231 in the anti-clockwise direction in a left side view. The link member 220 rotates in the third direction and causes the housing member 272 to move to the rear from the front end position of the movable range of the housing member 272.

[3. Cutting Operations of Cutting Mechanism 100]

Hereinafter, the cutting operations of the cutting mechanism 100 will be explained, as a half cut operation of the tube 9 and a full cut operation of the tube 9. Before the cutting mechanism 100 starts the cutting operation, the cutting mechanism 100 is in an initial state. When the cutting mechanism 100 is in the initial state, the receiving block movement mechanism 120 is in the initial state, and the cutting blade movement mechanism 200 is in the initial state. The initial position sensor 241 and the intermediate position sensor 242 are outputting the OFF signals. When the cutting mechanism 100 is in the initial state, the tube 9 may be positioned on the bottom wall portion 192 of the positioning portion 190 by the user. The tube 9 is disposed on the contact surface 183 (refer to FIG. 3) in a state in which the lower end of the tube 9 is positioned on the reference position P.

[3-1. Half Cut Operation of Cutting Mechanism 100]

An operation in which the cutting mechanism 100 performs a half cut of the large diameter tube 9A will be explained with reference to FIG. 4, FIG. 6, FIG. 9, FIG. 10, and FIG. 11A to FIG. 11C. In each of the FIG. 11A to FIG. 11C, FIG. 12A to 12C, and FIG. 15A to FIG. 15C, the receiving block 180, the cutting blade 275, and the tube 9 are illustrated schematically in cross-section as seen from the left side. In FIG. 11A to FIG. 11C, FIG. 12A to FIG. 12C, and FIG. 15A to FIG. 15C, hatching of the rear end portion of the cutting blade 275 is not illustrated.

The half cut operation of the large diameter tube 9A is as follows. The cutting mechanism 100 clamps the large diameter tube 9A between the first contact surface 181 and the cutting blade 275, while the receiving block 180 is maintained in a state of being stopped in the first opposed position. The cutting blade 275 presses the large diameter tube 9A toward the first contact surface 181 and thus performs the half cut of the large diameter tube 9A. In accordance with a driving control of the CPU of the control board 19 (refer to FIG. 2), the DC motor 104 is driven in the following manner.

While the cutting mechanism 100 is in the initial state, the DC motor 104 rotates in the forward direction. The intermittent gear 136 that is in the start rotation position does not mesh with the cam drive gear 156 and idles in the first rotation direction (the direction of the arrow A1 in FIG. 4). As shown in FIG. 6, while the support member 168 is urged to the right by the coil springs 171 and 173, the support member 168 is maintained in a state of being stopped at the right end position of its movable range. Thus, the receiving block 180 is maintained in the state of being stopped in the first opposed position.

Figure 10:
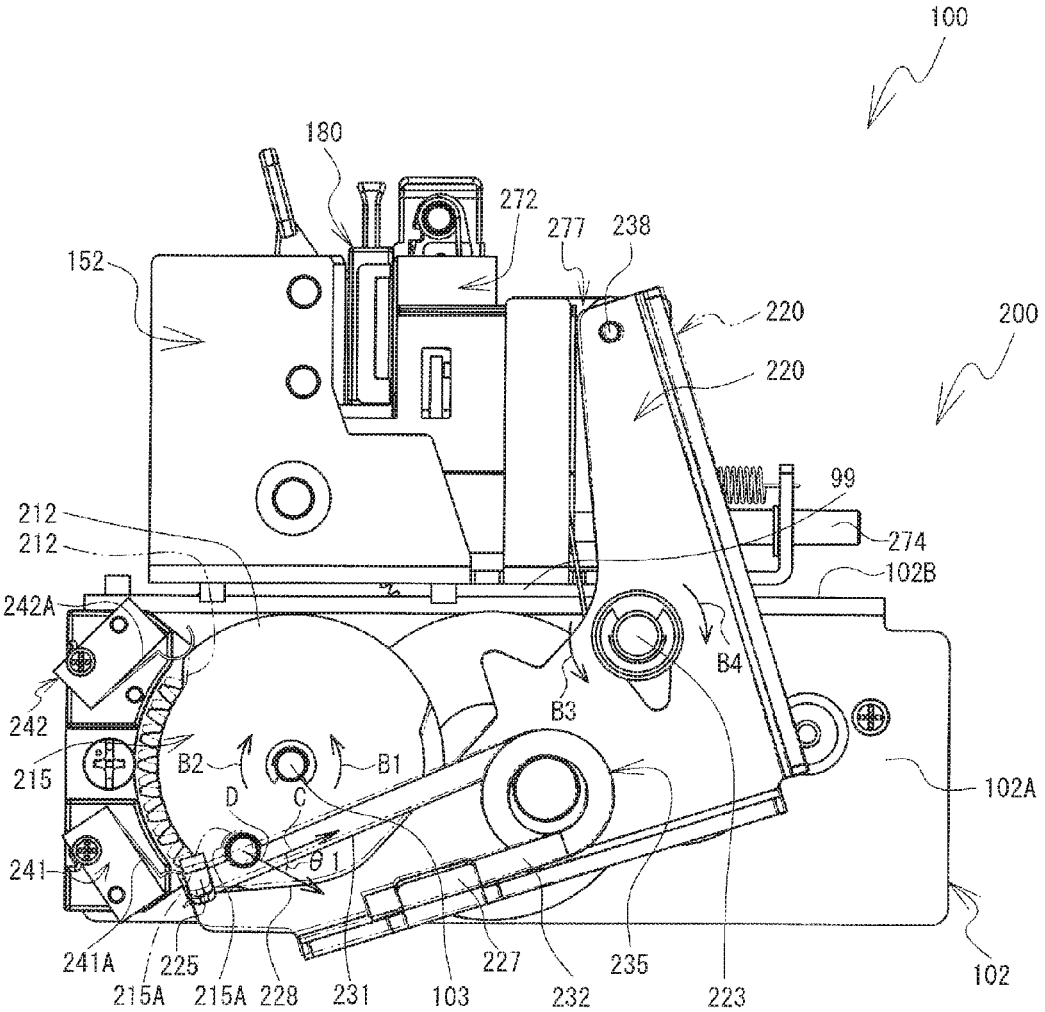
FIG. 10 is a left side view of the cutting mechanism 100 at a time of ending a half cut operation.
Figure 10:
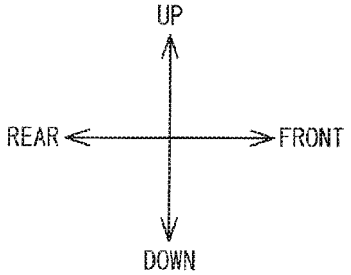

As shown in FIG. 9 and FIG. 10, when the intermittent gear 136 that is in the start rotation position rotates in the first rotation direction, the cam portion 215 rotates in the first direction (the direction of the arrow B1). The housing member 272 moves to the rear from the front end portion of its movable range. The cutting blade 275 moves to the rear from the separated position (refer to FIG. 11A).

Although not shown in the drawings, the housing member 272 that moves to the rear comes into contact with the large diameter tube 9A, from the front, ahead of the cutting blade 275. The movement of the housing member 272 to the rear is restricted. When the DC motor 104 continues to rotate in the forward direction, the arm member 277 urges the cutting blade 275 to the rear. The cutting blade 275 moves to the rear, relative to the housing member 272, while resisting the urging force of the attachment spring (not shown in the drawings).

As shown in FIG. 10 and FIG. 11B, the blade portion 275A moves to a clamping position. The clamping position of the present example is an arrangement position of the cutting blade 275 when the large diameter tube 9A is clamped between the blade portion 275A and the contact surface 183. When the half cut operation is performed, the cutting blade 275 that is in the clamping position clamps the large diameter tube 9A between the cutting blade 275 and the first contact surface 181. The large diameter tube 9A is elastically deformed between the cutting blade 275 and the first contact surface 181 and becomes a substantially elliptical shape that is long in the up-down direction in a left side view.

A rotation position of the link member 220 that has caused the cutting blade 275 to move to the clamping position is a clamping rotation position. When the half cut operation is performed, a rotation position of the cam portion 215 that has caused the link member 220 to move to the clamping rotation position is a first intermediate rotation position. In FIG. 10, the link member 220 that is in the clamping rotation position and the cam portion 215 that is in the first intermediate rotation position are illustrated by lines of alternate long and short dashes.

When the cam portion 215 that rotates in the first direction rotates from the initial rotation position to the first intermediate rotation position, the end surface of the left side protruding portion 212 in the first direction comes into contact with the movable portion 242A of the intermediate position sensor 242. The intermediate position sensor 242 outputs the ON signal instead of the OFF signal. In this way, the CPU of the control board 19 (refer to FIG. 2) can determine that the cam portion 215 has rotated to the first intermediate rotation position.

By the DC motor 104 further rotating continuously in the forward direction for a specified period of time, the cam portion 215 rotates further to the first direction side than the first intermediate rotation position. The pressing pin 215A presses the first arm portion 231. The first arm portion 231 is pressed in the anti-clockwise direction, in a left side view, around the spring shaft portion 226. The first arm portion 231 separates slightly downward from the latching piece 225, and an amount of elastic deformation of the torsion spring 235 increases. The torsion spring 235 urges the link member 220 in the third direction, via the second arm portion 232 and the latching piece 227. As a result, the cutting blade 275 is urged to the rear.

When the amount of elastic deformation of the torsion spring 235 increases at the time of the half cut operation, a pressing angle of the pressing pin 215A against the first arm portion 231 is an acute angle. The pressing angle is a tangential direction of the pressing pin 215A (a direction of an arrow D) with respect to a direction approaching the coil portion 233 (a direction of an arrow C), of an extending direction of the first arm portion 231. The tangential direction of the pressing pin 215A (the direction of the arrow D) is a direction of a line that orthogonally intersects, at a center of the pressing pin 215A, a line linking a center of the rotating shaft portion 103 and the center of the pressing pin 215A, in a left side view. The pressing angle when the half cut operation is performed corresponds to an angle θ1 shown in FIG. 10.

The cutting blade 275 that is being urged moves to a contact position (refer to FIG. 11C) while cutting through the large diameter tube 9A. The contact position is an arrangement position of the cutting blade 275 when the blade portion 275A is in contact with the contact surface 183. The contact position is a rear end position of the movable range of the cutting blade 275. When the half cut operation is performed, the blade portion 275A that has moved to the contact position is in contact with each of the two contact planes 181A. The large diameter tube 9A is half cut by leaving a portion of the large diameter tube 9A that has entered into the retraction groove 187 and has escaped from the cutting blade 275. The blade portion 275A that has moved to the contact position is opposed to the third surface 187C, with the large diameter tube 9A therebetween.

A rotation position of the link member 220 that has caused the cutting blade 275 to move to the contact position is a contact rotation position. When the half cut operation is performed, a rotation position of the cam portion 215 that has caused the link member 220 to move to the contact rotation position is a first final rotation position. In FIG. 10, the link member 220 that is in the contact rotation position and the cam portion 215 that is in the first final rotation position are illustrated with solid lines. When the cam portion 215 rotates from the initial rotation position to the first final rotation position, the rotation of the DC motor 104 in the forward direction is stopped. When the cam portion 215 is in the first final rotation position, the left side protruding portion 212 is in contact with the movable portion 242A.

When the rotation of the DC motor 104 in the forward direction is stopped, the rotation of the intermittent gear 136 in the first rotation direction is stopped. When the half cut operation is performed, while the cutting blade 275 is moving from the separated position to the contact position, the intermittent gear 136 rotates in the first rotation direction by a first specified rotation angle. The first specified rotation angle is smaller than the toothed portion non-formation angle. The first specified rotation angle of the present example is 190 degrees. While the cutting blade 275 is moving from the separated position to the contact position, the intermittent gear 136 does not mesh with the cam drive gear 156 and idles.

While the cutting blade 275 is moving from the separated position to the contact position, the right side protruding portion 211 does not come into contact with the movable portion 241A of the initial position sensor 241, and rotates in the first direction. Thus, while the cutting blade 275 is moving from the separated position to the contact position, the initial position sensor 241 outputs the OFF signal.

After the rotation of the DC motor 104 in the forward direction has stopped, the rotation direction is switched and the DC motor 104 rotates in the reverse direction. The cam portion 215 rotates in the second direction (the direction of the arrow B2 in FIG. 10). The link member 220 rotates in the fourth direction (the direction of the arrow B4 in FIG. 10) from the contact rotation position. The intermittent gear 136 rotates in the second rotation direction (the direction of the arrow A2 in FIG. 4).

When the cam portion 215 rotates to the initial rotation position (refer to FIG. 9) via the first intermediate rotation position, the link member 220 rotates to the separated rotation position via the clamping rotation position. The cutting blade 275 moves to the separated position (refer to FIG. 11A) via the clamping position (refer to FIG. 11B).

The DC motor 104 continues to rotate in the reverse direction. In the state in which the link member 220 is positioned in the separated position, the cam portion 215 rotates slightly in the second direction from the initial rotation position. The end surface of the right side protruding portion 211 in the second direction comes into contact with the movable portion 241A of the initial position sensor 241. The initial position sensor 241 outputs the ON signal instead of the OFF signal. The DC motor 104 switches the rotation direction and once more rotates in the forward direction. When the cam portion 215 returns to the initial rotation position, the right side protruding portion 211 separates from the movable portion 241A. The initial position sensor 241 outputs the OFF signal instead of the ON signal. In this manner, the CPU (not shown in the drawings) of the control board 19 determines that the cam portion 215 has returned to the initial rotation position, and stops the rotation of the DC motor 104. At that time, the intermittent gear 136 has returned to the start rotation position. As a result of the above operations, the cutting mechanism 100 returns to the initial state after performing the half cut of the large diameter tube 9A.

The half cut operation of the small diameter tube 9B by the cutting mechanism 100 will be explained with reference to FIG. 9, FIG. 10, and FIG. 12A to FIG. 12C. The half cut operation of the small diameter tube 9B is similar to the half cut operation of the large diameter tube 9A. Hereinafter, an explanation of operations that are the same as those of the half cut operation of the large diameter tube 9A will be simplified.

While the cutting mechanism 100 is in the initial state, the DC motor 104 rotates in the forward direction. The receiving block 180 is maintained in the state of being stopped in the first opposed position. When the cam portion 215 rotates to the first intermediate rotation position from the initial rotation position, the intermediate position sensor 242 outputs the ON signal instead of the OFF signal. At that time, the link member 220 has rotated to the clamping rotation position from the separated rotation position, and the cutting blade 275 has moved from the separated position (refer to FIG. 12A) to the clamping position (refer to FIG. 12B). The small diameter tube 9B is smaller than the large diameter tube 9A. Therefore, the small diameter tube 9B that is between the cutting blade 275 in the clamping position and the first contact surface 181 is only slightly elastically deformed.

After the intermediate position sensor 242 has output the ON signal, the DC motor 104 rotates further in the forward direction for a specified period of time. The cam portion 215 rotates further in the first direction from the first intermediate rotation position. The link member 220 rotates further in the third direction from the clamping rotation position, and urges the cutting blade 275 toward the first contact surface 181. The cutting blade 275 presses the small diameter tube 9B further toward the first contact surface 181. The cutting blade 275 moves from the clamping position to the contact position while cutting through the small diameter tube 9B. The small diameter tube 9B is half cut by leaving a portion of the small diameter tube 9B that has entered into the retraction groove 187.

After the cutting blade 275 has moved to the contact position, the rotation of the DC motor 104 in the forward direction is stopped. After that, the rotation direction is switched and the DC motor 104 rotates in the reverse direction. The DC motor 104 performs the same rotation operations as when the large diameter tube 9A is half cut. The cutting mechanism 100 returns to the initial state.

[3-2. Full Cut Operation of Cutting Mechanism 100]

The full cut operation of the large diameter tube 9A by the cutting mechanism 100 will be explained with reference to FIG. 3, FIG. 4, FIG. 6 to FIG. 9, FIG. 13, FIG. 14, and FIG. 15A to FIG. 15C. An overview of the full cut operation of the large diameter tube 9A is as follows. The cutting mechanism 100 causes the receiving block 180 to move to the second opposed position from the first opposed position, and clamps the large diameter tube 9A between the second contact surface 182 and the cutting blade 275. The cutting blade 275 presses the large diameter tube 9A toward the second contact surface 182 and thus performs a full cut of the large diameter tube 9A. In accordance with a driving control of the CPU (not shown in the drawings) of the control board 19 (refer to FIG. 2), the DC motor 104 is driven in the following manner.

The DC motor 104 rotates in the reverse direction while the cutting mechanism 100 is in the initial state. The intermittent gear 136 that is in the start rotation position rotates in the second rotation direction (the direction of the arrow A2 in FIG. 4). The first end portion 136B of the first toothed portion 136A meshes with the second toothed portion 156A. The cam drive gear 156 is caused to rotate in the third rotation direction (the direction of the arrow A3) by the intermittent gear 136.

As shown in FIG. 6 and FIG. 13, the cam member 158 is caused to rotate in the third rotation direction by the cam drive gear 156. In the state in which the sliding portion 172A is positioned in the first rotation position, the sliding portion 172A slides with respect to the first cam surface 162A and moves to the left while resisting the urging force of the coil spring 173. The support member 168 moves to the left while resisting the urging force of the coil springs 171 and 173. The receiving block 180 that is in the first opposed position moves to the left.

When the cam drive gear 156 is caused to rotate by the intermittent gear 136 by a second specified rotation angle, the sliding portion 172A moves from the right end portion to the left end portion of the first cam surface 162A, in the state in which the sliding portion 172A is positioned in the first rotation position. The sliding member 172 moves by the distance L as far as the left end position of the movable range of the sliding member 172. In this manner, the support member 168 moves by the distance L as far as the left end position of the movable range of the support member 168. The receiving block 180 moves by the distance L as far as the second opposed position. At that time, the first toothed portion 136A is meshed with the second toothed portion 156A.

The second specified rotation angle of the cam drive gear 156 corresponds to the angle over which the first cam surface 162A is formed, and is, for example, 82 degrees. As a result of the intermittent gear 136 rotating by a third specified rotation angle, the cam drive gear 156 is caused to rotate by the second specified rotation angle. The toothed portion formation angle is larger than the third specified rotation angle. The third specified rotation angle is smaller than the first specified rotation angle. The third specified rotation angle is, for example, 48 degrees.

After the receiving block 180 has moved to the second opposed position, the DC motor 104 continues to rotate in the reverse direction. The intermittent gear 136 rotates further in the second rotation direction, and the cam member 158 rotates further in the third rotation direction. After the sliding portion 172A has moved relative to the cam member 158 as far as the right end portion of the first cam surface 162A, the sliding portion 172A slides with respect to the third cam surface 162C. The third cam surface 162C extends in parallel to the fourth rotation direction. Therefore, the sliding portion 172A does not move to the left. The movement to the right of the sliding portion 172A, which is being urged to the right by the coil spring 173, is restricted by the third cam surface 162C. Thus, the receiving block 180 is maintained in the state of being positioned in the second opposed position.

As shown in FIG. 9, while the sliding portion 172A is sliding with respect to the third cam surface 162C, the cam portion 215 rotates in the second direction (the direction of the arrow B2) from the initial rotation position to the specific rotation position Immediately after the cam portion 215 has started to rotate in the second direction, the end surface of the right side protruding portion 211 in the second direction comes into contact with the movable portion 241A. The initial position sensor 241 outputs the ON signal instead of the OFF signal. The DC motor 104 continues to rotate in the reverse direction and the pressing pin 215A of the cam portion 215 urges the second arm portion 232 in the anti-clockwise direction in a left side view.

The link member 220 rotates in the third direction from the separated rotation position. The housing member 272 moves to the rear. The cutting blade 275 moves to the rear from the separated position (refer to FIG. 15A). Although not shown in the drawings, the housing member 272 that moves to the rear comes into contact, from the front, with the large diameter tube 9A ahead of the cutting blade 275. The movement of the housing member 272 to the rear is restricted. When the DC motor 104 continues to rotate in the reverse direction, the arm member 277 urges the cutting blade 275 (refer to FIG. 15A to FIG. 15C) to the rear. The cutting blade 275 moves to the rear, relative to the housing member 272, while resisting the urging force of the attachment spring (not shown in the drawings).

Figure 14:
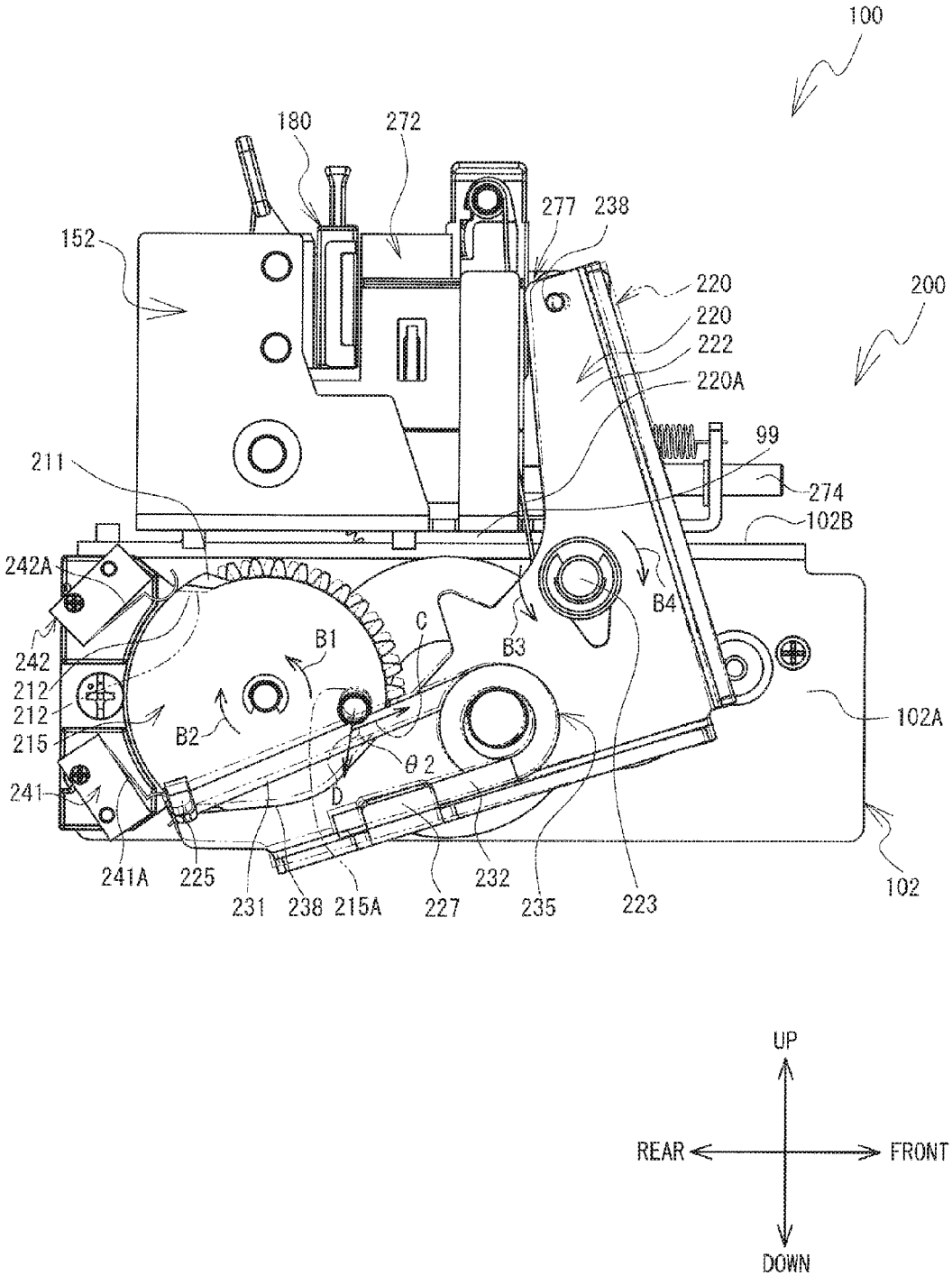
FIG. 14 is a left side view of the cutting mechanism 100 at a time of ending a full cut operation.
Figure 15A:
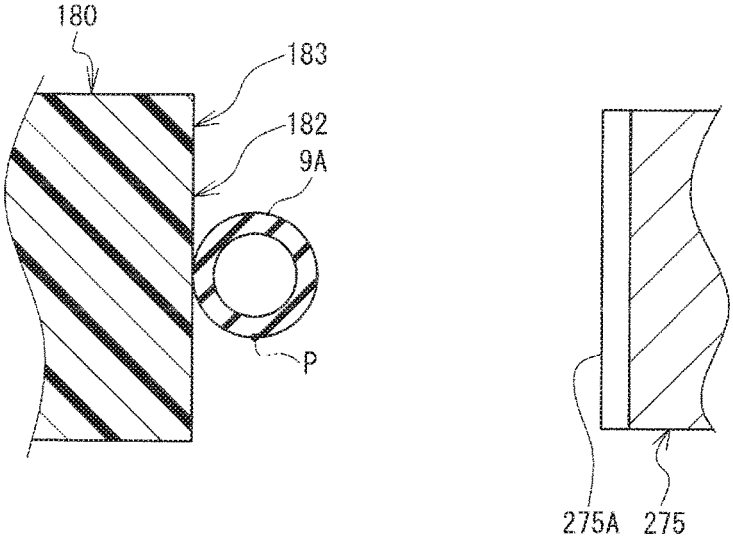
FIG. 15A is a diagram showing a positional relationship of the receiving block 180, the cutting blade 275, and the large diameter tube 9A.
Figure 15B:
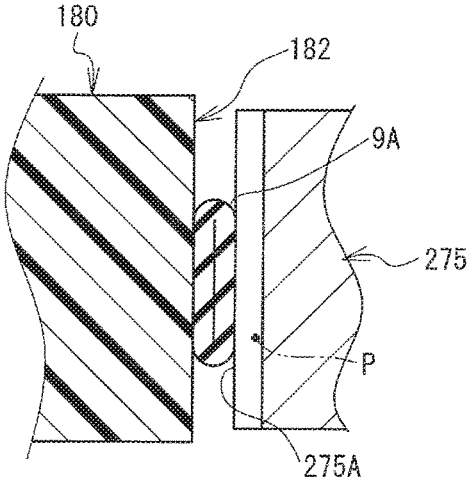
FIG. 15B is a diagram showing a positional relationship of the receiving block 180, the cutting blade 275, and the large diameter tube 9A.
Figure 15C:
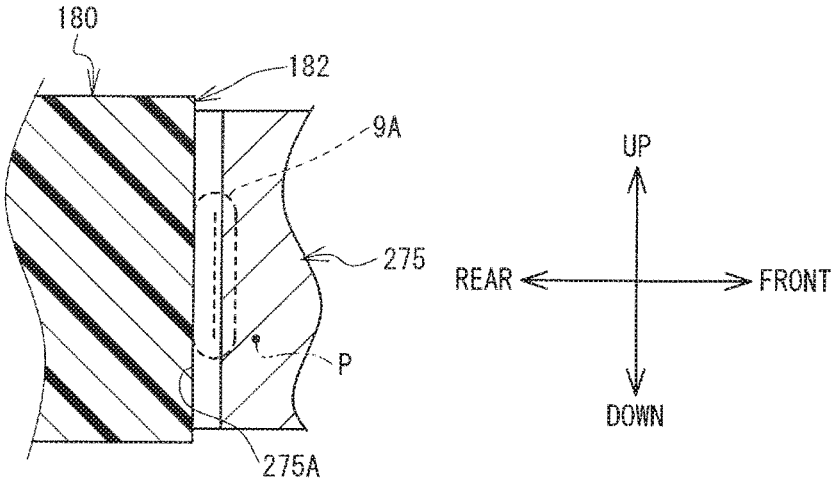
FIG. 15C is a diagram showing a positional relationship of the receiving block 180, the cutting blade 275, and the large diameter tube 9A.

As shown in FIG. 14 and FIG. 15B, the blade portion 275A moves to the clamping position. When the full cut operation is performed, the large diameter tube 9A is clamped between the cutting blade 275 that is in the clamping position and the second contact surface 182. Of the large diameter tube 9A, a portion that is between the blade portion 275A and the second contact surface 182 is elastically deformed and becomes a substantially elliptical shape that is long in the up-down direction in a left side view.

The rotation position of the link member 220 that has caused the cutting blade 275 to move to the clamping position is the above-described clamping rotation position. When the full cut operation is performed, the rotation position of the cam portion 215 that has caused the link member 220 to move to the clamping rotation position is a second intermediate rotation position. In FIG. 14, the link member 220 that is in the clamping rotation position and the cam portion 215 that is in the second intermediate rotation position are illustrated by lines of alternate long and short dashes.

When the cam portion 215 that is rotating in the second direction rotates from the initial rotation position to the second intermediate rotation position, the end surface of the left side protruding portion 212 in the second direction comes into contact with the movable portion 242A of the intermediate position sensor 242. The intermediate position sensor 242 outputs the ON signal instead of the OFF signal. In this way, the CPU (not shown in the drawings) of the control board 19 (refer to FIG. 2) can determine that the cam portion 215 has rotated to the second intermediate rotation position.

By the DC motor 104 rotating further in the reverse direction for a specified period of time, the cam portion 215 rotates further to the second direction side than the second intermediate rotation position. The pressing pin 215A presses the first arm portion 231. The first arm portion 231 is pressed in the anti-clockwise direction around the spring shaft portion 226 in a left side view. The first arm portion 231 separates slightly downward from the latching piece 225, and an amount of elastic deformation of the torsion spring 235 increases.

When the amount of elastic deformation of the torsion spring 235 increases at the time of the full cut operation, a pressing angle of the pressing pin 215A against the first arm portion 231 is an acute angle. The pressing angle when the full cut operation is performed corresponds to an angle θ2 shown in FIG. 14.

The cutting blade 275 that is being urged moves to the contact position (refer to FIG. 15C) while cutting through the large diameter tube 9A. When the full cut operation is performed, the blade portion 275A that has moved to the contact position is in contact with the second contact surface 182. The large diameter tube 9A is fully cut.

The rotation position of the link member 220 that has caused the cutting blade 275 to move to the contact position is the above-described contact rotation position. When the full cut operation is performed, the rotation position of the cam portion 215 that has caused the link member 220 to move to the contact rotation position is a second final rotation position. In FIG. 14, the link member 220 that is in the contact rotation position and the cam portion 215 that is in the second final rotation position are illustrated with solid lines. When the cam portion 215 is in the second final rotation position, the left side protruding portion 212 comes into contact with the movable portion 242A and the right side protruding portion 211 comes into contact with the movable portion 241A. As a result, the initial position sensor 241 and the intermediate position sensor 242 output the ON signals.

When the full cut operation is performed, while the cutting blade 275 is moving from the separated position to the contact position, the intermittent gear 136 rotates in the second rotation direction by a fourth specified rotation angle. The fourth specified rotation angle is smaller than the toothed portion formation angle. Thus, even when the cutting blade 275 moves from the separated position to the contact position, the first toothed portion 136A and the second toothed portion 156A are maintained in a state of being meshed with each other. The fourth specified rotation angle of the present example is 190 degrees, for example.

As shown in FIG. 6 and FIG. 13, after the cam portion 215 (refer to FIG. 14) has rotated to the second final rotation position, the DC motor 104 continues to rotate in the reverse direction. After the sliding portion 172A has slid with respect to the end portion of the third cam surface 162C in the fourth rotation direction, the sliding portion 172A slides with respect to the second cam surface 162B.

When the sliding portion 172A slides with respect to the second cam surface 162B, the sliding member 172 is urged by the coil spring 173 and moves to the right. The support member 168 moves to the right along with the sliding member 172. In this way, the receiving block 180 moves to the right from the second opposed position.

The sliding portion 172A that moves to the right comes into contact with the right end portion of the first cam surface 162A, after sliding with respect to the second cam surface 162B. The sliding member 172 moves to the right by the distance L as far as the right end position of the movable range of the sliding member 172. The support member 168 moves to the right by the distance L as far as the right end position of the movable range of the support member 168. In this way, the receiving block 180 moves from the second opposed position to the first opposed position. The rotation of the DC motor 104 in the reverse direction is stopped. At that time, the first toothed portion 136A and the second toothed portion 156A are maintained in the state of being meshed with each other. The rotation direction of the DC motor 104 is switched and the DC motor 104 starts to rotate in the forward direction.

As shown in FIG. 8, when the DC motor 104 starts to rotate in the forward direction, the cam member 158 rotates in the fourth rotation direction. The second cam surface 162B that rotates in the fourth rotation direction urges that sliding portion 172A in the clockwise direction in a left side view. After the second cam surface 162B, the sliding portion 172A comes into contact with the end portion of the specific cam surface 164 in the fourth rotation direction (the end portion of the second cam surface 162B in a direction of separation from the first shaft portion 154). The sliding member 172 rotates to the second rotation position.

While the specific cam surface 164 that rotates in the fourth rotation direction is sliding with respect to the sliding portion 172A, the movement of the support member 168 to the right is restricted by the right plate 152B, and the movement of the sliding member 172 to the right is restricted by the right wall portion 168B of the support member 168. Thus, while the sliding portion 172A is sliding with respect to the specific cam surface 164, the receiving block 180 is maintained in the state of being stopped in the first opposed position.

As shown in FIG. 9 and FIG. 14, while the sliding portion 172A is sliding with respect to the second cam surface 162B and the specific cam surface 164 in that order, the cam portion 215 rotates in the first direction from the second final rotation position. The cam portion 215 rotates to the initial rotation position from the second final rotation position via the second intermediate rotation position and the specific rotation position in that order. The link member 220 rotates from the contact rotation position to the separated rotation position via the clamping rotation position. The cutting blade 275 moves from the contact position to the separated position via the clamping position.

When the right side protruding portion 211 moves to the initial rotation position, the right side protruding portion 211 separates from the movable portion 241A. The initial position sensor 241 outputs the OFF signal instead of the ON signal. In this way, the CPU (not shown in the drawings) of the control board 19 can determine that the cam portion 215 has rotated to the initial rotation position. The rotation of the DC motor 104 in the forward direction is stopped. The cutting blade movement mechanism 200 returns to the initial state.

As shown in FIG. 6, when the cam portion 215 has returned to the initial rotation position, the sliding portion 172A has moved relative to the cam member 158 as far as the right end portion of the first cam surface 162A from the end portion of the specific cam surface 164 in the third rotation direction. The receiving block movement mechanism 120 returns to the initial state. As a result of the above-described operations, the cutting mechanism 100 returns to the initial state after performing the full cut operation of the large diameter tube 9A.

The operation of the cutting mechanism 100 to perform the full cut operation of the small diameter tube 9B is similar to the operation to perform the full cut operation of the large diameter tube 9A and an explanation is omitted here.

[4. Examples of Operational Effects]

As explained above, when the DC motor 104 rotates in the forward direction when the cutting mechanism 100 is in the initial state, the tube 9 is clamped between the blade portion 275A and the first contact surface 181. In this way, the cutting mechanism 100 half cuts the tube 9. On the other hand, when the DC motor 104 rotates in the reverse direction when the cutting mechanism 100 is in the initial state, the tube 9 is clamped between the blade portion 275A and the second contact surface 182. In this way, the cutting mechanism 100 fully cuts the tube 9. The cutting mechanism 100 can switch the cutting operation of the tube 9 between the half cut operation and the full cut operation simply by switching the rotation direction of the DC motor 104. The cutting mechanism 100 can perform the half cut operation and the full cut operation while simply having one each of the cutting blade 275, the receiving block 180, and the DC motor 104 (that is the drive source). As a result, the cutting mechanism 100 can perform the half cut operation and the full cut operation with a simple structure. In other words, the printer 1 can perform the half cut operation and the full cut operation with a simple structure, by being provided with the cutting mechanism 100.

When the DC motor 104 rotates in the forward direction when the cutting mechanism 100 is in the initial state, the first toothed portion 136A does not mesh with the second toothed portion 156A and the intermittent gear 136 idles in the first rotation direction. The receiving block movement mechanism 120 inhibits the transmission of the driving force of the DC motor 104 to the receiving block 180. While the DC motor 104 is rotating in the forward direction, the receiving block 180 is maintained in the state of being stopped at the first opposed position. On the other hand, immediately after the DC motor 104 has rotated in the reverse direction when the cutting mechanism 100 is in the initial state, the first toothed portion 136A and the second toothed portion 156A mesh with each other. The cam member 158 rotates in the fourth rotation direction and the receiving block 180 moves from the first opposed position to the second opposed position. In other words, when the DC motor 104 rotates in the reverse direction when the cutting mechanism 100 is in the initial state, the receiving block movement mechanism 120 allows the transmission of the driving force of the DC motor 104 to the receiving block 180. Simply with the intermittent gear 136, the cam drive gear 156, and the cam member 158, the receiving block movement mechanism 120 can be switched between a state that allows the transmission of the driving force of the DC motor 104 to the receiving block 180 and a state that inhibits the transmission of the driving force of the DC motor 104 to the receiving block 180. The structure of the receiving block movement mechanism 120 is simplified and it is thus possible to reduce the cost of the cutting mechanism 100.

The third specified rotation angle is smaller than the first specified rotation angle. Therefore, when the DC motor 104 rotates in the reverse direction when the intermittent gear 136 is in the start rotation position, the receiving block 180 moves to the second opposed position before the cutting blade 275 moves to the contact position. The receiving block 180 is stopped and stands by until the cutting blade 275 reaches the contact position. Thus, the cutting mechanism 100 can perform the full cut operation of the tube 9 in a stable manner.

When the DC motor 104 rotates in the reverse direction when the cutting mechanism 100 is in the initial state, the cam member 158 rotates in the third rotation direction. The sliding portion 172A slides with respect to the cam surface 162 and the receiving block 180 can move linearly from the first opposed position to the second opposed position. The cutting mechanism 100 can convert the rotation of the DC motor 104 to the linear movement of the receiving block 180, by causing the sliding portion 172A to slide with respect to the cam surface 162. As a result, the cutting mechanism 100 can convert the rotation of the DC motor 104 to the linear movement of the receiving block 180 with a simple structure.

When the cutting mechanism 100 performs the full cut operation, after the cutting blade 275 has moved to the contact position, the DC motor 104 continues to rotate in the forward direction. The sliding portion 172A slides with respect to the third cam surface 162C and the second cam surface 162B in that order, and comes into contact with the right end portion of the first cam surface 162A. The receiving block 180 moves from the second opposed position to the first opposed position. The DC motor 104 switches the rotation direction and rotates in the reverse direction, and while the cutting blade 275 is moving from the contact position to the separated position, the sliding portion 172A slides with respect to the specific cam surface 164. The receiving block 180 does not move from the first opposed position. Thus, the cutting mechanism 100 can reliably position the receiving block 180 in the first opposed position after the full cut operation of the tube 9 has ended.

The third cam surface 162C extends in parallel to the fourth rotation direction and the third rotation direction. As a result, when the full cut operation is performed, while the sliding portion 172A is sliding with respect to the third cam surface 162C, it is difficult for the receiving block 180 to move from the second opposed position toward the first opposed position. Thus, the receiving block 180 can stand by in a stable manner until the cutting blade 275 reaches the contact position.

When the DC motor 104 rotates in the forward direction when the cutting mechanism 100 is in the initial state, the receiving block 180 is maintained in the state of being positioned in the first opposed position. In the present example, when the receiving block 180 is positioned in the first opposed position, the first contact surface 181 can come into contact with the cutting blade 275. Thus, the cutting mechanism 100 can perform the half cut operation of the tube 9 in a more stable manner.

Figure 16:
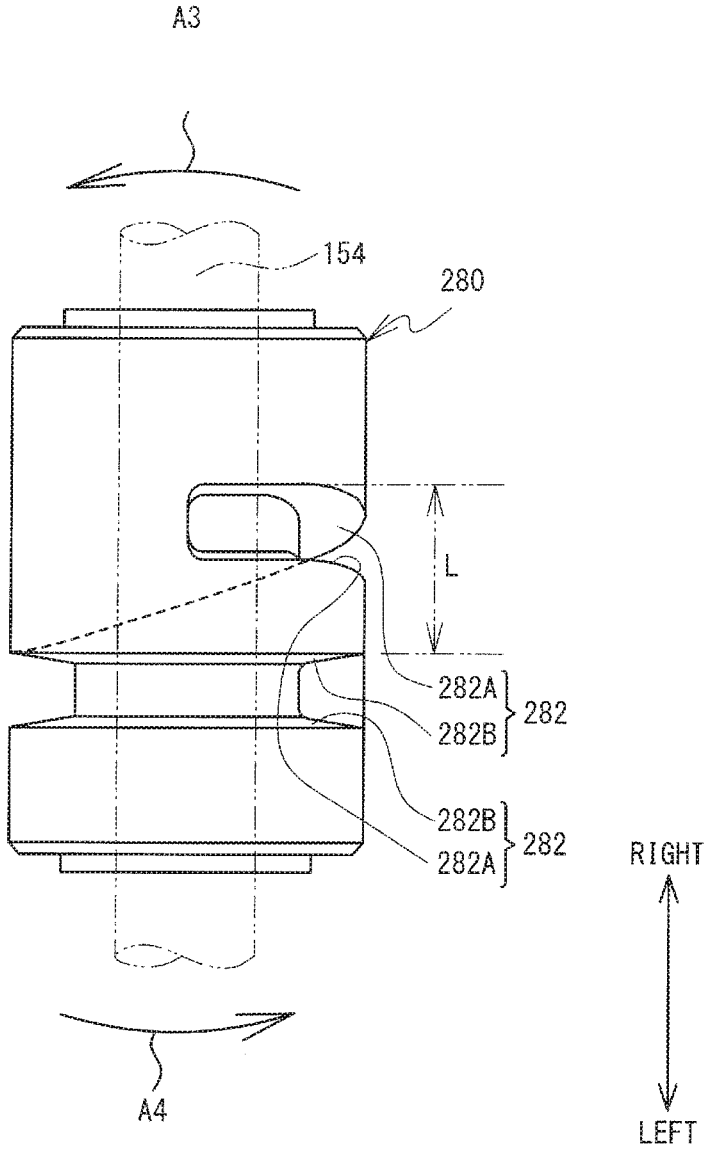
FIG. 16 is a diagram showing a cam member 280, which is a modified example of the cam member 158.

The cutting mechanism 100 is not limited to the above-described embodiment. For example, the cutting mechanism 100 may include a cam member 280, as shown in FIG. 16, in place of the cam member 158. In this case, the cutting mechanism 100 need not necessarily include the regulating portion 168D (refer to FIG. 8), and the coil springs 171 and 173 (refer to FIG. 6).

As shown in FIG. 16, the cam member 280 is supported by the first shaft portion 154 (refer to FIG. 6) and can rotate in the third rotation direction (the direction of the arrow A3) and the fourth rotation direction (the direction of the arrow A4). The cam member 280 includes two cam surfaces 282 that are separated by a gap in the left-right direction and that are opposed to each other.

Each of the cam surfaces 282 includes a first sliding surface 282A and a second sliding surface 282B. The first sliding surface 282A extends gradually to the left in the fourth rotation direction. A length of the first sliding surface 282A in the left-right direction (the distance L shown in FIG. 16) is the same as the length of the first cam surface 162A in the left-right direction (the distance L shown in FIG. 7). The second sliding surface 282B extends in the fourth rotation direction from the end portion of the first sliding surface 282A in the fourth rotation direction.

The sliding portion 172A (refer to FIG. 6) enters between the two cam surfaces 282. When the DC motor 104 rotates in the reverse direction when the receiving block movement mechanism 120 is in the initial state, the cam member 280 rotates in the third rotation direction. Of the two first sliding surfaces 282A, the sliding portion 172A slides with respect to the first sliding surface 282A on the right side. When the sliding portion 172A moves relative to the cam member 280 as far as the end portion of the first sliding surface 282A in the fourth rotation direction, the sliding member 172 moves from the right end position to the left end position of its movable range. As a result, the sliding member 172 moves by the distance L. The receiving block 180 moves from the first opposed position to the second opposed position before the cutting blade 275 moves to the contact position.

The DC motor 104 continues to rotate in the reverse direction, and the cam member 280 rotates further in the third rotation direction. The sliding portion 172A is disposed between the two second sliding surfaces 282B and is restricted from moving in the left-right direction. In this way, the receiving block 180 is maintained in the state of being positioned in the second opposed position until the cutting blade 275 moves to the contact position. As a result, the tube 9 is fully cut in a stable manner.

After the full cut operation has been performed, the DC motor 104 switches the rotation direction and rotates in the forward direction. The sliding portion 172A slides with respect to the second sliding surfaces 282B, and then slides with respect to the first sliding surface 282A, thus moving relative to the cam member 280. In this case, of the two first sliding surfaces 282A, the sliding portion 172A slides with respect to the first sliding surface 282A on the left side. In this manner, the sliding member 172 moves to the right by the distance L. The receiving block 180 moves from the second opposed position to the first opposed position. Thus, when the full cut operation is performed, the receiving block 180 can move along the left-right direction between the first opposed position and the second opposed position in a stable manner, in concert with the rotation of the DC motor 104.

[5. Overview of Structure and Operations of Cutting Mechanism 500 According to Modified Example]

Figure 20:
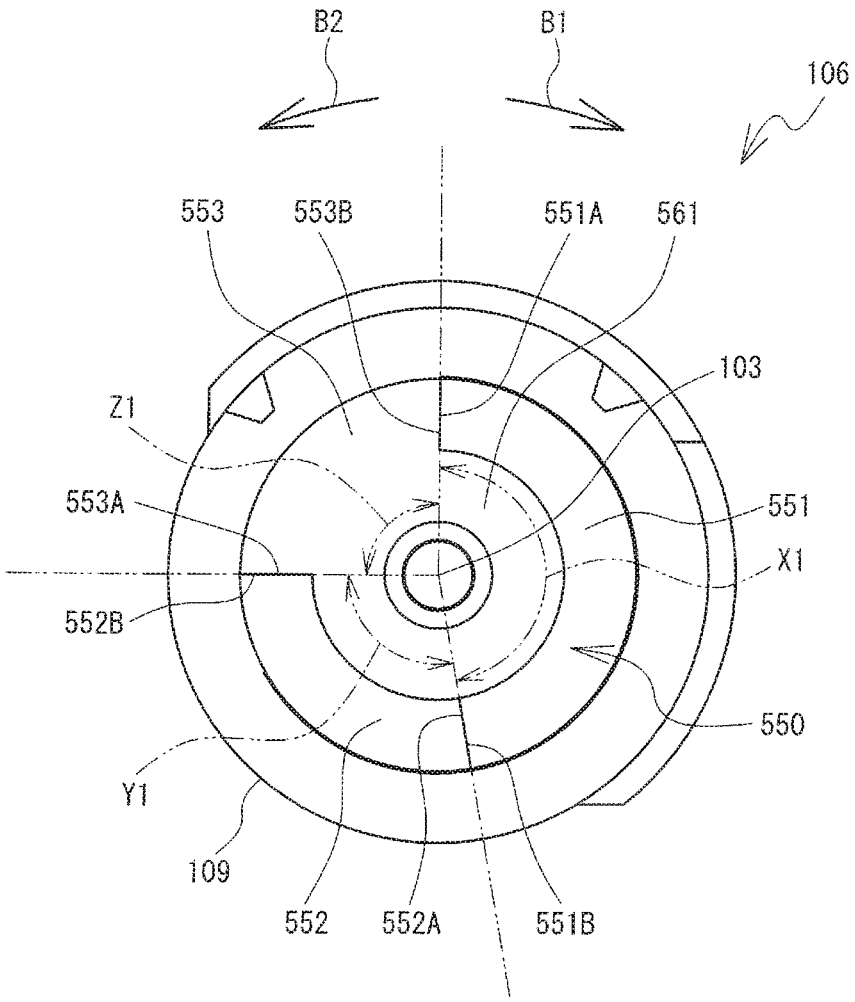
FIG. 20 is a right side view of the rotating member 106.
Figure 21:
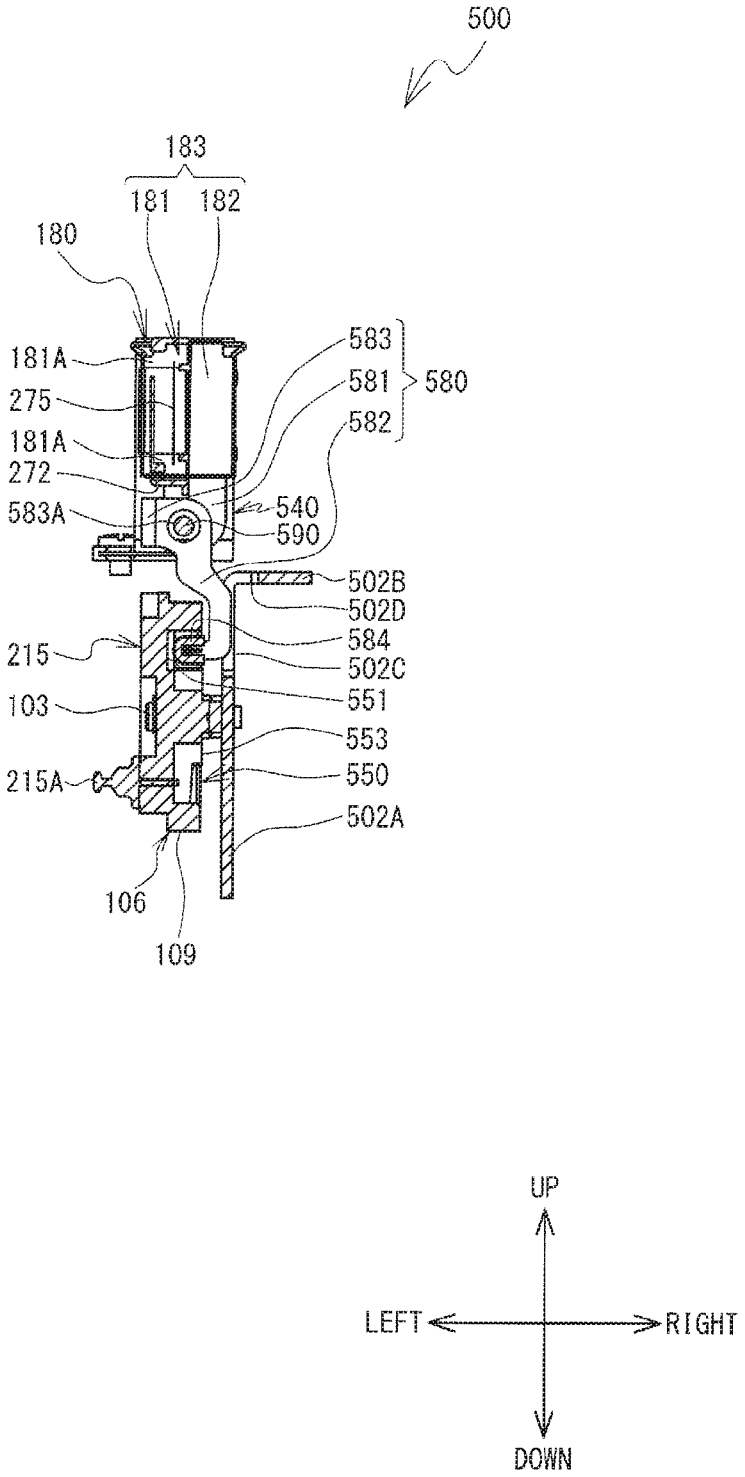
FIG. 21 is a front view of the receiving block 180 in the first opposed position.
Figure 22:
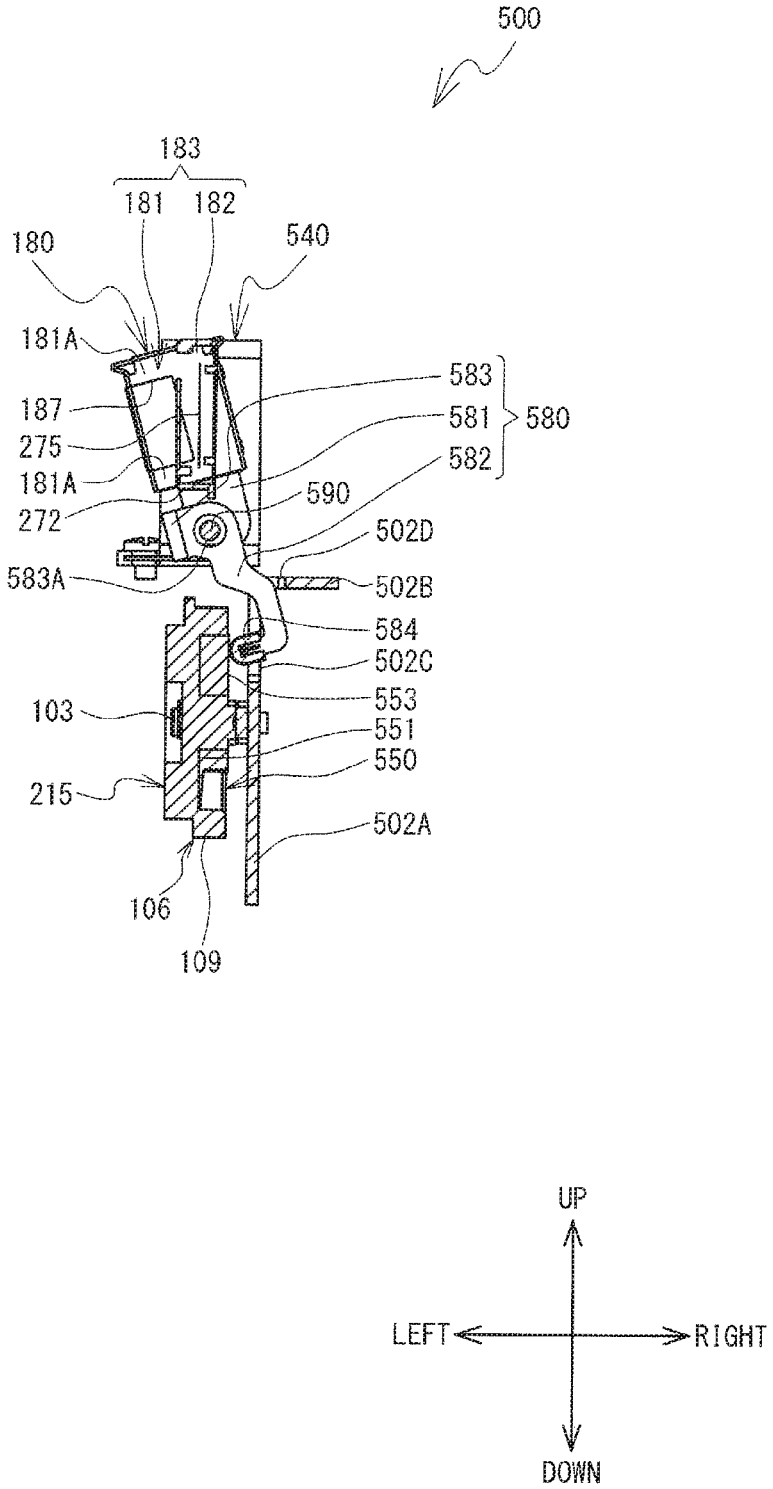
FIG. 22 is a front view of the receiving block 180 in the second opposed position.
Figure 23:
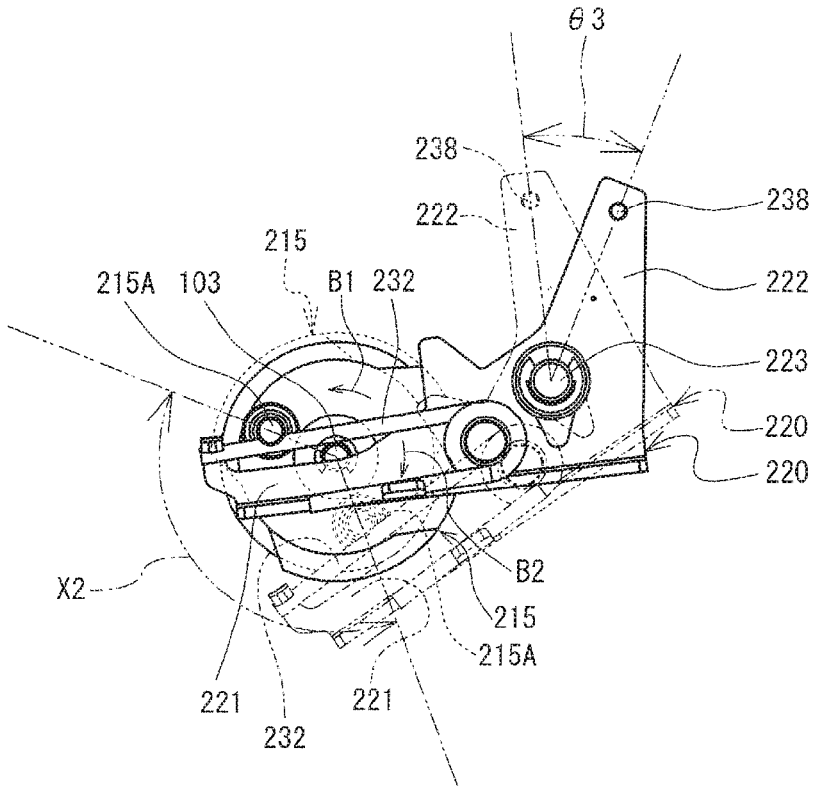
FIG. 23 is a left side view showing a rotational mode of a link member 220 and a cam portion 215 when a DC motor 104 rotates in a forward direction.
Figure 23:
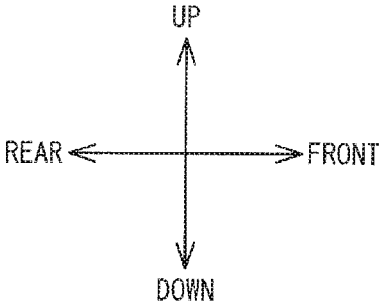
Figure 24:
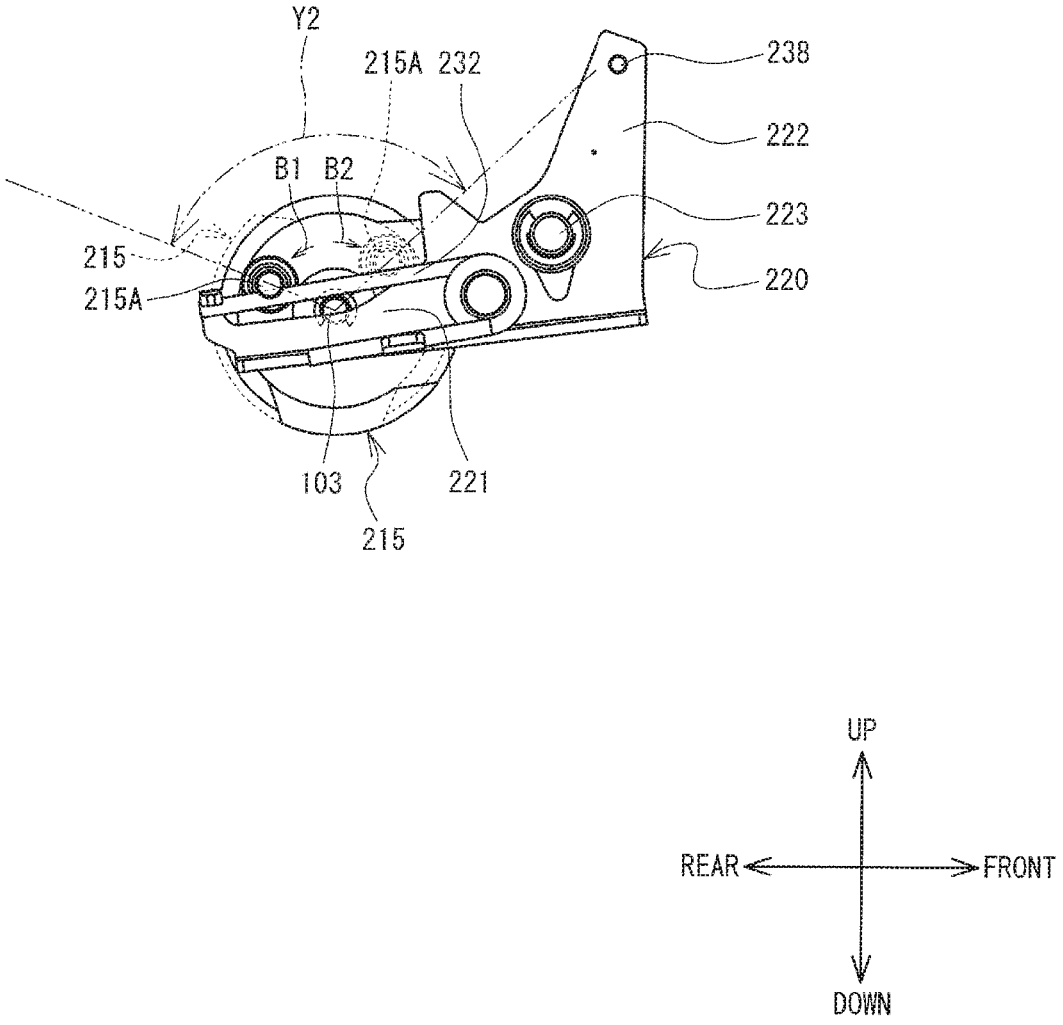
FIG. 24 is a left side view showing a rotational mode of the link member 220 and the cam portion 215 when the DC motor 104 rotates in a reverse direction.
Figure 25:
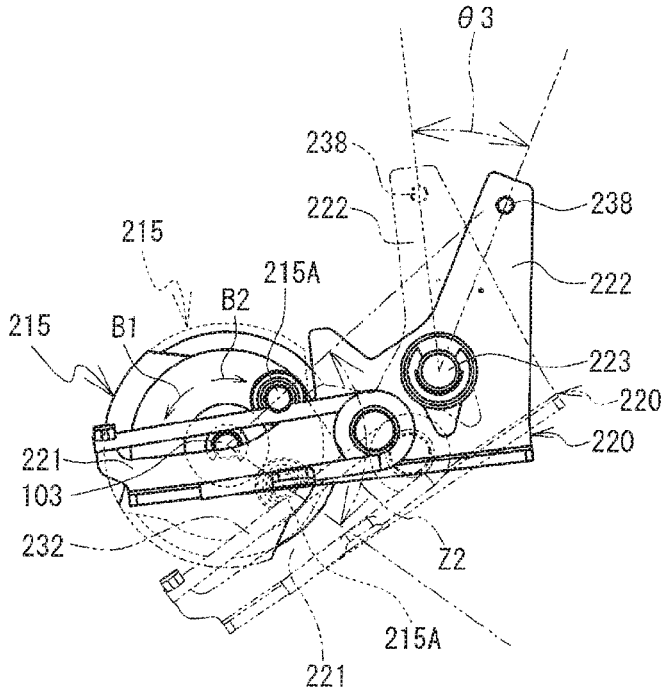
FIG. 25 is a left side view showing a rotational mode of the link member 220 and the cam portion 215 when the DC motor 104 rotates further in the reverse direction than shown in FIG. 23.
Figure 25:
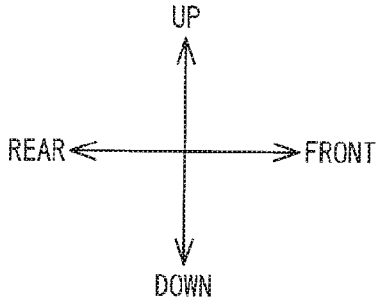

A cutting mechanism 500 that is a modified example of the cutting mechanism 100 will be explained with reference to FIG. 17 to FIG. 25. In the following explanation, the same reference numerals will be assigned to members having the same function as in the above-described embodiment, and an explanation thereof will be omitted. FIG. 21 and FIG. 22 show a cross section of the cam portion 215 etc. that is cut along a virtual surface that extends in the left-right direction and the up-down direction passing through the axial line of the rotating shaft portion 103 in the cutting mechanism 500. FIG. 23 shows, with solid lines, the cam portion 215 that is in the initial rotation position and the link member 220 that is in the separated rotation position. FIG. 23 shows, with broken lines, the cam portion 215 that is in the first final rotation position and the link member 220 that is in the contact rotation position. FIG. 24 shows, with solid lines, the cam portion 215 that is in the initial rotation position and the link member 220 that is in the separated rotation position. FIG. 24 shows, with broken lines, the cam portion 215 that is in the specific rotation position. FIG. 25 shows, with solid lines, the cam portion 215 that is in the specific rotation position and the link member 220 that is in the separated rotation position. FIG. 25 shows, with broken lines, the cam portion 215 that is in the second final rotation position and the link member 220 that is in the contact rotation position.

The printer 1 includes the cutting mechanism 500 in place of the cutting mechanism 100. The cutting mechanism 500 is provided between the left end portion of the tube mounting portion 40 (refer to FIG. 2) and the tube discharge opening 16 (refer to FIG. 2). The cutting mechanism 500 is a mechanism that performs cutting operations on the tube 9 (refer to FIG. 17) after printing.

Figure 17:
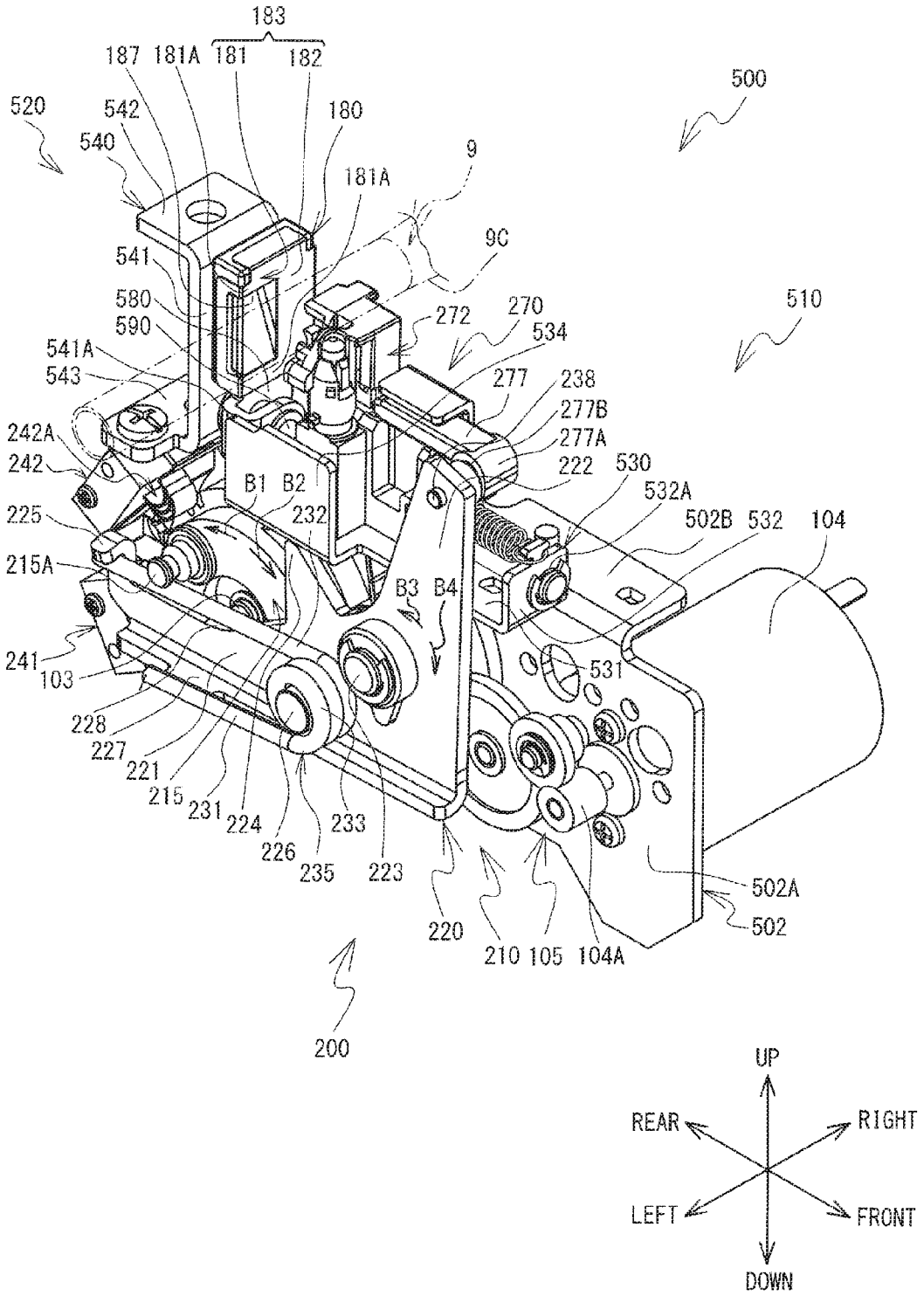
FIG. 17 is a perspective view of a cutting mechanism 500 as seen from the front left.
Figure 18:
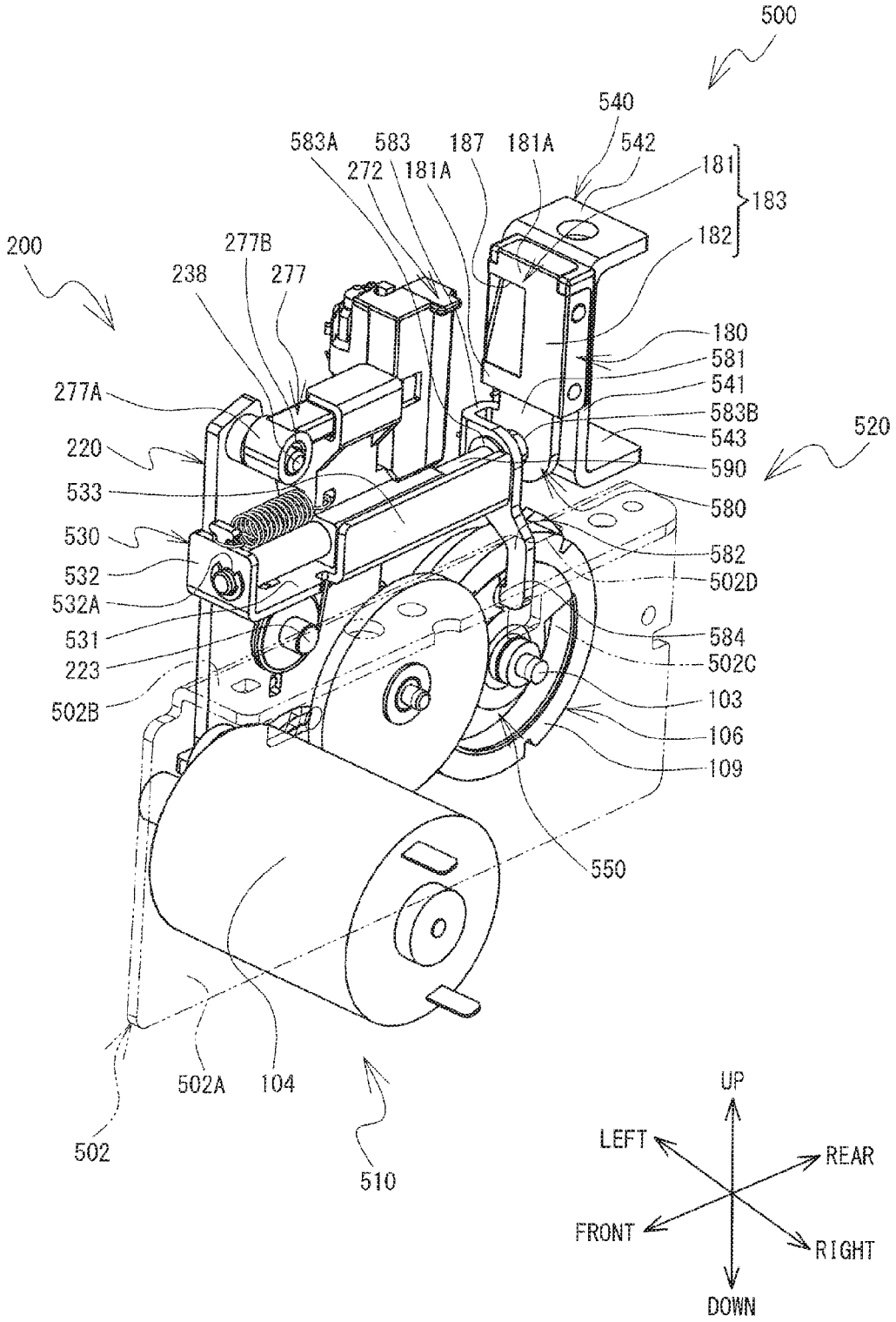
FIG. 18 is a perspective view of the cutting mechanism 500 as seen from the front right.

As shown in FIG. 17 and FIG. 18, the cutting mechanism 500 includes the positioning portion 190 (refer to FIG. 2), a drive portion 510, a receiving block swinging mechanism 520, and the cutting blade movement mechanism 200. The cutting mechanism 500 differs from the cutting mechanism 100 in that the cutting mechanism 500 includes the drive portion 510 in place of the drive portion 110 and the receiving block swinging mechanism 520 in place of the receiving block movement mechanism 120. Hereinafter, the drive portion 510 and the receiving block swinging mechanism 520 will be explained. The drive portion 510 drives the receiving block swinging mechanism 520 and the cutting blade movement mechanism 200. The receiving block swinging mechanism 520 is a mechanism that supports the receiving block 180 such that the receiving block 180 can swing in the left-right direction around a shaft extending in the front-rear direction. By the link member 220 rotating by a specified angle θ3 (refer to FIG. 23) around the link shaft portion 223 as a rotation shaft, the cutting blade 275 is caused to move between the separated position and the contact position.

[5-1. Drive Portion 510]

The drive portion 510 will be explained with reference to FIG. 17 and FIG. 18. The drive portion 510 is provided lower than the tube feed path 9C. The drive portion 510 includes a support portion 502, the DC motor 104, and the gear group 105 (refer to FIG. 17). The drive portion 510 differs from the drive portion 110 in that the drive portion 510 includes the support portion 502 in place of the support portion 102. The support portion 502 includes a first plate portion 502A and a second plate portion 502B. The first plate portion 502A is a plate-shaped body that extends in the up-down direction and the front-rear direction. A first recessed portion 502C (refer to FIG. 18) is formed in the first plate portion 502A. The first recessed portion 502C is recessed downward from the slightly rear side from a central portion, in the front-rear direction, of an upper end portion of the first plate portion 502A. The first recessed portion 502C penetrates through the first plate portion 502A in the left-right direction. The second plate portion 502B is a plate-shaped body that extends to the right from the upper end portion of the first plate portion 502A. The plate body 99 (refer to FIG. 9) is attached to the upper surface of the second plate portion 502B. The plate body 99 extends in the left-right direction and the front-rear direction. A second recessed portion 502D (refer to FIG. 17) is formed in the second plate portion 502B. The second recessed portion 502D is recessed to the right from the left end portion of the second plate portion 502B, from the same position, in the front-rear direction, as the first recessed portion 502C. The second recessed portion 502D penetrates through the second plate portion 502B in the up-down direction. The first recessed portion 502C and the second recessed portion 502D are formed continuously with each other.

The DC motor 104 is fixed to a front portion of a right surface of the first plate portion 502A. The output shaft of the DC motor 104 penetrates through the first plate portion 502A.

The gear group 105 includes the plurality of gears. The plurality of gears are rotatably provided on shaft portions that extend to the left from the left surface of the first plate portion 502A. In FIG. 16 and FIG. 17, some of the plurality of gears are not illustrated.

[5-2. Receiving Block Swinging Mechanism 520]

The receiving block swinging mechanism 520 will be explained with reference to FIG. 17 to FIG. 20 and FIG. 23 to FIG. 25. As shown in FIG. 16 and FIG. 17, the receiving block swinging mechanism 520 includes a cam surface 550 (refer to FIG. 18), auxiliary members 530 and 540, a rail member 590, a support portion 580, and the receiving block 180. The cutting mechanism 500 includes the auxiliary members 530 and 540 in place of the holding member 152. The cutting mechanism 500 includes the rail member 590 in place of the rail member 274 of the cutting mechanism 100.

[5-2-1. Cam Surface 550]

Figure 19:
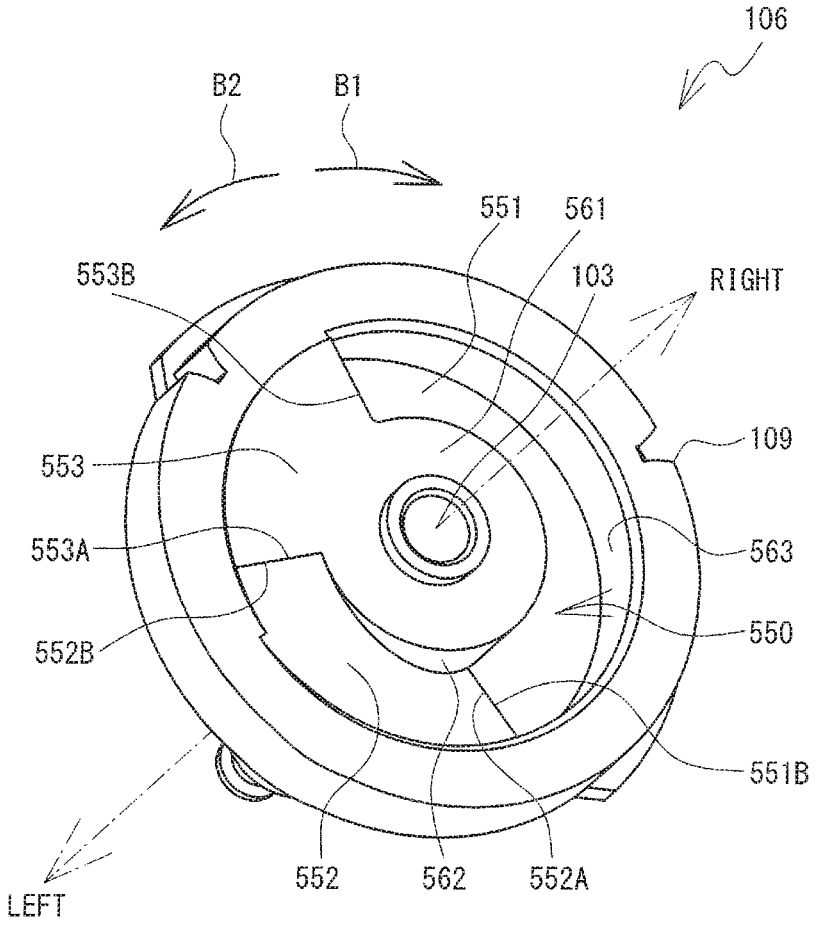
FIG. 19 is a perspective view of the rotating member 106 as seen from the right.

As shown in FIG. 19, the cam surface 550 is a surface formed on a right surface of the above-described rotating member 106. The cam surface 550 is circular in a right side view. The cam surface 550 can rotate around the rotating shaft portion 103, along with the first gear portion 109. The cam surface 550 includes a first surface 561, a second surface 562, a third surface 563, a first cam surface 551, a second cam surface 552, and a third cam surface 553. The first surface 561 is a surface that extends in a direction perpendicular to the rotating shaft portion 103. The first surface 561 is ring-shaped in a right side view. The first surface 561 has a specified width in a direction of separation away from the vicinity of the rotating shaft portion 103 (hereinafter referred to as a "separating direction"). The second surface 562 extends to the left from a part of the end portion of the first surface 561 in the separating direction. The third surface 563 is provided in a position separated further from the rotating shaft portion 103, in the separating direction, than the second surface 562. The third surface 563 is opposed to the second surface 562 with a gap between the third surface 563 and the second surface 562, and extends in the rotation direction of the rotating shaft portion 103. The right end portion of the third surface 563 is connected to the end portion of the right surface of the first gear portion 109 in a direction opposite to the separating direction.

The first cam surface 551 extends in the first direction (the direction of the arrow B1) on a part of the periphery of the rotating shaft portion 103, and extends from the left end portion of the second surface 562 to the left end portion of the third surface 563. The first cam surface 551 includes a first end portion 551A (refer to FIG. 20) and a second end portion 551B. The first end portion 551A is an end portion of the first cam surface 551 in the second direction (the direction of the arrow B2). The second end portion 551B is an end portion of the first cam surface 551 in the first direction.

The second cam surface 552 extends in the first direction from the second end portion 551B on a part of the periphery of the rotating shaft portion 103. The second cam surface 552 is inclined to the right with respect to the first direction. The second cam surface 552 extends from the left end portion of the second surface 562 to the left end portion of the third surface 563. The second cam surface 552 includes a third end portion 552A and a fourth end portion 552B. The third end portion 552A is an end portion of the second cam surface 552 in the second direction. The fourth end portion 552B is an end portion of the second cam surface 552 in the first direction. The third end portion 552A is connected to the second end portion 551B.

The third cam surface 553 extends in the first direction from the fourth end portion 552B to above the first end portion 551A, on a part of the periphery of the rotating shaft portion 103. Of the end portion of the first surface 561 in the separating direction, the third cam surface 553 extends from the end portion that is not connected to the second cam surface 562, to the right end portion of the third surface 563. The third cam surface 553 includes a fifth end portion 553A and a sixth end portion 553B. The fifth end portion 553A is an end portion of the third cam surface 553 in the second direction. The sixth end portion 553B is an end portion of the third cam surface 553 in the first direction. The fifth end portion 553A is connected to the fourth end portion 552B. The sixth end portion 553B is connected to the first end portion 551A, via a surface that extends from the sixth end portion 553B to the first end portion 551A.

Angles over which the first cam surface 551, the second cam surface 552, and the third cam surface 553 are formed will be explained with reference to FIG. 20. A first cam angle X1 is an angle over which the first cam surface 551 is formed. The first cam angle X1 is an angle from the first end portion 551A to the second end portion 551B in the first direction (the direction of the arrow B1). As shown in FIG. 23, a first rotation angle X2 is a rotation angle when the DC motor 104 rotates in the forward direction and the cam portion 215 rotates in the first direction from the initial rotation position to the first final rotation position. The first cam angle X1 is equal to or greater than the first rotation angle X2. For example, the first cam angle X1 is 170 degrees. The first rotation angle X2 is 150 degrees, for example.

A second cam angle Y1 is an angle over which the second cam surface 552 is formed. The second cam angle Y1 is an angle from the third end portion 552A to the fourth end portion 552B in the first direction. As shown in FIG. 24, a second rotation angle Y2 is a rotation angle when the DC motor 104 rotates in the reverse direction and the cam portion 215 rotates in the second direction (the direction of the arrow B2) from the initial rotation position to the specific rotation position. The second cam angle Y1 is equal to or smaller than the second rotation angle Y2. For example, the second cam angle Y1 is 110 degrees. The second rotation angle Y2 is 120 degrees, for example.

A third cam angle Z1 is an angle over which the third cam surface 553 is formed. The third cam angle Z1 is an angle from the fifth end portion 553A to the sixth end portion 553B in the first direction. As shown in FIG. 25, a third rotation angle Z2 is a rotation angle when the DC motor 104 rotates in the reverse direction and the cam portion 215 rotates in the second direction from the specific rotation position to the second final rotation position. The third cam angle Z1 is equal to or greater than the third rotation angle Z2. For example, the third cam angle Z1 is 80 degrees. The third rotation angle Z2 is 77 degrees, for example.

In the present modified example, a Formula (1) shown below is established.

$$\text{second cam angle } Y1 + \text{third cam angle } Z1 \geq \text{second rotation angle } Y2 + \text{third rotation angle } Z2. \qquad \text{Formula (1):}$$

[5-2-2. Auxiliary Members 530 and 540]

As shown in FIG. 17 and FIG. 18, the auxiliary member 530 is provided between the link member 220 and the first plate portion 502A, above the second plate portion 502B. The auxiliary member 530 is fixed to the plate body 99 (refer to FIG. 9). The auxiliary member 530 includes a lower plate portion 531, a front plate portion 532, a right plate portion 533 (refer to FIG. 18), and a left plate portion 534 (refer to FIG. 17).

The lower plate portion 531 is a plate-shaped body that is substantially rectangular in a plan view and whose longitudinal direction is the front-rear direction. The front plate portion 532 is a plate-shaped body that is substantially rectangular in a front view and extends upward from the front end portion of the lower plate portion 531. A hole portion 532A is formed in a substantially center portion of the front plate portion 532. The right plate portion 533 extends upward from a portion, of the right end portion of the lower plate portion 531, from the rear end portion to a slightly to the front of a substantially center portion in the front-rear direction. The right plate portion 533 is a plate-shaped body that is substantially rectangular in a right side view and whose longitudinal direction is the front-rear direction. The left plate portion 534 extends upward from a portion, of the left end portion of the lower plate portion 531, from the rear end portion to a substantially center portion in the front-rear direction. The left plate portion 534 is a plate-shaped body that is substantially rectangular in a left side view and whose longitudinal direction is the front-rear direction.

The auxiliary member 540 is provided on the rear side of the receiving block 180. The auxiliary member 540 is fixed to the plate body 99 (refer to FIG. 9). The auxiliary member 540 includes a first plate portion 541, a second plate portion 542, and a third plate portion 543. The first plate portion 541 is a plate-shaped body that is substantially rectangular in a front view and whose longitudinal direction is the up-down direction. The first plate portion 541 extends, in the up-down direction, from the upper end portion of the receiving block 180 to a position further below the lower end portion of the receiving block 180. A hole portion 541A (refer to FIG. 17) is formed in the section of the first plate portion 541 that is below the lower end portion of the receiving block 180. The second plate portion 542 and the third plate portion 543 are plate-shaped bodies that are substantially rectangular in a front view and that extend to the rear from the upper end portion and the lower end portion of the first plate portion 541, respectively.

[5-2-3. Rail Member 590]

The rail member 590 is a cylindrical body that extends in the front-rear direction. The rail member 590 is supported by the hole portions 532A and 541A. The housing member 272 is supported by a front portion of the rail member 590 such that the housing member 272 can move in the front-rear direction.

[5-2-4. Support portion 580]

As shown in FIG. 18, the support portion 580 is swingably supported by the rail member 590 between the auxiliary member 530 and the auxiliary member 540 in the front-rear direction. In the present modified example, the support portion 580 is a plate-shaped body that supports the receiving block 180. The support portion 580 includes a bent portion 583, an upper extension portion 581, and a lower extension portion 582. The bent portion 583 is a substantially rectangular frame shape that is open on the right side in a plan view. The bent portion 583 has a pair of wall portions that are opposed to each other in the front-rear direction with a gap therebetween. Of the pair of wall portions of the bent portion 583, a hole 583A is formed in the wall portion on the front side. Of the pair of wall portions of the bent portion 583, a hole 583B is formed in the wall portion on the rear side. The rail member 590 is inserted through the holes 583A and 583B. A diameter of each of the holes 583A and 583B is slightly larger than a diameter of the rail member 590. Thus, the support portion 580 can swing, with the rail member 590 as a fulcrum.

The upper extension portion 581 extends upward from the upper end of a rear portion of the bent portion 583. The upper extension portion 581 has a substantially rectangular shape in a front view and its longitudinal direction is the up-down direction. The receiving block 180 is fixed to an upper end portion of the upper extension portion 581.

The lower extension portion 582 extends downward and to the right from the lower end of a front portion of the bent portion 583, and then extends further downward. The lower extension portion 582 has a substantially rectangular shape in a front view and its longitudinal direction is the up-down direction. A length in the up-down direction of the lower extension portion 582 is substantially the same as a distance from a lower end portion of the upper extension portion 581 to an upper end portion of the receiving block 180. The lower extension portion 582 is inserted into the first recessed portion 502C and the second recessed portion 502D.

A sliding portion 584, which protrudes to the left, is provided on a lower end portion of the lower extension portion 582. The sliding portion 584 is provided on a side, of the support portion 580, opposite to the receiving block 180 with respect to the rail member 590. The sliding portion 584 slides with respect to the first cam surface 551 (refer to FIG. 18), the second cam surface 552 (refer to FIG. 18), and the third cam surface 553 (refer to FIG. 18) by the rotation of the rotating member 106. The sliding portion 584 is urged to the left by a spring (not shown in the drawings) that is provided in the hole 583A.

According to the above-described structure, when the sliding portion 584 is sliding with respect to the first cam surface 551, the receiving block 180 is positioned in the first opposed position. When the sliding portion 584 is sliding with respect to the third cam surface 553, the receiving block 180 is positioned in the second opposed position. The support portion 580 swingably supports the receiving block 180, with the rail member 590 as a fulcrum, on the downstream side of the positioning portion 190 in the tube feed direction.

[5-2-5. Positional Relationships of Various Members when Receiving Block Swinging Mechanism 520 is in Initial State]

Positional relationships of the cam surface 550, the support portion 580, the rail member 590, and the receiving block 180 when the receiving block swinging mechanism 520 having the above-described structure is in the initial state will be explained with reference to FIG. 19 to FIG. 21. When the receiving block swinging mechanism 520 is in the initial state, the sliding portion 584 comes into contact with the vicinity of the second end portion 551B of the first cam surface 551. At this time, as shown in FIG. 21, a virtual line linking the sliding portion 584, the rail member 590, and the receiving block 180 is substantially aligned in the up-down direction. When the receiving block swinging mechanism 520 is in the initial state, the receiving block 180 is positioned in the first opposed position.

[5-2-6. Overview of Operations of Receiving Block Swinging Mechanism 520]

An overview of operations of the receiving block swinging mechanism 520 will be explained with reference to FIG. 19, FIG. 21, and FIG. 22. By the sliding portion 584 sliding with respect to the cam surface 550, the support portion 580 swings, with the rail member 590 as the fulcrum. In this way, the receiving block swinging mechanism 520 swingably supports the receiving block 180 between the first opposed position and the second opposed position.

When the DC motor 104 rotates in the forward direction when the receiving block swinging mechanism 520 is in the initial state, the cam surface 550 rotates in the first direction (the direction of the arrow B1). In this case, the sliding portion 584 slides with respect to the first cam surface 551 from the vicinity of the second end portion 551B as far as the vicinity of the first end portion 551A. The position of the sliding portion 584 does not change in the left-right direction. Thus, the support portion 580 does not swing with the rail member 590 as the fulcrum. In this case, the receiving block swinging mechanism 520 inhibits the transmission of the driving force of the DC motor 104 to the receiving block 180. The receiving block swinging mechanism 520 maintains the receiving block 180 in the state of being stopped in the first opposed position (refer to FIG. 21).

When the DC motor 104 rotates in the reverse direction when the receiving block swinging mechanism 520 is in the initial state, the cam surface 550 rotates in the second direction (the direction of the arrow B2). In this case, the sliding portion 584 slides from the vicinity of the second end portion 551B as far as the sixth end portion 553B, in the order of the first cam surface 551, the second cam surface 552 and the third cam surface 553. The position of the sliding portion 584 in the left-right direction is displaced gradually to the right. In line with this, the support portion 580 causes the receiving block 180 to swing to the left, with the rail member 590 as the fulcrum. In this case, the receiving block swinging mechanism 520 allows the transmission of the driving force of the DC motor 104 to the receiving block 180. The receiving block swinging mechanism 520 causes the receiving block 180 to swing from the first opposed position (refer to FIG. 21) to the second opposed position (refer to FIG. 22).

[6. Cutting Operations of Cutting Mechanism 500]

Hereinafter, the cutting operations of the cutting mechanism 500 will be explained, as the half cut operation of the tube 9 and the full cut operation of the tube 9. The movement of the cutting blade 275 by the cutting blade movement mechanism 200 is the same as the above-described embodiment and an explanation thereof is simplified here.

Before the start of the cutting operation, the cutting mechanism 500 is in an initial state. When the cutting mechanism 500 is in the initial state, the receiving block swinging mechanism 520 is in the initial state and the cutting blade movement mechanism 200 is in the initial state. When the cutting mechanism 500 is in the initial state, the tube 9 may be positioned on the bottom wall portion 192 of the positioning portion 190 by the user.

[6-1. Half Cut Operation of Cutting Mechanism 500]

The half cut operation of the tube 9 will be explained. The DC motor 104 rotates in the forward direction while the cutting mechanism 500 is in the initial state. In this way, the rotating member 106 rotates in the first direction (the direction of the arrow B1). In accordance with the rotation of the rotating member 106 in the first direction, the cam surface 550 and the cam portion 215 rotate in the first direction.

By the cam surface 550 rotating in the first direction, the sliding portion 584 slides with respect to the first cam surface 551. The position of the sliding portion 584 in the left-right direction is not displaced. Thus, the support portion 580 maintains the receiving block 180 in the state of being stopped in the first opposed position.

Meanwhile, by rotating in the first direction, the cam portion 215 rotates from the initial rotation position to the first final rotation position, via the first intermediate rotation position. In this way, the cutting blade 275 moves to the contact position (refer to FIG. 11C) and half cuts the tube 9.

As described above, the first cam angle X1 is equal to or greater than the first rotation angle X2. In the initial state, the sliding portion 584 is in contact with the vicinity of the second end portion 551B of the first cam surface 551. Thus, while the sliding portion 584 is sliding with respect to the first cam surface 551, the cam portion 215 can rotate from the initial rotation position to the first final rotation position, via the first intermediate rotation position. While the sliding portion 584 is sliding with respect to the first cam surface 551, the link member 220 can move the cutting blade 275 from the separated position to the contact position.

As described above, the cutting mechanism 500 moves the cutting blade 275 to the contact position while maintaining the receiving block 180 in the state of being stopped in the first opposed position. In this way, the cutting mechanism 500 performs the half cut operation of the tube 9. After the half cut operation has ended, the DC motor 104 rotates in the reverse direction, and the cutting mechanism 500 returns to the initial state.

[6-2. Full Cut Operation of Cutting Mechanism 500]

The full cut operation of the tube 9 will be explained. The DC motor 104 rotates in the reverse direction while the cutting mechanism 500 is in the initial state. In this way, the rotating member 106 rotates in the second direction (the direction of the arrow B2). In accordance with the rotation of the rotating member 106 in the second direction, the cam surface 550 and the cam portion 215 rotate in the second direction.

By the cam surface 550 rotating in the second direction, the sliding portion 584 slides from the first cam surface 551 to the third cam surface 553, via the second cam surface 552. The position of the sliding portion 584 in the left-right direction is displaced to the right. In accordance with this, the support portion 580 causes the receiving block 180 to swing to the left, with the rail member 590 as the fulcrum, and thus causes the receiving block 180 to swing from the first opposed position to the second opposed position.

Meanwhile, by rotating in the second direction, the cam portion 215 rotates from the initial rotation position to the specific rotation position. In this case, the pressing pin 215A separates from the second arm portion 232. Therefore, the link member 220 does not rotate.

As described above, the second cam angle Y1 is equal to or smaller than the second rotation angle Y2. In the initial state, the sliding portion 584 is in contact with the vicinity of the second end portion 551B of the first cam surface 551. As a result, while the cam portion 215 is rotating from the initial rotation position to the specific rotation position, the sliding portion 584 slides from the first cam surface 551 to the third cam surface 553, via the second cam surface 552. While the cam portion 215 is rotating from the initial rotation position to the specific rotation position, the receiving block 180 swings from the first opposed position to the second opposed position. When the cam portion 215 is in the specific rotation position, the sliding portion 584 is in contact with the vicinity of the fifth end portion 553A of the third cam surface 553.

By further rotating in the second direction, the cam portion 215 that is in the specific rotation position rotates from the specific rotation position to the second final rotation position, via the second intermediate rotation position. In this way, the cutting blade 275 moves to the contact position and cuts the tube 9.

As described above, the third cam angle Z1 is equal to or greater than the third rotation angle Z2. When the cam portion 215 is in the specific rotation position, the sliding portion 584 is in contact with the vicinity of the fifth end portion 553A of the third cam surface 553. Thus, while the sliding portion 584 is sliding with respect to the third cam surface 553, the cam portion 215 can rotate from the specific rotation position to the second final rotation position, via the second intermediate rotation position. Specifically, while the sliding portion 584 is sliding with respect to the third cam surface 553, the link member 220 can move the cutting blade 275 from the separated position to the contact position.

As described above, the cutting mechanism 500 causes the receiving block 180 to swing from the first opposed position to the second opposed position. After that, the cutting mechanism 500 moves the cutting blade 275 to the contact position, while maintaining the receiving block 180 in the second opposed position. In this way, the cutting mechanism 500 performs the full cut operation of the tube 9. After the full cut operation has ended, the cutting mechanism 500 returns to the initial state by the DC motor 104 rotating in the forward direction.

[7. Example of Operational Effects]

As explained above, when the DC motor 104 rotates in the forward direction while the cutting mechanism 500 is in the initial state, the tube 9 is clamped between the blade portion 275A and the first contact surface 181. In this way, the cutting mechanism 500 half cuts the tube 9. On the other hand, when the DC motor 104 rotates in the reverse direction while the cutting mechanism 500 is in the initial state, the tube 9 is clamped between the blade portion 275A and the second contact surface 182. In this way, the cutting mechanism 500 fully cuts the tube 9. The cutting mechanism 500 can switch the cutting operation of the tube 9 between the half cut operation and the full cut operation, simply by switching the rotation direction of the DC motor 104. The cutting mechanism 500 can perform the half cut operation and the full cut operation while simply having one each of the cutting blade 275, the receiving block 180, and the DC motor 104 (that is the drive source). As a result, the cutting mechanism 500 can perform the half cut operation and the full cut operation with a simple structure. In other words, the printer 1 can perform the half cut operation and the full cut operation with a simple structure, by being provided with the cutting mechanism 500.

When the DC motor 104 rotates in the forward direction when the cutting mechanism 500 is in the initial state, the sliding portion 584 continues to slide with respect to the first cam surface 551, in concert with the rotation of the cam portion 215 in the first direction. In this case, the position of the sliding portion 584 is not displaced in the left-right direction. In this way, the receiving block swinging mechanism 520 inhibits the transmission of the driving force of the DC motor 104 to the receiving block 180. The receiving block swinging mechanism 520 maintains the receiving block 180 in the state of being stopped in the first opposed position. The link member 220 causes the cutting blade 275 to move from the separated position to the contact position, as a result of being rotated by the cam portion 215 by the specified angle θ3.

The first cam angle X1 is equal to or greater than the first rotation angle X2. In the initial state, the sliding portion 584 is in contact with the vicinity of the second end portion 551B of the first cam surface 551. Thus, while the sliding portion 584 is sliding with respect to the first cam surface 551, the cam portion 215 can rotate from the initial rotation position to the first final rotation position, via the first intermediate rotation position. While the sliding portion 584 is sliding with respect to the first cam surface 551, the link member 220 can cause the cutting blade 275 to move from the separated position to the contact position. In this way, the cutting mechanism 500 can perform the half cut operation in a stable manner.

On the other hand, when the DC motor 104 rotates in the reverse direction when the cutting mechanism 500 is in the initial state, the sliding portion 584 slides with respect to the first cam surface 551, the second cam surface 552, and the third cam surface 553, in that order, in concert with the rotation of the cam portion 215 in the second direction. Thus, the sliding portion 584 moves to the right. In this case, the receiving block swinging mechanism 520 allows the transmission of the driving force of the DC motor 104 to the receiving block 180. The support portion 580 swings, with the rail member 590 as the fulcrum. In this way, the receiving block swinging mechanism 520 causes the receiving block 180 to swing from the first opposed position to the second opposed position. While the sliding portion 584 is sliding with respect to the second cam surface 552, the pressing pin 215A separates from the link member 220. As a result, the link member 220 does not move the cutting blade 275.

The second cam angle Y1 is equal to or smaller than the second rotation angle Y2, and, in the initial state, the sliding portion 584 is in contact with the vicinity of the second end portion 551B of the first cam surface 551. Thus, while the cam portion 215 is rotating from the initial rotation position to the specific rotation position, the sliding portion 584 slides from the first cam surface 551 to the third cam surface 553, via the second cam surface 552. While the cam portion 215 is rotating from the initial rotation position to the specific rotation position, the receiving block 180 can swing from the first opposed position to the second opposed position.

After the sliding portion 584 has slid with respect to the third cam surface 553 and the receiving block 180 has swung to the second opposed position, the link member 220 is caused to rotate by the cam portion 215 by the specified angle θ3. In this way, the link member 220 causes the cutting blade 275 to move from the separated position to the contact position.

When the third cam angle Z1 is equal to or greater than the third rotation angle Z2 and the cam portion 215 is in the specific rotation position, the sliding portion 584 is in contact with the vicinity of the fifth end portion 553A of the third cam surface 553. Thus, while the sliding portion 584 is sliding with respect to the third cam surface 553, the cam portion 215 can rotate from the specific rotation position to the second final rotation position, via the second intermediate rotation position. Specifically, while the sliding portion 584 is sliding with respect to the third cam surface 553, the link member 220 can cause the cutting blade 275 to move from the separated position to the contact position. In this way, the cutting mechanism 500 can perform the full cut operation in a stable manner.

In the present modified example, the Formula (1) is established. Specifically, a rotation angle by which the cam portion 215 rotates from the initial rotation position to the second final rotation position (the second rotation angle Y2+the third rotation angle Z2) is smaller than an angle from the third end portion 552A to the sixth end portion 553B in the second direction (the second cam angle Y1+the third cam angle Z1). As a result, when the DC motor 104 rotates in the reverse direction when the cutting mechanism 500 is in the initial state, while the sliding portion 584 is sliding with respect to the third cam surface 553, the link member 220 can reliably cause the cutting blade 275 to move from the separated position to the contact position.

Each of the receiving block 180 and the cutting blade 275 is moved by the DC motor 104 (which is the driving source), the link member 220, and the cam portion 215 that includes the cam surface 550. The cam surface 550 and the cam portion 215 are provided on the single member. The driving force of the DC motor 104 is transmitted to the receiving block 180 and the cutting blade 275 via the cam portion 215 that includes the cam surface 550. The receiving block swinging mechanism 520 and the cutting blade movement mechanism 200 can be easily synchronized. The cutting mechanism 500 can switch between the half cut operation and the full cut operation in a stable manner.

The support portion 580 swingably supports the receiving block 180, with the rail member 590 as the fulcrum, on the downstream side of the positioning portion 190 in the tube feed direction. As a result, the cutting mechanism 500 can suppress interference between the receiving block 180 and the positioning portion 190.

When the DC motor 104 rotates in the forward direction, the cutting mechanism 500 maintains the receiving block 180 in the state of being stopped in the first opposed position. The cutting mechanism 500 clamps the tube 9 between the receiving block 180 in the first opposed position and the blade portion 275A, and cuts the tube 9. When the cutting mechanism 500 half cuts the tube 9, the receiving block 180 does not move with respect to the blade portion 275A. Thus, the cutting mechanism 500 can perform the half cut operation in a stable manner.

When the cutting blade 275 moves between the separated position and the contact position, the rail member 590 guides the movement of the housing member 272 in the front-rear direction, and swingably supports the support portion 580. Using the rail member 590 that is the single member, it is possible to guide the movement of the cutting blade 275 and to support the support portion 580. As a result, it is possible to reduce a number of components of the cutting mechanism 500 and the cutting mechanism 500 can be downsized. The swinging fulcrum of the support portion 580 is positioned on an extension line of a movement axis of the housing member 272. Thus, it is difficult for the position of the cutting blade 275 housed in the housing member 272 to be displaced with respect to the receiving block 180.

Figure 26:
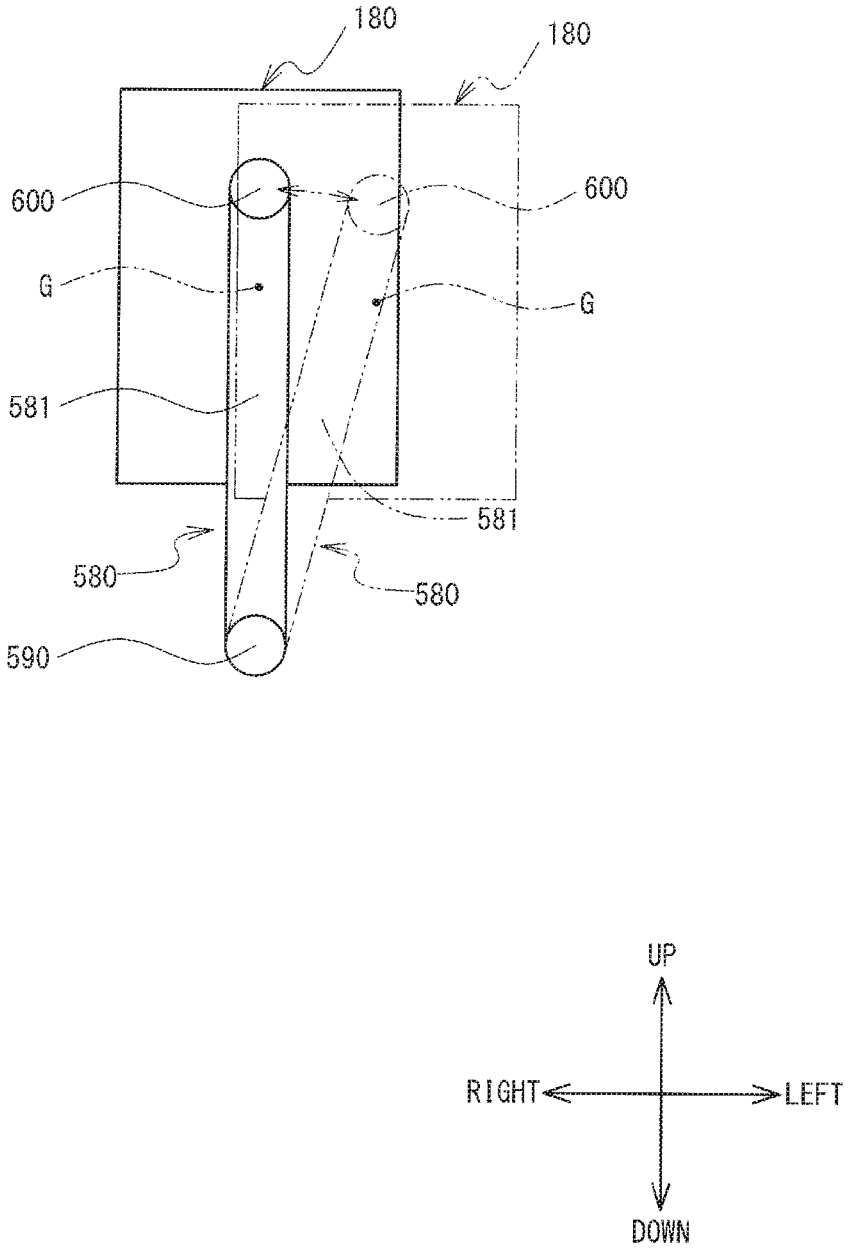
FIG. 26 is a back view showing a swinging mode of the receiving block 180 that is swung by a support portion 580 including a second fulcrum portion 600.

The cutting mechanism 500 is not limited to the above-described modified example. For example, the cutting mechanism 500 may include the support portion 580 including a second fulcrum portion 600. As shown in FIG. 26, the support portion 580 includes the second fulcrum portion 600 on an end portion on the opposite side to that supported by the rail member 590, of the upper extension portion 581. FIG. 26 shows the receiving block 180 that is in the first opposed position, the rail member 590, and the upper extension portion 581 of the support portion 580, with solid lines. FIG. 26 shows the receiving block 180 that is in the second opposed position, the rail member 590, and the upper extension portion 581 of the support portion 580, with lines of alternate long and short dashes. The support portion 580 swingably supports the receiving block 180 above a center of gravity G of the receiving block 180. In this way, when the receiving block 180 swings due to the support portion 580 between the first opposed position and the second opposed position, with the rail member 590 as the fulcrum, the receiving block 180 swings due to its own weight, with the second fulcrum portion 600 as a fulcrum. As a result, it is easy for the receiving block 180 to maintain the same angle with respect to the horizontal plane. In this way, it is easy for the blade portion 275A to come into contact with the contact surface 183 at the same angle, regardless of whether the receiving block 180 is in either the first opposed position or the second opposed position. The cutting mechanism 500 can thus perform the half cut and the full cut operations in a stable manner.

The second contact surface 182 may be opposed to the blade portion 275A when the receiving block 180 is in the first opposed position. The first contact surface 181 may be opposed to the blade portion 275A when the receiving block 180 is in the second opposed position. In this case, when the cutting mechanism 500 performs the full cut operation, the cutting mechanism 500 may move the cutting blade 275 from the separated position to the contact position while maintaining the receiving block 180 in the state of being stopped in the first opposed position. The cutting mechanism 500 can thus perform the full cut operation in a stable manner.

The driving source of the cutting blade movement mechanism 200 and the receiving block swinging mechanism 520 is not limited to the DC motor 104 and may be a stepping motor, for example.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A cutting device comprising:

a cutting blade that includes a blade portion;

a receiving block that includes a contact surface contactable by the blade portion, the contact surface including a first contact surface and a second contact surface;

a motor configured to rotate;

a cutting blade movement mechanism that supports the cutting blade, the cutting blade movement mechanism being configured to move the cutting blade between a separated position and a contact position in concert with a rotation of the motor, the separated position being a position in which the blade portion is separated from the contact surface, and the contact position being a position in which the blade portion is in contact with the contact surface; and a receiving block movement mechanism configured to move the receiving block linearly from a first opposed position to a second opposed position in concert with the rotation of the motor, the first opposed position being a position in which one of the first contact surface and the second contact surface is opposed to the blade portion, the second opposed position being a position in which the other one of the first contact surface and the second contact surface is opposed to the blade portion.

2. The cutting device according to claim 1, wherein:

the motor is configured to rotate in a forward direction and a reverse direction, the receiving block movement mechanism comprises:

a first gear that includes a first toothed portion, the first toothed portion being provided on a part of a circumferential surface of the first gear, the first gear being configured to rotate in a first rotation direction in concert with the rotation in the forward direction of the motor, the first gear being configured to rotate in a second rotation direction in concert with the rotation in the reverse direction of the motor, and the second rotation direction being a rotation direction opposite to the first rotation direction;

a second gear that includes a second toothed portion, the second toothed portion being provided on a circumferential surface of the second gear, the second toothed portion being configured to mesh with the first toothed portion, and the second gear being configured to be rotated by a first rotation angle by the first gear rotating in the second rotation direction; and a cam member configured to move the receiving block linearly from the first opposed position to the second opposed position by rotating in a third rotation direction in concert with the rotation by the first rotation angle of the second gear, a toothed portion formation angle is equal to or greater than a second rotation angle, the toothed portion formation angle being an angle from a first end portion to a second end portion in the first rotation direction, the first end portion being an end portion of the first toothed portion in the second rotation direction, the second end portion being an end portion of the first toothed portion in the first rotation direction, and the second rotation angle being a rotation angle of the first gear that causes the second gear to rotate by the first rotation angle, and a toothed portion non-formation angle is equal to or greater than a third rotation angle, the toothed portion non-formation angle being an angle from the first end portion to the second end portion in the second rotation direction, and the third rotation direction being a rotation angle by which the first gear rotates while the cutting blade moves from the separated position to the contact position in concert with the rotation in the forward direction of the motor.

3. The cutting device according to claim 2, wherein the second rotation angle is smaller than the third rotation angle.

4. The cutting device according to claim 3, wherein:

the cam member is configured to rotate around a first shaft portion, the first shaft portion extending in parallel to a movement direction of the receiving block, the cam member including a cam surface, the cam surface including a portion extending gradually to a first specified direction in a fourth rotation direction, the first specified direction being a specified direction of the movement direction, and the fourth rotation direction being a rotation direction, around the first shaft portion, opposite to the third rotation direction, a distance from a third end portion to a fourth end portion in the first specified direction is equal to a movement distance, the third end portion being an end portion of the cam surface in an opposite direction to the first specified direction, the fourth end portion being an end portion of the cam surface in the first specified direction, and the movement distance being a distance over which the receiving block moves from the first opposed position to the second opposed position, an angle from the third end portion to the fourth end portion in the fourth rotation direction is equal to a rotation angle of the cam member caused to rotate by the second gear rotating by the first rotation angle, the receiving block movement mechanism is provided on the receiving block, and the receiving block movement mechanism includes a sliding portion configured to slide with respect to the cam surface in accordance with the rotation of the cam member in the third rotation direction.

5. The cutting device according to claim 4, wherein:

the cam surface comprises:

a first cam surface gradually extending to the first specified direction in the fourth rotation direction, a length of the first cam surface in the first specified direction being equal to the movement distance; and a second cam surface connected to an end portion of the first cam surface in the opposite direction and extending in a separating direction and the first specified direction, the separating direction being a direction of separation from the first shaft portion, the cam member includes a specific cam surface extending in the third rotation direction from an end portion of the second cam surface in the separating direction, the sliding portion is configured to rotate around a second shaft portion extending in the movement direction, the sliding portion being configured to rotate between a first rotation position and a second rotation position, the first rotation position being a position in which the sliding portion slides with respect to the cam surface, and the second rotation position being a position in which the sliding portion slides with respect to the specific cam surface, and the receiving block movement mechanism comprises:

a support member configured to move in the first specified direction, the support member including a support portion and a regulating portion, the support portion being configured to support the second shaft portion, and the regulating portion being configured to inhibit the sliding portion in the first rotation position from rotating in a direction from the second rotation position toward the first rotation position; and an urging member configured to urge the sliding portion in the opposite direction.

6. The cutting device according to claim 5, wherein the cam surface includes a third cam surface, the third cam surface connecting an end portion of the first cam surface in the fourth rotation direction and an end portion of the second cam surface in the first specified direction, and the third cam surface extending in parallel to the fourth rotation direction on a side of the first specified direction with respect to the specific cam surface.

7. The cutting device according to claim 4, wherein:

two of the cam surfaces are arranged with a gap between the two of the cam surfaces in the first specified direction, and the sliding portion is configured to enter into the gap between the two of the cam surfaces.

8. The cutting device according to claim 7, wherein each of the two of the cam surfaces comprises:

a first sliding surface extending gradually to the first specified direction in the fourth rotation direction, a length of the first sliding surface in the first specified direction being equal to the movement distance; and a second sliding surface extending in the fourth rotation direction from the end portion of the first sliding surface in the fourth rotation direction.

9. The cutting device according to claim 1, wherein:

the first opposed position is a position in which the first contact surface is opposed to the blade portion, and the second opposed position is a position in which the second contact surface is opposed to the blade portion.

10. A printer comprising the cutting device according to claim 1, further comprising:

a print portion configured to perform printing on an object to be cut; and a supply portion configured to supply, to the cutting device, the object on which the printing has been performed by the print portion.

11. The cutting device according to claim 1, wherein the first contact surface includes two portions that are contactable by the blade portion and that are aligned with a recessed portion between the two portions, and the second contact surface is a continuous portion contactable by the blade portion.

12. A cutting device comprising:

a cutting blade that includes a blade portion;

a receiving block that includes a contact surface contactable by the blade portion, the contact surface including a first contact surface and a second contact surface;

a motor configured to rotate;

a cutting blade movement mechanism that supports the cutting blade, the cutting blade movement mechanism being configured to move the cutting blade between a separated position and a contact position in concert with a rotation of the motor, the separated position being a position in which the blade portion is separated from the contact surface, and the contact position being a position in which the blade portion is in contact with the contact surface; and a receiving block movement mechanism configured to move the receiving block linearly from a first opposed position to a second opposed position in concert with the rotation of the motor, the first opposed position being a position in which one of the first contact surface and the second contact surface is opposed to the blade portion, the second opposed position being a position in which the other one of the first contact surface and the second contact surface is opposed to the blade portion, wherein:

the motor is configured to rotate in a forward direction and a reverse direction, the receiving block movement mechanism includes a support portion and a first fulcrum portion, the support portion supporting the receiving block, and the first fulcrum portion swingably supporting the support portion, and the receiving block movement mechanism is configured to swing the receiving block between the first opposed position and the second opposed position by swinging the support portion with the first fulcrum portion as a fulcrum in concert with the rotation of the motor.

13. The cutting device according to claim 12, wherein:

the cutting blade movement mechanism comprises:

a first rotating member configured to move the cutting blade between the separated position and the contact position by rotating by a specified angle when the motor rotates in the forward direction and when the motor rotates in the reverse direction; and a second rotating member that includes a pressing portion, the pressing portion being configured to cause the first rotating member to rotate by pressing the first rotating member, and the second rotating member is configured to rotate to one of positions including an initial position, a first final position, an intermediate position, and a second final position in concert with the rotation of the motor, the second rotating member is configured to rotate by a first rotation angle in a first rotation direction from the initial position to the first final position in concert with the rotation of the motor in the forward direction and to cause the first rotating member to rotate by the specified angle by the pressing portion pressing the first rotating member, the pressing portion is configured to separate from the first rotating member when the second rotating member rotates by a second rotation angle in a second rotation direction from the initial position to the intermediate position in concert with the rotation of the motor in the reverse direction, the second rotation direction being a rotation direction opposite to the first rotation direction, the second rotating member is configured to rotate by a third rotation angle in the second rotation direction from the intermediate position to the second final position in concert with the rotation of the motor in the reverse direction and to cause the first rotating member to rotate by the specified angle by the pressing portion pressing the first rotating member, the receiving block movement mechanism comprises:

a cam surface formed on a surface, of the second rotating member, intersecting a second specified direction, the second specified direction being a direction in which a shaft portion that is a center of rotation of the second rotating member extends, the cam surface including a first cam surface, a second cam surface, and a third cam surface, the first cam surface extending in the first rotation direction, the first cam surface including a first end portion in the second rotation direction and a second end portion in the first rotation direction, the second cam surface extending in the first rotation direction from the second end portion, the second cam surface being inclined in the second specified direction with respect to the first rotation direction, the second cam surface including a third end portion in the second rotation direction and a fourth end portion in the first rotation direction, the third cam surface extending in the first rotation direction from the fourth end portion, and the third cam surface including a fifth end portion in the second rotation direction and a sixth end portion in the first rotation direction; and a sliding portion provided on a portion of the support portion on an opposite side, with respect to the first fulcrum portion, to the receiving block, the sliding portion being a portion configured to slide with respect to the cam surface, the sliding portion is configured to cause the receiving block to be positioned in the first opposed position when the sliding portion slides with respect to the first cam surface, the sliding portion is configured to cause the receiving block to be positioned in the second opposed position when the sliding portion slides with respect to the third cam surface, a first cam angle is equal to or greater than the first rotation angle, the first cam angle being an angle from the first end portion to the second end portion in the first rotation direction, a second cam angle is equal to or smaller than the second rotation angle, the second cam angle being an angle from the third end portion to the fourth end portion in the first rotation direction, and a third cam angle is equal to or greater than the third rotation angle, the third cam angle being an angle from the fifth end portion to the sixth end portion in the first rotation direction.

14. The cutting device according to claim 12, further comprising:

a guide portion configured to guide an object to be cut in a third specified direction, the third specified direction being a specified direction with respect to the receiving block, wherein:

the cutting blade is configured to clamp the object guided by the guide portion between the cutting blade and the contact surface when the cutting blade is in the separated position, and the support portion supports the receiving block on a side of the third specified direction of the guide portion.

15. The cutting device according to claim 12, wherein the support portion includes a second fulcrum portion, the second fulcrum portion swingably supporting the receiving block above a center of gravity position of the receiving block.

16. The cutting device according to claim 12, wherein:

the first opposed position is a position in which the first contact surface is opposed to the blade portion, and the second opposed position is a position in which the second contact surface is opposed to the blade portion.

17. A printer comprising the cutting device according to claim 12, further comprising:

a print portion configured to perform printing on an object to be cut; and a supply portion configured to supply, to the cutting device, the object on which the printing has been performed by the print portion.

18. The cutting device according to claim 12, wherein the first contact surface includes two portions that are contactable by the blade portion and that are aligned with a recessed portion between the two portions, and the second contact surface is a continuous portion contactable by the blade portion.

19. A cutting device comprising:

a cutting blade that includes a blade portion;

a receiving block that includes a contact surface contactable by the blade portion, the contact surface including a first contact surface and a second contact surface;

a motor configured to rotate;

a cutting blade movement mechanism that supports the cutting blade, the cutting blade movement mechanism being configured to move the cutting blade between a separated position and a contact position in concert with a rotation of the motor, the separated position being a position in which the blade portion is separated from the contact surface, and the contact position being a position in which the blade portion is in contact with the contact surface; and a receiving block movement mechanism configured to move the receiving block linearly from a first opposed position to a second opposed position in concert with the rotation of the motor, the first opposed position being a position in which one of the first contact surface and the second contact surface is opposed to the blade portion, the second opposed position being a position in which the other one of the first contact surface and the second contact surface is opposed to the blade portion, wherein:

the motor is configured to rotate in a forward direction and a reverse direction, and the receiving block movement mechanism is configured to maintain the receiving block in a state of being stopped in the first opposed position when the motor rotates in the forward direction, by inhibiting a driving force of the motor from being transmitted to the receiving block, and the receiving block movement mechanism being configured to move the receiving block from the first opposed position to the second opposed position when the motor rotates in the reverse direction, by transmitting the driving force to the receiving block.

* * * * *